US009291017B2

(12) United States Patent
Zediker

(10) Patent No.: US 9,291,017 B2
(45) **Date of Patent: *Mar. 22, 2016**

(54) LASER ASSISTED SYSTEM FOR CONTROLLING DEEP WATER DRILLING EMERGENCY SITUATIONS

(71) Applicants: FORO ENERGY, INC., Littleton, CO (US); CHEVRON U.S.A. INC., Houston, TX (US)

(72) Inventor: Mark S. Zediker, Castle Rock, CO (US)

(73) Assignees: Foro Energy, Inc., Houston, TX (US); Chevron U.S.A. Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/270,288

(22) Filed: May 5, 2014

(65) Prior Publication Data

US 2014/0345872 A1 Nov. 27, 2014

Related U.S. Application Data

(63) Continuation of application No. 13/034,037, filed on Feb. 24, 2011, now Pat. No. 8,720,584.

(51) Int. Cl.

| | |
|---|---|
| ***E21B 29/12*** | (2006.01) |
| ***E21B 29/02*** | (2006.01) |
| ***E21B 34/04*** | (2006.01) |
| ***E21B 33/064*** | (2006.01) |

(Continued)

(52) U.S. Cl.

CPC ..... *E21B 29/12* (2013.01); *E21B 17/01* (2013.01); *E21B 17/085* (2013.01); *E21B 17/18* (2013.01); *E21B 29/08* (2013.01); *E21B 33/063* (2013.01)

(58) Field of Classification Search

CPC ..... E21B 29/08; E21B 43/11; E21B 29/002; E21B 29/005; E21B 43/1185; E21B 43/116; E21B 31/16

USPC ..... 166/361, 363, 364, 297, 298, 55, 55.6, 166/85.4; 137/315.02; 251/1.1, 1.2, 1.3; 219/121.67, 121.72

See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |

(Continued)

FOREIGN PATENT DOCUMENTS

| | | | |
|---|---|---|---|
| EP | 0 565 287 | A1 | 10/1993 |
| EP | 0 950 170 | B1 | 9/2002 |

(Continued)

OTHER PUBLICATIONS

U.S. Appl. No. 12/543,968, filed Aug. 19, 2009, Rinzler et al.

(Continued)

*Primary Examiner* — Matthew R Buck
*Assistant Examiner* — Edwin Toledo-Duran
(74) *Attorney, Agent, or Firm* — Glen P. Belvis; Steptoe & Johnson LLP

(57) ABSTRACT

There is provided a high power laser riser blowout preventer system and controller for operation thereof. The system utilizes high power laser cutters that are associated with the riser and the blowout preventer to provide an integrated operation to quickly weaken or cut tubulars to address potential emergency and emergency situations that can arise during deep sea drilling.

50 Claims, 34 Drawing Sheets

(51) Int. Cl.

| | |
|---|---|
| ***E21B 43/116*** | (2006.01) |
| ***E21B 43/119*** | (2006.01) |
| ***E21B 29/08*** | (2006.01) |
| ***E21B 29/00*** | (2006.01) |
| ***E21B 33/06*** | (2006.01) |
| ***E21B 17/01*** | (2006.01) |
| ***E21B 17/08*** | (2006.01) |
| ***E21B 17/18*** | (2006.01) |

(56) References Cited

U.S. PATENT DOCUMENTS 2,742,555 A 4/1956 Murray
3,122,212 A 2/1964 Karlovitz
3,168,334 A 2/1965 Johnson
3,461,964 A * 8/1969 Venghiattis ..... E21B 7/15 166/297
3,493,060 A 2/1970 Van Dyk
3,539,221 A 11/1970 Gladstone
3,544,165 A 12/1970 Snedden
3,556,600 A 1/1971 Shoupp et al.
3,561,526 A 2/1971 Williams et al.
3,574,357 A 4/1971 Alexandru et al.
3,652,447 A 3/1972 Yant
3,693,718 A 9/1972 Stout
3,820,605 A 6/1974 Barber et al.
3,821,510 A 6/1974 Muncheryan
3,871,485 A 3/1975 Keenan, Jr.
3,882,945 A 5/1975 Keenan, Jr.
3,913,668 A 10/1975 Todd et al.
3,938,599 A 2/1976 Horn
3,960,448 A 6/1976 Schmidt et al.
3,977,478 A 8/1976 Shuck
3,981,369 A 9/1976 Bokenkamp
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,043,575 A 8/1977 Roth
4,046,191 A * 9/1977 Neath ..... E21B 21/001 166/352
4,061,190 A 12/1977 Bloomfield
4,066,138 A 1/1978 Salisbury et al.
4,081,027 A * 3/1978 Nguyen ..... E21B 29/08 116/55
4,086,971 A 5/1978 Hall et al.
4,090,572 A 5/1978 Welch
4,113,036 A 9/1978 Stout
4,189,705 A 2/1980 Pitts, Jr.
4,194,536 A 3/1980 Stine et al.
4,199,034 A 4/1980 Salisbury et al.
4,227,582 A * 10/1980 Price ..... E21B 7/15 166/297
4,228,856 A 10/1980 Reale
4,252,015 A 2/1981 Harbon et al.
4,256,146 A 3/1981 Genini et al.
4,266,609 A 5/1981 Rom et al.
4,280,535 A 7/1981 Willis
4,282,940 A 8/1981 Salisbury et al.
4,332,401 A 6/1982 Stephenson et al.
4,336,415 A 6/1982 Walling
4,340,245 A 7/1982 Stalder
4,370,886 A 2/1983 Smith, Jr. et al.
4,374,530 A 2/1983 Walling
4,375,164 A 3/1983 Dodge et al.
4,415,184 A 11/1983 Stephenson et al.
4,417,603 A 11/1983 Argy
4,444,420 A 4/1984 McStravick et al.
4,453,570 A 6/1984 Hutchison
4,459,731 A 7/1984 Hutchison
4,477,106 A 10/1984 Hutchison
4,531,552 A 7/1985 Kim
4,533,814 A * 8/1985 Ward ..... B23K 26/282 219/121.63
4,565,351 A 1/1986 Conti et al.
4,662,437 A 5/1987 Renfro
4,694,865 A 9/1987 Tauschmann
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,923,008 A * 5/1990 Wachowicz ..... E21B 29/08 137/14
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,070,904 A 12/1991 McMahon et al.
5,078,546 A * 1/1992 Fisk ..... E21B 7/205 138/97
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,140,664 A 8/1992 Bosisio et al.
5,163,321 A 11/1992 Perales
5,172,112 A 12/1992 Jennings
5,212,755 A 5/1993 Holmberg
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,396,805 A 3/1995 Surjaatmadja
5,400,857 A 3/1995 Whitby et al.
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,561,516 A 10/1996 Noble et al.
5,566,764 A 10/1996 Elliston
5,573,225 A 11/1996 Boyle et al.
5,577,560 A 11/1996 Coronado et al.
5,599,004 A 2/1997 Newman et al.
RE35,542 E * 6/1997 Fisk ..... E21B 7/205 138/97
5,638,904 A 6/1997 Misselbrook et al.
5,655,745 A 8/1997 Morrill
5,657,823 A 8/1997 Kogure et al.
5,694,408 A 12/1997 Bott et al.
5,735,502 A 4/1998 Levett et al.
5,757,484 A 5/1998 Miles et al.
5,771,974 A 6/1998 Stewart et al.
5,771,984 A 6/1998 Potter et al.
5,847,825 A 12/1998 Alexander
5,862,273 A 1/1999 Pelletier
5,864,113 A 1/1999 Cossi
5,896,482 A 4/1999 Blee et al.
5,896,938 A 4/1999 Moeny et al.
5,902,499 A 5/1999 Richerzhagen
5,924,489 A 7/1999 Hatcher

(56) References Cited

U.S. PATENT DOCUMENTS 5,929,986 A 7/1999 Slater et al.
5,986,236 A 11/1999 Gainand et al.
5,986,756 A 11/1999 Slater et al.
RE36,525 E 1/2000 Pringle
6,015,015 A 1/2000 Luft et al.
6,026,905 A * 2/2000 Garcia-Soule ..... E21B 34/045 166/336
6,032,742 A 3/2000 Tomlin et al.
6,038,363 A 3/2000 Slater et al.
6,047,781 A 4/2000 Scott et al.
RE36,723 E 6/2000 Moore et al.
6,084,203 A 7/2000 Bonigen
6,104,022 A 8/2000 Young et al.
RE36,880 E 9/2000 Pringle
6,116,344 A * 9/2000 Longbottom ..... E21B 29/06 166/298
6,147,754 A 11/2000 Theriault et al.
6,166,546 A 12/2000 Scheihing et al.
6,173,770 B1 1/2001 Morrill
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,301,423 B1 10/2001 Olson
6,321,839 B1 11/2001 Vereecken et al.
6,325,159 B1 12/2001 Peterman et al.
6,328,343 B1 12/2001 Hosie et al.
6,352,114 B1 3/2002 Toalson et al.
6,355,928 B1 3/2002 Skinner et al.
6,356,683 B1 3/2002 Hu et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,497,290 B1 12/2002 Misselbrook et al.
6,543,538 B2 * 4/2003 Tolman ..... E21B 33/124 166/278
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,710,720 B2 3/2004 Carstensen et al.
6,712,150 B1 3/2004 Misselbrook et al.
6,719,042 B2 4/2004 Johnson et al.
6,725,924 B2 * 4/2004 Davidson ..... E21B 41/0014 166/250.01
6,737,605 B1 5/2004 Kern
6,746,182 B2 6/2004 Munk et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,860,525 B2 3/2005 Parks
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,957,576 B2 10/2005 Skinner et al.
6,967,322 B2 11/2005 Jones et al.
6,978,832 B2 12/2005 Gardner et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,467 B2 8/2006 Schlegelmilch et al.
7,086,484 B2 8/2006 Smith, Jr.
7,087,865 B2 8/2006 Lerner
7,126,332 B2 10/2006 Blanz et al.
7,134,488 B2 11/2006 Tudor et al.
7,147,064 B2 12/2006 Batarseh et al.
7,172,026 B2 2/2007 Misselbrook
7,195,731 B2 3/2007 Jones
7,199,869 B2 4/2007 MacDougall
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,367,396 B2 5/2008 Springett et al.
7,395,696 B2 7/2008 Bissonnette et al.
7,395,866 B2 7/2008 Milberger et al.
7,416,032 B2 8/2008 Moeny et al.
7,416,258 B2 8/2008 Reed et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 De Monmorillon et al.
7,591,315 B2 9/2009 Dore et al.
7,600,564 B2 10/2009 Shampine et al.
7,671,983 B2 3/2010 Shammai et al.
7,779,917 B2 8/2010 Kotrla et al.
7,802,384 B2 9/2010 Kobayashi et al.
7,832,477 B2 * 11/2010 Cavender ..... E21B 43/103 166/206
7,938,175 B2 5/2011 Skinner et al.
7,980,306 B2 * 7/2011 Lovell ..... E21B 17/206 166/250.01
8,056,633 B2 * 11/2011 Barra ..... E21B 19/002 166/298
8,322,441 B2 12/2012 Fenton
2002/0039465 A1 4/2002 Skinner
2002/0189806 A1 12/2002 Davidson et al.
2003/0000741 A1 1/2003 Rosa
2003/0021634 A1 1/2003 Munk et al.
2003/0053783 A1 3/2003 Shirasaki
2003/0085040 A1 5/2003 Hemphill et al.
2003/0094281 A1 5/2003 Tubel
2003/0132029 A1 7/2003 Parker
2003/0136927 A1 7/2003 Baugh
2003/0145991 A1 8/2003 Olsen
2004/0006429 A1 1/2004 Brown
2004/0016295 A1 1/2004 Skinner et al.
2004/0020643 A1 2/2004 Thomeer et al.
2004/0033017 A1 2/2004 Kringlebotn et al.
2004/0074979 A1 4/2004 McGuire
2004/0093950 A1 5/2004 Bohnert
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0012244 A1 1/2005 Jones
2005/0094129 A1 5/2005 MacDougall
2005/0099618 A1 5/2005 DiFoggio et al.

(56) References Cited

U.S. PATENT DOCUMENTS

2005/0201652 A1 9/2005 Ellwood, Jr.
2005/0212284 A1 9/2005 Dole
2005/0230107 A1 10/2005 McDaniel et al.
2005/0252286 A1 11/2005 Ibrahim et al.
2005/0268704 A1 12/2005 Bissonnette et al.
2005/0269132 A1 12/2005 Bissonnette et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0065815 A1 3/2006 Jurca
2006/0102343 A1 5/2006 Skinner et al.
2006/0118303 A1 6/2006 Schultz et al.
2006/0185843 A1 8/2006 Smith, Jr.
2006/0191684 A1 8/2006 Smith, Jr.
2006/0201682 A1 9/2006 Reynolds
2006/0204188 A1 9/2006 Clarkson et al.
2006/0231257 A1 10/2006 Reed et al.
2006/0237233 A1 10/2006 Reed et al.
2007/0125163 A1 6/2007 Dria et al.
2007/0227741 A1 10/2007 Lovell et al.
2007/0247701 A1 10/2007 Akasaka et al.
2007/0267220 A1 11/2007 Magiawala et al.
2007/0280615 A1 12/2007 de Montmorillon et al.
2008/0078081 A1 4/2008 Huff et al.
2008/0093125 A1 4/2008 Potter et al.
2008/0099701 A1 5/2008 Whitby et al.
2008/0138022 A1 6/2008 Tassone
2008/0180787 A1 7/2008 DiGiovanni et al.
2008/0245568 A1 10/2008 Jeffryes
2008/0273852 A1 11/2008 Parker et al.
2009/0050371 A1 2/2009 Moeny
2009/0133929 A1 5/2009 Rodland
2009/0205675 A1 8/2009 Sarker et al.
2009/0260829 A1 10/2009 Mathis
2009/0272424 A1 11/2009 Ortabasi
2009/0279835 A1 11/2009 de Montmorillon et al.
2009/0294050 A1 12/2009 Traggis et al.
2010/0000790 A1 1/2010 Moeny
2010/0001179 A1 1/2010 Kobayashi et al.
2010/0032207 A1 2/2010 Potter et al.
2010/0044102 A1 2/2010 Rinzler
2010/0044103 A1 2/2010 Moxley
2010/0044104 A1 2/2010 Zediker
2010/0044105 A1 2/2010 Faircloth
2010/0044106 A1 2/2010 Zediker
2010/0051847 A1 3/2010 Mailand et al.
2010/0071794 A1 3/2010 Homan
2010/0078414 A1 4/2010 Perry et al.
2010/0089574 A1 4/2010 Wideman et al.
2010/0089576 A1 4/2010 Wideman et al.
2010/0089577 A1 4/2010 Wideman et al.
2010/0147528 A1 6/2010 Baugh
2010/0164223 A1 7/2010 Curtiss, III et al.
2010/0197116 A1 8/2010 Shah et al.
2010/0215326 A1 8/2010 Zediker
2010/0218955 A1 9/2010 Hart
2010/0326659 A1 12/2010 Schultz et al.
2010/0326665 A1 12/2010 Redlinger et al.
2011/0030367 A1 2/2011 Dadd
2012/0000646 A1 1/2012 Liotta et al.
2012/0020631 A1 1/2012 Rinzler
2012/0061091 A1 3/2012 Radi
2012/0067643 A1 3/2012 DeWitt
2012/0068086 A1 3/2012 DeWitt
2012/0074110 A1 3/2012 Zediker
2012/0217015 A1 8/2012 Zediker
2012/0217017 A1 8/2012 Zediker
2012/0217018 A1 8/2012 Zediker
2012/0217019 A1 8/2012 Zediker
2012/0248078 A1 10/2012 Zediker
2012/0255774 A1 10/2012 Grubb
2012/0255933 A1 10/2012 McKay
2012/0261188 A1 10/2012 Zediker
2012/0266803 A1 10/2012 Zediker
2012/0267168 A1 10/2012 Grubb
2012/0273269 A1 11/2012 Rinzler
2012/0273470 A1 11/2012 Zediker
2012/0275159 A1 11/2012 Fraze
2013/0011102 A1 1/2013 Rinzler
2013/0161007 A1* 6/2013 Wolfe ..... E21B 43/11857 166/297
2013/0168081 A1* 7/2013 Yang ..... E21B 47/122 166/247
2013/0175090 A1 7/2013 Zediker
2013/0192893 A1 8/2013 Zediker
2013/0192894 A1 8/2013 Zediker
2013/0220626 A1 8/2013 Zediker et al.
2013/0228372 A1 9/2013 Linyaev
2013/0228557 A1 9/2013 Zediker
2013/0266031 A1 10/2013 Norton
2013/0319984 A1 12/2013 Linyaev
2014/0000902 A1 1/2014 Wolfe
2014/0060802 A1 3/2014 Zediker
2014/0060930 A1 3/2014 Zediker
2014/0069896 A1 3/2014 Deutch
2014/0090846 A1 4/2014 Deutch
2014/0190949 A1 7/2014 Zediker
2014/0231085 A1 8/2014 Zediker
2014/0231398 A1 8/2014 Land
2014/0248025 A1 9/2014 Rinzler

FOREIGN PATENT DOCUMENTS

FR 2 716 924 A1 9/1995
JP 63242483 A 10/1988
JP 09072738 A 3/1997
WO WO 97/49893 A1 12/1997
WO WO 98/50673 A1 11/1998
WO WO 02/057805 A2 7/2002
WO WO 2004/009958 A1 1/2004
WO WO 2006/008155 A1 1/2006
WO WO 2006/054079 A1 5/2006
WO WO 2010/060177 A1 6/2010

OTHER PUBLICATIONS

U.S. Appl. No. 12/543,986, filed Aug. 19, 2009, Moxley et al.
U.S. Appl. No. 12/544,038, filed Aug. 19, 2009, Zediker et al.
U.S. Appl. No. 12/544,094, filed Aug. 19, 2009, Faircloth et al.
U.S. Appl. No. 12/544,136, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,509, filed Feb. 23, 2012, Fraze et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Jun. 1, 2012, Rinzler et al.
U.S. Appl. No. 13/565,345, filed Aug. 2, 2012, Zediker et al.
U.S. Appl. No. 13/777,650, filed Feb. 26, 2013, Zediker et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
Related utility U.S. Appl. No. 13/565,345, filed Aug. 2, 2012, 112 pages.
International Search Report for PCT Application No. PCT/US09/54295, dated Apr. 26, 2010, 16 pgs.

(56) References Cited

OTHER PUBLICATIONS

International Search Report and Written Opinion for PCT App. No. PCT/US10/24368, dated Nov. 2, 2010, 16 pgs.
International Search Report for PCT Application No. PCT/US2012/026471, dated May 30, 2012, 13 pgs.
International Search Report for PCT Application No. PCT/US2012/026494, dated May 31, 2012, 12 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
Agrawal Dinesh et al., Report on "Development of Advanced Drill Components for BHA Using Mircowave Technology Incorporating Carbide Diamond Composites and Functionally Graded Materials", believed to be published by Microwave Processing and Engineering Center, Material Research Institute, The Pennsylvania State University, 2003, 10 pgs.
Agrawal Dinesh et al., Report on "Graded Steel-Tungsten Cardide/Cobalt-Diamond Systems Using Microwave Heating", *Proceedings of the 2002 International Conference on Functionally Graded Materials*, 2002, pp. 50-58.
Agrawal Dinesh et al., "Microstructural Examination by TEM of WC/Co composites Prepared by Conventional and Microwave Processes", *15th International Plansee Seminar*, vol. 2, , 2001, pp. 677-684.
Agrawal, Govind P., "Nonlinear Fiber Optics", Chap. 9, Fourth Edition, believed to be published by Academic Press copyright 2007, pp. 334-337.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3, 1986, pp. 497-510.
Aydin, A. et al., "The Schmidt hammer in rock material characterization", *Engineering Geology*, vol. 81, 2005, pp. 1-14.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and Nd:YAG laser wavelengths", believed to be published by *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. SAND-84-7101, 1984, 196 pgs.
Batarseh, S. et al. "Well Perforation Using High-Power Lasers", *Society of Petroleum Engineers*, SPE 84418, 2003, pp. 1-10.
Author Unknown, "Geothermal Completion Technology Life-Cycle Cost Model (GEOCOM)", believed to be published by BDM Corporation, *Sandia National Laboratories*, for the U.S. Dept. of Energy, vols. 1 and 2, 1982, 222 pgs.
Beste, U. et al., "Micro-scratch evaluation of rock types—a means to comprehend rock drill wear", *Tribology International*, vol. 37, 2004, pp. 203-210.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Britz, Dieter, "Digital Simulation in Electrochemistry", *Lect. Notes Phys.*, vol. 666, 2005, pp. 103-117.
Browning, J. A. et al., "Recent Advances in Flame Jet Working of Minerals", *7th Symposium on Rock Mechanics*, 1965, pp. 281-313.
Cardenas, R., "Protected Polycrystalline Diamond Compact Bits for Hard Rock Drilling", Report No. DOE-99049-1381, believed to be published by U.S. Department of Energy, 2000, pp. 1-79.
Carstens, Jeffrey et al., "Heat-Assisted Tunnel Boring Machines", *Federal Railroad Administration and Urban Mass Transportation Administration*, believed to be published by U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International* 102287, 2006, pp. 1-10.
Close, F. et al., "Successful Drilling of Basalt in a West of Shetland Deepwater Discovery", *SPE International* 96575, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", believed to be published by *Geothermal Research Division, Sandia National Laboratories*, 1987, pp. 1-6.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", believed to be published by *U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept.*, believed to be published by *University of Southwestern Louisiana and Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", believed to be published by *Gas Technology Institute, Colorado School of Mines, Halliburton Energy Services, Argonne National Laboratory*, 2002, pp. 1-13.
Finger, John T. et al., "PDC Bit Research at Sandia National Laboratories", believed to be published by *Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Effect of Downhole Pressure Conditions on High-Power Laser Perforation", *Society of Petroleum Engineers*, SPE 97093, 2005, pp. 1-7.

(56) References Cited

OTHER PUBLICATIONS

Gahan, B. C. et al., "Laser Drilling: Determination of Energy Required to Remove Rock", *Society of Petroleum Engineers International*, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", believed to be published by *Sandia National Laboratories*, SAND-85-0666C, DE85 008313, 1985, pp. 1-23.
Glowka, David A., "Development of a Method for Predicting the Performance and Wear of PDC Drill Bits", believed to be published by *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", believed to be published by *Sandia National Laboratories*, SAND 93-1953, 1993, pp. 1-50.
Glowka, David A. et al., "Progress in the Advanced Synthetic-Diamond Drill Bit Program", believed to be published by *Sandia National Laboratories*, SAND95-2617C, 1994, pp. 1-9.
Glowka, David A., "The Use of Single-Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, believed to be published by *Petroleum Engineering Department, Colorado School of Mines*, 2001, pp. 1-157.
Gurarie, V. N., "Stress resistance parameters of brittle solids under laser/plasma pulse heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, pp. 1-242.
Hareland, G. et al., "Cutting Efficiency of a Single PDC Cutter on Hard Rock", *Journal of Canadian Petroleum Technology*, vol. 48, No. 6, 2009, pp. 1-6.
Hashida, T. et al., "Numerical simulation with experimental verification of the fracture behavior in granite under confining pressures based on the tension-softening model", *International Journal of Fracture*, vol. 59, 1993, pp. 227-244.
Healy, Thomas E., "Fatigue Crack Growth in Lithium Hydride", believed to be published by *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Mechanisms for Polycrystalline-Diamond Compacts as Utilized for Drilling in Geothermal Environments", believed to be published by *Sandia National Laboratories*, for the United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, believed to be published by *Sandia National Laboratories*, SAND81-1404, 1981, pp. 1-35.
Huff, C. F. et al., "Recent Developments in Polycrystalline Diamond-Drill-Bit Design", believed to be published by *Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", believed to be published by *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kubacki, Emily et al., "Optics for Fiber Laser Applications", believed to be published by *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", believed to be published by *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", believed to be published by *Sandia National Laboratories*, SAND-81-1470C, 1981, pp. 1-6.
Lomov, I. N. et al., "Explosion in the Granite Field: Hardening and Softening Behavior in Rocks".
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", believed to be published by *National Energy Technology Laboratory*, 2007, pp. 1-6.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
Marshall, David B. et al., "Indentation of Brittle Materials", *Microindentation Techniques in Materials Science and Engineering, ASTM STP 889; American Society for Testing and Materials*, 1986, pp. 26-46.

(56) References Cited

OTHER PUBLICATIONS

Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Mocofanescu, A. et al., "SBS threshold for single mode and multimode GRIN fibers in an all fiber configuration", *Optics Express*, vol. 13, No. 6, 2005, pp. 2019-2024.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, believed to be published by *Sandia National Laboratories*, 1982, 23 pgs.
Ortega, Alfonso et al., "Studies of the Frictional Heating of Polycrystalline Diamond Compact Drag Tools During Rock Cutting", believed to be published by *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium.* Schubert (ed.), VGE, 2004, pp. 1-6.
Polsky, Yarom et al., "Enhanced Geothermal Systems (EGS) Well Construction Technology Evaluation Report", believed to be published by *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, pp. 1-10.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", believed to be published by *Massachusetts Institute of Technology*, submitted in partial fulfillment of doctorate degree, 1986, pp. 1-583.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", believed to be published by *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shannon, G. J. et al., "High power laser welding in hyperbaric gas and water environments", *Journal of Laser Applications*, vol. 9, 1997, pp. 129-136.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", believed to be published by *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.

(56) References Cited

OTHER PUBLICATIONS

Tanaka, K. et al., "The Generalized Relationship Between the Parameters C and m of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
Author unknown, "Chapter 6—Drilling Technology and Costs", from Report for the Future of Geothermal Energy, believed to be published by the U.S. Dept. of Energy, 2005, 53 pgs.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol.*, vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", believed to be published by *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electra-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", believed to be published by *Moscow Mining Institute.* (*Translated from Fiziko-Tekhnicheskie Problemy Razrabotki Poleznykh Iskopaemykh*), 1985, pp. 363-366.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated region", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt A PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", believed to be published by *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", believed to be published by *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", believed to be published by *National Aeronautics and Space Administration, Glenn Research Center*, NASA/TM-2000-210237, 2000, pp. 1-22.
Author unknown, "A Built-for-Purpose Coiled Tubing Rig", believed to be published by Schulumberger Wells,No. DE-PS26-03NT15474, 2006, p. 18.
Author unknown, "Diamond-Cutter Drill Bits", believed to be published by Geothermal Energy Program, Office of Geothermal and Wind Technologies, 2000, 2 pages.
Author unknown, "Introducing the XTC200DTR Plus", believed to be published by Extreme Drilling Corporation, 2009, 10 pages.
Author unknown, "IADC Dull Grading System for Fixed Cutter Bits", believed to be published by Hughes Christensen, 1996, 14 pages.
Author unknown, "Percussion Drilling Manual Impax™ Hammer Bit", by Smith Tool, 2002, 67 pages.
Author unknown, "Simple Drilling Methods", believed to be published by WEDC Loughborough University, United Kingdom, 1995, pp. 41-44.
Author unknown, "Capital Drilling Equipment Brochure", believed to be published by GE Oil & Gas Business, 2008, 15 pages.
Chastain, T. et al., "Deep Water Drilling System", *SPE Drilling Engineering*, Aug. 1986, pp. 325-328.
Author unknown, "Drilling Systems: Reliable to the Extremes", believed to be published by GE Oil & Gas (Drilling & Production) Brochure, 2009, 15 pages.
Author unknown, "Forensic Examination of Deepwater Horizon Blowout Preventer", a DNV (Det Norske Veritas) report for US Department of the Interior, Bureau of Ocean Energy Management, Regulation, and Enforcement, Mar. 20, 2011, 200 pages.
Author unknown, "Mini Shear Study", a West Engineering Services, Inc. Case Study for U.S. Minerals Management Services, Dec. 2002, pp. 1-16.
Author unknown, "Shear Ram Blowout Preventer Forces Required", believed to be published by Barringer and Associates, Inc., 2010, 17 pages.
Author unknown, "Shear Ram Capabilities Study", a West Engineering Services Study for US Minerals Management Services, Sep. 2004, 61 pages.
Related utility U.S. Appl. No. 13/777,650, filed Feb. 26, 2013, 73 pages.
Related utility U.S. Appl. No. 13/800,559, filed Mar. 13, 2013, 73 pages.
Related utility U.S. Appl. No. 13/800,820, filed Mar. 13, 2013, 73 pages.
Related utility U.S. Appl. No. 13/800,879, filed Mar. 13, 2013, 73 pages.
Related utility U.S. Appl. No. 13/800,933, filed Mar. 13, 2013, 73 pages.

* cited by examiner

LASER ASSISTED SYSTEM FOR CONTROLLING DEEP WATER DRILLING EMERGENCY SITUATIONS

This application is a continuation of Ser. No. 13/034,037, filed Feb. 24, 2011 (U.S. Pat. No. 8,720,584) the entire disclosures of each of which are incorporated herein by reference.

BACKGROUND OF THE INVENTION

1. Field of the Invention

The present inventions relate to systems used for offshore exploration and production of hydrocarbons, such as oil and natural gas. Thus, and in particular, the present inventions relate to novel systems that utilize high power laser cutters to quickly assist in the management and control of offshore drilling emergency events.

As used herein, unless specified otherwise the terms "blowout preventer," "BOP," and "BOP stack" are to be given their broadest possible meaning, and include: (i) devices positioned at or near the borehole surface, e.g., the seafloor, which are used to contain or manage pressures or flows associated with a borehole; (ii) devices for containing or managing pressures or flows in a borehole that are associated with a subsea riser; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring. As used herein, unless specified otherwise the terms "well" and "borehole" are to be given their broadest possible meaning and include any hole that is bored or otherwise made into the earth's surface, e.g., the seafloor or sea bed, and would further include exploratory, production, abandoned, reentered, reworked, and injection wells. As used herein the term "riser" is to be given its broadest possible meaning and would include any tubular that connects a platform at, on or above the surface of a body of water, including an offshore drilling rig, a floating production storage and offloading (FPSO) vessel, and a floating gas storage and offloading (FGSO) vessel, to a structure at, on, or near the seafloor for the purposes of activities such as drilling, production, workover, service, well service, intervention and completion.

As used herein the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms are to be given their broadest possible meaning and include two, three or four sections of drill pipe that have been connected, e.g., joined together, typically by joints having threaded connections. As used herein the terms "drill string," "string," "string of drill pipe," string of pipe" and similar type terms are to be given their broadest definition and would include a stand or stands joined together for the purpose of being employed in a borehole. Thus, a drill string could include many stands and many hundreds of sections of drill pipe.

As used herein the term "tubular" is to be given its broadest possible meaning and includes drill pipe, casing, riser, coiled tube, composite tube, production tubing, vacuum insulated tubing (VIT) and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise "high power laser energy" means a laser beam having at least about 1 kW (kilowatt) of power. As used herein, unless specified otherwise "great distances" means at least about 500 m (meter). As used herein the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

2. Discussion of Related Art

Deep Water Drilling

Offshore hydrocarbon exploration and production has been moving to deeper and deeper waters. Today drilling activities at depths of 5000 ft, 10,000 ft and even greater depths are contemplated and carried out. For example, its has been reported by RIGZONE, www.rigzone.com, that there are over 330 rigs rated for drilling in water depths greater than 600 ft (feet), and of those rigs there are over 190 rigs rated for drilling in water depths greater than 5,000 ft, and of those rigs over 90 of them are rated for drilling in water depths of 10,000 ft. When drilling at these deep, very-deep and ultra-deep depths the drilling equipment is subject to the extreme conditions found in the depths of the ocean, including great pressures and low temperatures at the seafloor.

Further, these deep water drilling rigs are capable of advancing boreholes that can be 10,000 ft, 20,000 ft, 30,000 ft and even deeper below the sea floor. As such, the drilling equipment, such as drill pipe, casing, risers, and the BOP are subject to substantial forces and extreme conditions. To address these forces and conditions drilling equipment, for example, risers, drill pipe and drill strings, are designed to be stronger, more rugged, and in may cases heavier. Additionally, the metals that are used to make drill pipe and casing have become more ductile.

Typically, and by way of general illustration, in drilling a subsea well an initial borehole is made into the seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward, in general, all drilling activity in the borehole takes place through the riser and the BOP.

The BOP, along with other equipment and procedures, is used to control and manage pressures and flows in a well. In general, a BOP is a stack of several mechanical devices that have a connected inner cavity extending through these devices. BOP's can have cavities, e.g., bore diameters ranging from about 4⅛" to 26¾." Tubulars are advanced from the offshore drilling rig down the riser, through the BOP cavity and into the borehole. Returns, e.g., drilling mud and cuttings, are removed from the borehole and transmitted through the BOP cavity, up the riser, and to the offshore drilling rig. The BOP stack typically has an annular preventer, which is an expandable packer that functions like a giant sphincter muscle around a tubular. Some annular preventers may also be used or capable of sealing off the cavity when a tubular is not present. When activated, this packer seals against a tubular that is in the BOP cavity, preventing material from flowing through the annulus formed between the outside diameter of the tubular and the wall of the BOP cavity. The BOP stack also typically has ram preventers. As used herein unless specified otherwise, the term "ram preventer" is to be given its broadest definition and would include any mechanical devices that clamp, grab, hold, cut, sever, crush, or combinations thereof, a tubular within a BOP stack, such as shear rams, blind rams, blind-shear rams, pipe rams, variable rams, variable pipe rams, casing shear rams, and preventers such as Hydril's HYDRIL PRESSURE CONTROL COMPACT Ram, Hydril Pressure Control Conventional Ram, HYDRIL PRESSURE CONTROL QUICK-LOG, and HYDRIL PRESSURE CONTROL SENTRY Workover, SHAFFER ram preventers, and ram preventers made by Cameron.

Thus, the BOP stack typically has a pipe ram preventer and my have more than one of these. Pipe ram preventers typically are two half-circle like clamping devices that are driven against the outside diameter of a tubular that is in the BOP cavity. Pipe ram preventers can be viewed as two giant hands that clamp against the tubular and seal-off the annulus between the tubular and the BOP cavity wall. Blind ram preventers may also be contained in the BOP stack, these rams can seal the cavity when no tubulars are present.

Pipe ram preventers and annular preventers typically can only seal the annulus between a tubular in the BOP and the BOP cavity; they cannot seal-off the tubular. Thus, in emergency situations, e.g., when a "kick" (a sudden influx of gas, fluid, or pressure into the borehole) occurs, or if a potential blowout situations arises, flows from high downhole pressures can come back up through the inside of the tubular, the annulus between the tubular and riser, and up the riser to the drilling rig. Additionally, in emergency situations, the pipe ram and annular preventers may not be able to form a strong enough seal around the tubular to prevent flow through the annulus between the tubular and the BOP cavity. Thus, BOP stacks include a mechanical shear ram assembly. Mechanical shear rams are typically the last line of defense for emergency situations, e.g., kicks or potential blowouts. (As used herein, unless specified otherwise, the term "shear ram" would include blind shear rams, shear sealing rams, shear seal rams, shear rams and any ram that is intended to, or capable of, cutting or shearing a tubular.) Mechanical shear rams function like giant gate valves that supposed to quickly close across the BOP cavity to seal it. They are intended to cut through any tubular is in the BOP cavity that would potentially block the shear ram from completely sealing the BOP cavity.

BOP stacks can have many varied configurations, which are dependent upon the conditions and hazards that are expected during deployment and use. These components could include, for example, an annular type preventer, a rotating head, a single ram preventer with one set of rams (blind or pipe), a double ram preventer having two sets of rams, a triple ram type preventer having three sets of rams, and a spool with side outlet connections for choke and kill lines. Examples of existing configurations of these components could be: a BOP stack having a bore of 7 1/16" and from bottom to top a single ram, a spool, a single ram, a single ram and an annular preventer and having a rated working pressure of 5,000 psi; a BOP stack having a bore of 13⅝" and from bottom to top a spool, a single ram, a single ram, a single ram and an annular preventer and having a rated working pressure of 10,000 psi; and, a BOP stack having a bore of 18¾" and from bottom to top, a single ram, a single ram, a single ram, a single ram, an annular preventer and an annular preventer and having a rated working pressure of 15,000 psi. (As used herein the term "preventer" in the context of a BOP stack, would include all rams, shear rams, and annular preventers, as well as, any other mechanical valve like structure used to restrict, shut-off or control the flow within a BOP bore.)

BOPs need to contain the pressures that could be present in a well, which pressures could be as great as 15,000 psi or greater. Additionally, there is a need for shear rams that are capable of quickly and reliably cutting through any tubular, including drilling collars, pipe joints, and bottom hole assemblies that might be present in the BOP when an emergency situation arises or other situation where it is desirable to cut tubulars in the BOP and seal the well. With the increasing strength, thickness and ductility of tubulars, and in particular tubulars of deep, very-deep and ultra-deep water drilling, there has been an ever increasing need for stronger, more powerful, and better shear rams. This long standing need for such shear rams, as well as, other information about the physics and engineering principles underlying existing mechanical shear rams, is set forth in: West Engineering Services, Inc., "Mini Shear Study for U.S. Minerals Management Services" (Requisition No. 2-1011-1003, December 2002); West Engineering Services, Inc., "Shear Ram Capabilities Study for U.S. Minerals Management Services" (Requisition No. 3-4025-1001, September 2004); and, Barringer & Associates Inc., "Shear Ram Blowout Preventer Forces Required" (Jun. 6, 2010, revised Aug. 8, 2010).

In an attempt to meet these ongoing and increasingly important needs, BOPs have become larger, heavier and more complicated. Thus, BOP stacks having two annular preventers, two shear rams, and six pipe rams have been suggested. These BOPs can weigh many hundreds of tons and stand 50 feet tall, or taller. The ever-increasing size and weight of BOPs presents significant problems, however, for older drilling rigs. Many of the existing offshore rigs do not have the deck space, lifting capacity, or for other reasons, the ability to handle and use these larger more complicated BOP stacks.

As used herein the term "riser" is to be given its broadest possible meaning and would include any tubular that connects a platform at, on or above the surface of a body of water, including an offshore drilling rig, a floating production storage and offloading ("FPSO") vessel, and a floating gas storage and offloading ("FGSO") vessel, to a structure at, on, or near the seafloor for the purposes of activities such as drilling, production, workover, service, well service, intervention and completion.

Risers, which would include marine risers, subsea risers, and drilling risers, are essentially large tubulars that connect an offshore drilling rig, vessel or platform to a borehole. Typically a riser is connected to the rig above the water level and to a BOP on the seafloor. Risers can be viewed as essentially a very large pipe, that has an inner cavity through which the tools and materials needed to drill a well are sent down from the offshore drilling rig to the borehole in the seafloor and waste material and tools are brought out of the borehole and back up to the offshore drilling rig. Thus, the riser functions like an umbilical cord connecting the offshore rig to the wellbore through potentially many thousands of feet of water.

Risers can vary in size, type and configuration. All risers have a large central or center tube that can have an outer diameters ranging from about 13⅜" to about 24" and can have wall thickness from about ⅝" to ⅞" or greater. Risers come in sections that can range in length from about 49 feet to about 82 feet, and typically for ultra deep water applications, are about 75 feet long. Thus, to have a riser extend from the rig to a BOP on the seafloor the rise sections are connected together by the rig and lowered to the seafloor.

The ends of each riser section have riser couplings that enable the large central tube of the riser sections to be connected together. The term "riser coupling" should be given its broadest possible meaning and includes various types of coupling that use mechanical means, such as, flanges, bolts, clips, bowen, lubricated, dogs, keys, threads, pins and other means of attachment known to the art or later developed by the art. Thus, by way of example riser couplings would include flange-style couplings, which use flanges and bolts; dog-style couplings, which use dogs in a box that are driven into engagement by an actuating screw; and key-style couplings, which use a key mechanism that rotates into locking engagement. An example of a flange-style coupling would be the VetcoGray HMF. An example of a dog-style coupling would be the VetcoGray MR-10E. An example of a key-style coupling would be the VetcoGray MR-6H SE Each riser section also has external pipes associated with the large central tube. These pipes are attached to the outside of the large central tube, run down the length of the tube or riser section, and have their own connections that are associated with riser section connections. Typically, these pipes would include a choke line, kill line, booster line, hydraulic line and potentially other types of lines or cables. The choke, kill, booster and hydraulic lines can have inner diameters from about 3" (hydraulic lines may be as small as about 2.5") to about 6.5" or more and wall thicknesses from about ½" to about 1" or more.

Situations arise where it may be necessary to disconnect the riser from the offshore drilling rig, vessel or platform. In some of these situations, e.g., drive-off of a floating rig, there may be little or no time, to properly disconnect the riser. In others situations, such as weather related situations, there may be insufficient time to pull the riser string once sufficient weather information is obtained; thus forcing a decision to potentially unnecessarily pull the riser. Thus, and particularly for deep, very deep and ultra deep water drilling there has existed a need to be able to quickly and with minimal damage disconnect a riser from an offshore drilling rig.

In offshore drilling activities critical and often times emergency situations arise. These situations can occur quickly, unexpectedly and require prompt attention and remedial actions. Although these offshore emergency situations may have similar downhole causes to onshore drilling emergency situations, the offshore activities are much more difficult and complicated to manage and control. For example, it is generally more difficult to evacuate rig personnel to a location, away from the drilling rig, in an offshore environment. Environmentally, it is also substantially more difficult to mitigate and manage the inadvertent release of hydrocarbons, such as in an oil spill, or blowout, for an offshore situation than one that occurs onshore. The drilling rig, in an offshore environment, can be many tens of thousands of feet away from the wellhead. Moreover, the offshore drilling rig is fixed to the borehole by the riser and any tubulars that may be in the borehole. Such tubulars may also interfere with, inhibit, or otherwise prevent, well control equipment from functioning properly. These tubulars and the riser can act as a conduit bringing dangerous hydrocarbons and other materials into the very center of the rig and exposing the rig and its personnel to extreme dangers.

Thus, there has long been a need for systems that can quickly and reliably address, assist in the management of, and mitigate critical and emergency offshore drilling situations. This need has grown ever more important as offshore drilling activities have moved into deeper and deeper waters. In general, it is believed that the art has attempted to address this need by relying upon heavier and larger pieces of equipment; in essence by what could be described as using brute force in an attempt to meet this need. Such brute force methods, however, have failed to meet this long-standing and important need High Power Laser Beam Conveyance Prior to the recent breakthroughs of inventor Dr. Mark Zediker and those working with him at Foro Energy, Inc., Littleton Colo., it was believed that the transmission of high power laser energy over great distances without substantial loss of power was unobtainable. Their breakthroughs in the transmission of high power laser energy, and in particular energy levels greater than about 5 kW, are set forth, in part, in the novel and innovative teachings contained in US patent application publications 2010/0044106 and 2010/0215326 and in Rinzler et. al, pending U.S. patent application Ser. No. 12/840,978 titled "Optical Fiber Configurations for Transmission of Laser Energy Over Great Distances" (filed Jul. 21, 2010). The disclosures of these three U.S. patent applications, to the extent that they refer or relate to the transmission of high power laser energy, and lasers, fibers and cable structures for accomplishing such transmissions, are incorporated herein by reference. It is to be noted that this incorporation by reference herein does not provide any right to practice or use the inventions of these applications or any patents that may issue therefrom and does not grant, or give rise to, any licenses thereunder.

SUMMARY

In offshore drilling operations it has long been desirable to have the ability to quickly and in a controlled manner cut or weaken tubulars that extend from an offshore drilling rig to, and into, a borehole to assist in the control and management of emergency situations that arise during deep sea drilling activities. The present invention, among other things, solves this need by providing the articles of manufacture, devices and processes taught herein.

Thus, there is provided herein a laser riser and blowout preventer system for use with an offshore drilling rig to control and manage potential emergency and emergency situations, the laser riser blowout preventer system having: a high power laser; a high power beam switch that is optically associated with the high power laser; a riser; a blowout preventer; a first laser cutter and a second laser cutter, in optical association with the high power beam switch; wherein the first laser cutter is positioned adjacent the riser, whereby the first laser cutter is capable of directing a first high power laser beam toward a component of the riser; wherein the second laser cutter is positioned in the blowout preventer, whereby the second laser cutter is capable of directing a second high power laser beam toward a tubular within the blowout preventer; and, a control network in data and control communication with the laser, the beam switch and the blowout preventer, wherein the control network provides for firing of the laser and actuation of the blowout preventer.

Additionally, there is provided a system wherein the control network has a programmable logic controller; wherein the control network has a user interface; wherein the control network includes a memory device, having a series of instructions for executing a predetermined sequence of firing the first laser cutter, the second laser cutter and actuation of the blowout preventer; wherein the control network includes a plurality of controllers; wherein the high power laser has at least about 10 kW of power; wherein the high power laser has at least about 20 kW of power; or wherein the high power laser has at least about 40 kW of power.

Moreover, there is provided a system having a plurality of high power lasers; wherein only one of the plurality of high power lasers is on line at any give time; or having a third laser cutter, wherein one of the second or third laser cutters is associated with an upper portion of the blowout preventer and the other one of the second or third laser cutters is associated with a lower portion of the blowout preventer.

Additionally, there is provided a laser riser and blowout preventer system for use with an offshore drilling rig to control and manage potential emergency and emergency situations, the laser riser blowout preventer system having: a first high power laser and a second high power laser; a riser; a blowout preventer; a first laser cutter and a second laser cutter, the first laser cutter being in optical association with the first high power laser and the second optical cutter being in optical association with the second high power laser; and, wherein the first laser cutter is associated with the riser and, wherein the second laser cutter is associated with the blowout preventer.

Further still, there is provided a laser riser and blowout preventer system for use with an offshore drilling rig to control and manage potential emergency and emergency situations, the laser riser blowout preventer system having: a high power laser; a high power beam switch in optical and control association with the high power laser; a riser having a first laser cutter, whereby the first laser cutter is capable of directing a first high power laser beam toward a component of the riser; a blowout preventer including a second laser cutter, whereby the second laser cutter is capable of directing a second high power laser beam toward a tubular within the blowout preventer; and, the first and a second laser cutter in optical association with the high power laser.

Still further, there is provided an offshore drilling rig having a laser riser and blowout preventer system to control and manage potential emergency and emergency situations, the laser riser and blowout preventer system having: a high power laser in optical association with a high power beam switch; a riser including a plurality of riser sections, wherein the plurality of riser sections are configured for being lowered from and operably connected to the offshore drilling rig to a depth at or near a seafloor; a blowout preventer configured for being operably connected to the riser and lowered by the riser from the offshore drilling rig to the seafloor; and, one of the plurality of riser sections including a first laser cutter for emitting a first laser beam defining a first beam path, wherein the first beam path is directed toward a riser section; the blowout preventer including a second laser cutter for emitting a second laser beam defining a second beam path, wherein the second beam path is directed toward a cavity defined by the blowout preventer; and, a control system; wherein, when the riser and blowout preventer are deployed and operably associating the offshore drilling rig and a borehole in the seafloor, the control system is configured to control the firing of the first and second laser cutters. Still further this system can be configured to control the actuation of the blowout preventer.

Moreover, there is provided a method of performing drilling, workover, intervention, completion or service on a subsea well by using a laser riser and blowout preventer system in conjunction with an offshore drilling rig to control and manage potential emergency and emergency situations, the method including: lowering a blowout preventer, from an offshore drilling rig, vessel or platform to a seafloor using a riser including a plurality of riser sections; wherein the blowout preventer includes: a blowout preventer cavity defined by the blowout preventer; and a first laser cutter for emitting a first laser beam that defines a first beam path, wherein the first beam path is directed toward the blowout preventer cavity; wherein the riser includes: a riser cavity defined by the riser; and a second laser cutter for emitting a second laser beam that defines a second beam path, wherein the second beam path is directed toward a component of the riser; operably connecting a high power laser into a control system; securing the blowout preventer to a borehole, whereby the borehole cavity and the riser cavity are in fluid and mechanical communication; and, performing operations on the borehole by lowering structures from the offshore drilling rig down through the riser cavity, the blowout preventer cavity and into the borehole; and, wherein, the control system is configured to fire the high power laser. Further, the structures may be selected from the group consisting of: tubulars, wireline, coiled tubing and slickline.

DESCRIPTION OF THE PREFERRED EMBODIMENTS

Figure 1:
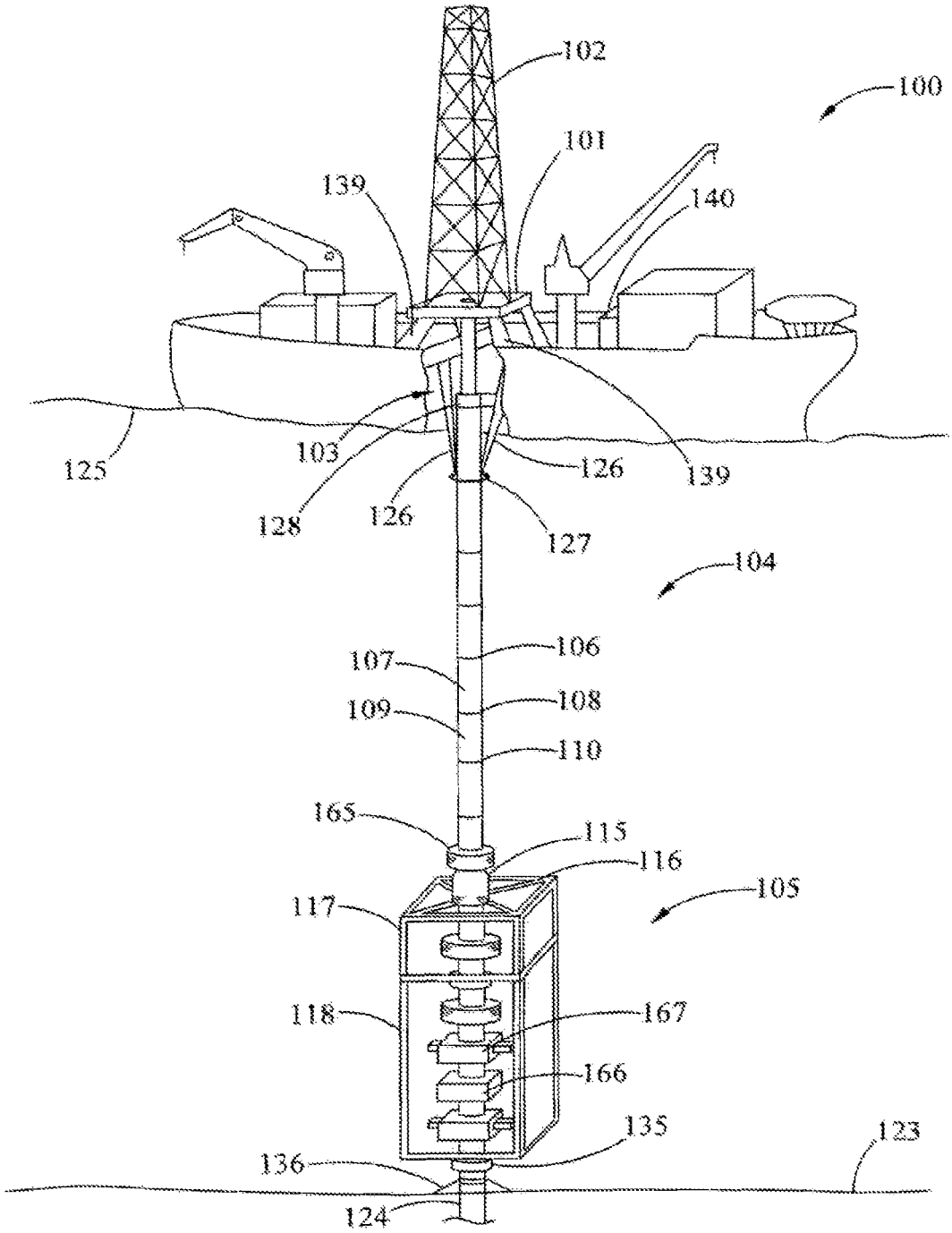
FIGS. 1 and 1A are perspective views of an embodiment of a system of the present invention.

In general, the present inventions relate to multiple laser beam delivery systems that can deliver controlled, precise and predetermined laser energy to address crisis and emergency situations during offshore drilling activities. Thus, by way of example, an embodiment of an offshore drilling rig having a laser beam delivery system is schematically shown in FIG. 1. In this embodiment there is provided a dynamically positioned (DP) drill ship 100 having a drill floor 101, a derrick 102 above the drill floor, and moon pool 103 (as seen by the cutaway in the figure showing the interior of the drill ship 100) below the drill floor 101 and other drilling and drilling support equipment and devices utilized for operation, which are known to the offshore drilling arts, but are not shown in the figure. The drill ship includes a riser 104 and a BOP stack 105. Although a drill ship is shown in this embodiment, any other type of offshore drilling rig, vessel or platform, including FPSOs, or GGSOs, may be utilized.

The riser 104 is deployed and connects drill ship 100 with a borehole 124 that extends below the seafloor 123. The upper portion, i.e., the portion of the riser when deployed that is closest to the surface 125 of the water, of riser 104, is connected to the drillship 100 by tensioners 126 that are attached to tension ring 127. The upper section of riser 104 may have a diverter 128 and other components (not shown in this figure) that are commonly utilized and employed with risers and are well known to those of skill in the art of offshore drilling.

The riser 104 extends from the moon pool 103 of drill ship 100 and is connected to BOP stack 105. The riser 104 is made up of riser sections, e.g., 107, 109, that are connected together, by riser couplings, e.g., 106, 108, 110 and lowered through the moon pool 103 of the drill ship 100. Thus, the riser 104 may also be referred to as a riser string. The lower portion, i.e., the portion of the riser that when deployed is closest to the seafloor, of the riser 104 is connected to the BOP stack 105 by way of the riser-BOP connecter 115. The riser-BOP connecter 115 is associated with flex joint 116, which may also be referred to as a flex connection or ball joint. The flex joint 116 is intended to accommodate movements of the drill ship 100 from positions that are not directly above the laser assisted BOP stack 105; and thus accommodate the riser 104 coming into the BOP stack 105 at an angle.

The BOP stack 105 may be characterized as having two component assemblies: an upper component assembly 117, which may be referred to as the lower marine riser package (LMRP), and a lower component assembly 118, which may be referred to as the lower BOP stack or the BOP proper. The BOP stack 105 has a wellhead connecter 135 that attached to wellhead 136, which is attached to borehole 124. The LMRP 117 of the BOP stack 105 may have a frame that houses for example an annular preventer. The lower component assembly 118 the BOP 105 may have a frame that houses an annular preventer, a laser shear ram assembly, a shear laser module ("SLM") and a ram preventer.

During deployment the BOP stack 105 is attached to the riser 104, lowered to the seafloor 123 and secured to a wellhead 136. The wellhead 136 is position and fixed to a casing (not shown), which has been cemented into a borehole 124. From this point forward, generally, all the drilling activity in the borehole takes place through the riser and the BOP. Such drilling activity would include, for example, lowering a string of drill pipe having a drill bit at its end from the drill ship 100 down the internal cavity of the riser 104, through the cavity of the BOP stack 105 and into the borehole 124. Thus, the drill string would run from the drill ship 100 on the surface 125 of the water to the bottom of the borehole, potentially many tens of thousands of feet below the water surface 125 and seafloor 123. The drill bit would be rotated against the bottom of the borehole, while drilling mud is pumped down the interior of the drill pipe and out the drill bit. The drilling mud would carry the cuttings, e.g., borehole material removed by the rotating bit, up the annulus between the borehole wall and the outer diameter of the drill string, continuing up through the annulus between BOP cavity wall and the outer diameter of the drill string, and continuing up through the annulus between the inner diameter of the riser cavity and the outer diameter of the drill string, until the drilling mud and cuttings are directed, generally by a bell housing (not shown), or in extreme situations a diverter 128, to the drill ship 100 for handling or processing. Thus, the drilling mud is pumped from the drill ship 100 through a drill string in the riser to the bottom of the borehole and returned to the drill ship, in part, by the riser 104 and BOP 105.

The sections of the riser are typically stored vertically on the offshore drilling rig. Once the drilling rig has reached a drilling location the riser and BOP package are deployed to the seafloor. In general, it being recognized that different, varied and more detailed procedures may be followed, as a first step in deploying the BOP, the BOP stack is prepared and positioned under the drill floor and under the rotary table. A spider and gimbal are also positioned with respect to the rotary table. The lower most section of the riser that attaches to the BOP is moved into the derrick and lowered by the hoisting apparatus in the derrick through the spider and down to the BOP below the drill floor where it is connected to the BOP. The riser and BOP are then lowered to a point where the upper coupling of the riser section is at a height above the drill floor were it can be readily connected to the next section of riser. The spider holds the riser in this position. Once the connection has been made, the two sections and the BOP are then lowered, and this process is repeated until sufficient sections of riser have been added and lowered to enable the BOP to reach and be landed on (attached to) the wellhead at the seafloor.

During this process, laser cutters can be attached to the riser either below the drill floor, if they are too large to fit through the spider, or above the drill floor if they can fit through the spider. Additionally, during the assembly of the BOP laser cutters can be attached, or placed in the stack as assembled. The laser cutters could also be contained within the stack and within a riser section and thus, not require any additional assembly time or time to affix the cuter during deployment of the riser and BOP. The high power cables preferably will be attached to and held by external brackets or assemblies on the riser. Preferably the cables are affixed to the riser in the moon pool area before the riser section is lowered into the water. In this manner the high power cables can be played out from a spool as the BOP and riser are lowered to the seafloor. High power cables with high power laser couplers on each end may be externally mounded on each riser section, in the same way that choke and kill lines are affixed to riser sections. In this manner, the final optical connection from the uppermost riser section to the laser can be made below the drill floor and after the riser and BOP have been landed on the wellhead.

The riser has an internal cavity, not shown in FIG. 1 that is in fluid and mechanical communication with an internal cavity, not shown in FIG. 1, in the BOP stack. Thus, as deployed, the riser 104 and BOP 105 provide a cavity or channel putting the drillship in fluid and mechanical communication with the borehole 124. The BOP stack frames protect the BOP, and may have lifting and handling devices, a control and connection module, and other equipment and devices utilized in subsea operation, which are known to the offshore drilling art, but are not shown in the figure. The internal cavity in the stack goes through the stack from its top (closest to the water surface 125) to its bottom (closest to the sea floor 123).

In the exemplary embodiment shown in FIG. 1 the riser is a 21" riser and the BOP is an 18¾" BOP. The term "21" riser" and 18¾" BOP can be considered as generic and cover risers wherein the large central tube has an outer diameter in the general range of 21" and BOPs where the center cavity or bore diameter is in the general range of 18¾". The use of smaller and larger diameter risers, different types and configurations of risers, BOPs having smaller and larger diameter cavities, and different types and configurations of BOPs, are contemplated; and, the teachings and inventions of this specification are not limited to, or by, the size, type or configuration of a particular riser or BOP.

In FIG. 1 the riser and BOP package is configured along the lines of a drilling riser BOP package with the BOP positioned at or near the seafloor, typically attached to a wellhead, as for example seen in some drilling activities. The present systems, laser modules, laser cutters laser assemblies and laser-riser assemblies of the present inventions have applications to other types of risers, riser-BOP packages and activities. Thus, they have applications in relation to drilling, workover, servicing, testing, intervention and completing activities. They also have applications to surface BOPs, e.g., where BOP is positioned above the surface of the water and the riser extends from the BOP to the seafloor, where a BOP is not employed, were drilling is done in the riser, where the riser is a production riser, and other configurations known to or later developed by the art.

Figure 1A:
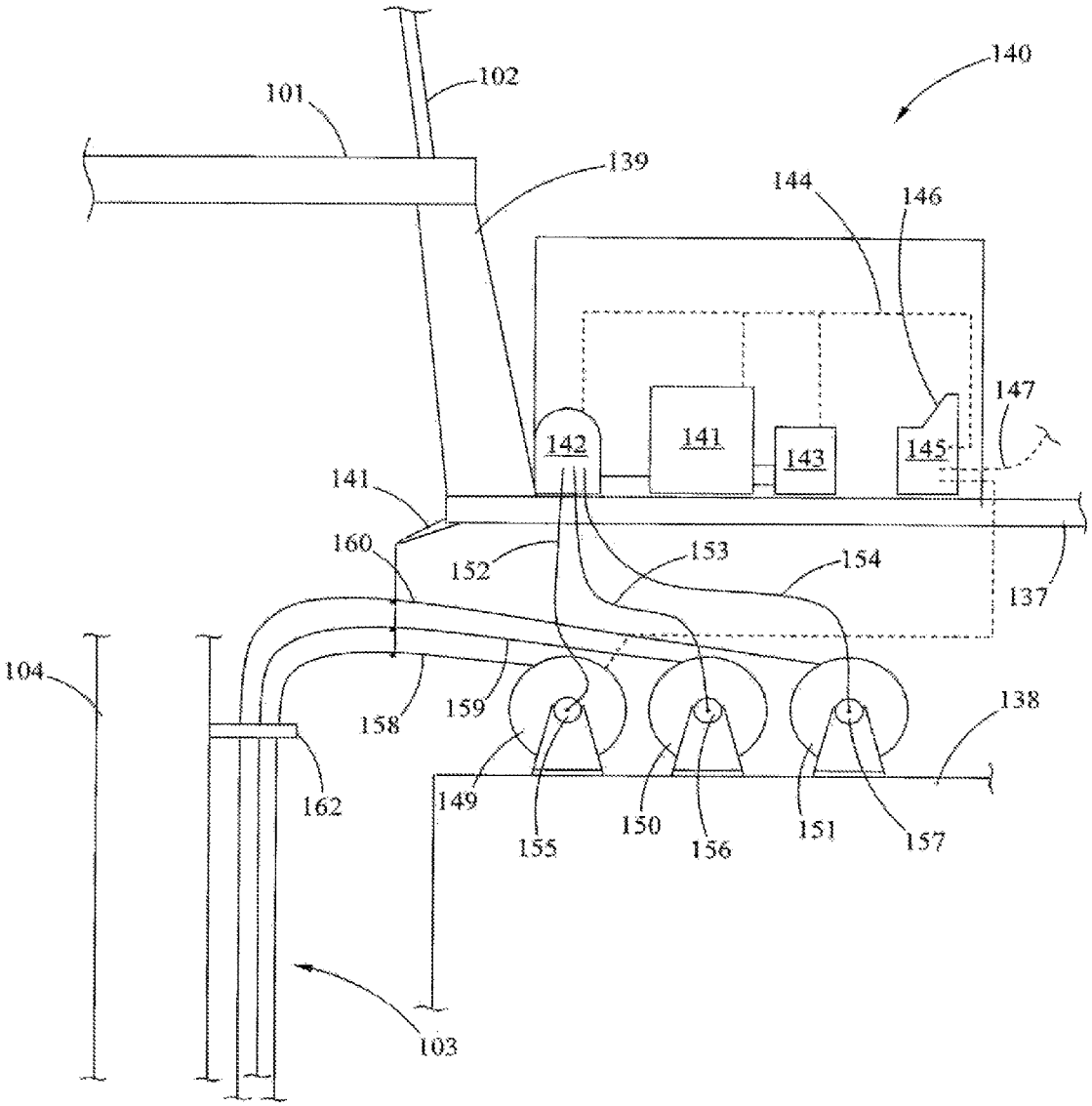

The laser beam delivery system in the embodiment shown in FIG. 1, and seen in greater detail in FIG. 1A, has a laser room 140. The laser room 140 contains a 40 kW fiber laser 141, a high power beam switch 142, a chiller 143 and a laser system controller 145, having an operator interface 146. There is also shown a deck 137 of the drill ship 100 that is below the rig floor 101, and another deck 138 of the drill ship 100 that is below deck 137. Supports 139 for the drill floor 101 and derrick 102 are also shown.

The laser system controller 145, chiller 143, laser 141 and beam switch 142 are in communication via a network, cables, fiber or other type of factory, marine or industrial data and control signal communication medium, shown as dashed lines 144. The controller 145 is in communication, as shown by dashed line 147, via a network, cables fiber or other type of factory, marine or industrial data and control signal communication medium with the BOP control system and potentially other systems in the offshore drilling rig (not shown in this figure). The controller 145 may also be in communication (as described above) with a first spool of high power laser cable 149, a second spool of high power laser cable 150 and a third spool of high power laser cable 151. High power laser optics fibers 152, 153, 154, respectively, connect the beam switch 142 to the spools 149, 150, 151. The high power fibers 152, 153, 154 enter the spools 149, 150, 151, and are placed in optical and rotational association with the high power cables 158, 159,160 on the spools 149, 150, 151, by way of optical slip rings 155, 156, 157. High power cables 158, 159, 160 may be supported by support 161 and held to the riser 104 by holder 162.

Although not shown in the figures, the cables 158, 159, 160 should have a means to accommodate the change in length of the riser between the BOP and the rig floor 101 that occurs because of the vertical movement (heave) of a floating offshore rig, such as drill ship 100. The change in length of the riser is accommodated by a riser-telescoping joint (not shown in the drawings). Thus, extra cable length could be employed or the spools may be on variable controlled drives that maintain the correct length of the cable and tension.

The high power cables 158, 159, 160 follow the riser down to three laser cutters: a first laser cutter 165 is associated with the riser 104 and provided to assist in the quick disconnection of the riser; a second laser cutter 166 is associated with the cavity of the BOP 105 and provided to assist in the quick disconnection of any tubular that is within the BOP cavity; and, a third laser cutter 167 is contained within a shear ram and provided to assist the shear ram in quickly severing any tubular in the path of the rams and sealing the BOP bore.

Although three laser cutters are shown, more or less may be employed. Further the positions of the laser cutters with respect to the riser-BOP package components many be varied, and may also vary depending upon the particular components that are employed in the riser-BOP package. An advantage of the present system is that its components can be tailored to match a particular BOP or riser-BOP package configuration. A further advantage the present inventions is that the preselected laser firing and preventer activation sequences can be tailored to match these configurations, as well as, the applications in which these configuration may be used.

The laser room, e.g., 140, may be modular, that is, the room may be a self-contained unit such as a container used for shipping that has been fitted with electrical, communication and optical fittings. In this case, it is also preferable that the container has climate control features, e.g., heaters and air conditioners, built in or otherwise incorporated into the room. The laser room could be a structure that is integral to the offshore drilling rig, or it could be a combination of modular components and integral components. Any such structure will suffice and any placement, including on a separate laser boat from the offshore drilling rig can be employed, provided that the laser equipment and operators are sufficiently protected from the offshore environmental and operating conditions, and that the laser system is readily capable of being integrated into, or with, the other systems of the offshore drilling rig.

The controller, e.g., 145, may be any type of processor, computer, programmed logic controller (PLC), or similar computer device having memory and a processor; that may be, or is, used for industrial, marine or factory automation and control. In the system, the controller preferably should be in data and control communication with the offshore drilling rig's equipment, in particular the BOP control systems. Although show as being in a separate room in the figures, the laser system controller, e.g., 145, could be integral with, or the same as, the BOP controller, or another controller or control system of the offshore drilling rig.

The laser system controller may also be in communication with, integral with, or in association with, downhole sensing and monitoring equipment, rig floor sensing and monitoring equipment and mud return sensing and monitoring equipment. In this manner the laser system is integral with, or preferably, fully integrated into the BOP control systems and other systems on the offshore drilling rig. Further, the controller may be a part of a control network that includes the BOP control system, monitors and sensors for downhole conditions, drilling systems controllers and monitors and other systems of the offshore drilling rig. Thus, in a potential emergency situation, or an actual emergency situation, the laser cutters and BOP preferably can be controlled from the BOP control panel, the laser room, the drilling console, or other locations in the offshore drilling rig. This fully integrated control system network, may further have predetermined laser firing, preventer actuation and kill, choke and boost pumping and control procedures that could be automatically activated and run upon an a predetermined command being sent to or entered into the network. Moreover, the network upon detecting a specific set of conditions may initiate a predetermined command being sent and causing a predetermined laser firing, preventer actuation, and kill and choke and sequence.

The laser systems of the present invention may utilize a single high power laser, and preferably may have two or three high power lasers, and may have several high power lasers, for example, six or more. High power solid-state lasers, specifically semiconductor lasers and fiber lasers are preferred, because of their short start up time and essentially instant-on capabilities. The high power lasers for example may be fiber lasers or semiconductor lasers having 10 kW, 20 kW, 50 kW or more power and, which emit laser beams with wavelengths preferably in about the 1550 nm (nanometer), or 1083 nm ranges. Examples of preferred lasers, and in particular solid-state lasers, such as fibers lasers, are set forth in US patent application publications 2010/0044106 and 2010/0215326 and in pending U.S. patent application Ser. No. 12/840,978. The laser, or lasers, may be located on the offshore drilling rig, above the surface of the water, and optically connected to laser modules on the riser by way of a high power long distance laser transmission cable, preferred examples of which are set forth in US patent application publications 2010/0044106 and 2010/0215326 and in pending U.S. patent application Ser. No. 12/840,978. The laser transmission cable may be contained on a spool and unwound and attached to the riser sections as they are lowered to the seafloor. The lasers may also be contained in, or associated with, the BOP frame, and having optical cables running from the BOP frame up the riser to the laser module located on the riser. To the extent that the lasers are not located on the offshore drilling rig greater care needs to be taken to enable these remote lasers to be integrated into the control system or network. By locating the laser on or near the seafloor, there is the potential to eliminate the need for a long distance of high power optical cable to transmit the laser beam from the surface of the water down to the seafloor. In view of the extreme conditions in which the laser modules are required to operate and the need for high reliability in their operation, one such configuration of a laser-riser BOP package is to have at least one high power laser located on the offshore drilling rig and connected to the laser module by a high power transmission cable and to have at least one laser in, or associated with, the BOP frame on the seafloor and connected to the laser module by a high power transmission cable.

The laser cutters used in the laser systems of the present inventions may be any suitable device for the delivery of high power laser energy. Thus, any configuration of optical elements for culminating and focusing the laser beam can be employed. A further consideration, however, is the management of the optical effects of fluids, e.g., sea water, mud or other material from a cut choke line, cut kill line or cut center tube of a riser, or hydraulic fluid from a cut hydraulic line, that may be located within the beam path between laser cutter and the object to be cut such as a tubular, a riser, coupling, center pipe, external pipe, bolt, nut or other structure to be cut.

These fluids could include, by way of example, water, seawater, salt water, brine, drilling mud, nitrogen, inert gas, diesel, mist, foam, or hydrocarbons. There can also likely be present in these drilling fluids borehole cuttings, e.g., debris, which are being removed from, or created by, the advancement of the borehole or other downhole operations. There can be present two-phase fluids and three-phase fluids, which would constitute mixtures of two or three different types of material. These riser fluids can interfere with the ability of the laser beam to cut the tubular, or other structure to be cut. Such fluids may not transmit, or may only partially transmit, the laser beam, and thus, interfere with, or reduce the power of, the laser beam when the laser beam is passed through them. If these fluids are flowing, such flow may further increase their non-transmissiveness. The non-transmissiveness and partial-transmissiveness of these fluids can result from several phenomena, including without limitation, absorption, refraction and scattering. Further, the non-transmissiveness and partial-transmissiveness can be, and likely will be, dependent upon the wavelength of the laser beam.

Depending upon the configuration of the laser cutters, the riser and the BOP package, the laser beam could be required to pass through over about 8" of riser fluids. In other configurations the laser cutters may be positioned in close, or very close, proximity to the structure to be cut and moved in a manner where this close proximity is maintained. In these configurations the distance for the laser beam to travel between the laser cutters and the structure to be cut may be maintained within about 2", less than about 2", less than about 1" and less than about ½", and maintained within the ranges of less than about 3" to less than about ½", and less than about 2" to less than about ½".

In particular, for those configurations and embodiments where the laser has a relatively long distance to travel, e.g., greater than about 1" or 2" (although this distance could be more or less depending upon laser power, wavelength and type of drilling fluid, as well as, other factors) it is advantageous to minimize the detrimental effects of such riser fluids and to substantially ensure, or ensure, that such fluids do not interfere with the transmission of the laser beam, or that sufficient laser power is used to overcome any losses that may occur from transmitting the laser beam through such fluids. To this end, mechanical, pressure and jet type systems may be utilized to reduce, minimize or substantially eliminate the effect of the drilling fluids on the laser beam.

For example, mechanical devices may be used to isolate the area where the laser cut is to be performed and the riser fluid removed from this area of isolation, by way of example, through the insertion of an inert gas, or an optically transmissive fluid, such as an oil or diesel fuel. The use of a fluid in this configuration has the added advantage that it is essentially incompressible. Moreover, a mechanical snorkel like device, or tube, which is filled with an optically transmissive fluid (gas or liquid) may be extended between or otherwise placed in the area between the laser cutter and the structure to be cut. In this manner the laser beam is transmitted through the snorkel or tube to the structure.

A jet of high-pressure gas may be used with the laser cutter and laser beam. The high-pressure gas jet may be used to clear a path, or partial path for the laser beam. The gas may be inert, or it may be air, oxygen, or other type of gas that accelerates the laser cutting. The relatively small amount of oxygen needed, and the rapid rate at which it would be consumed by the burning of the tubular through the laser-metal-oxygen interaction, should not present a fire hazard or risk to the drilling rig, surface equipment, personnel, or subsea components.

The use of oxygen, air, or the use of very high power laser beams, e.g., greater than about 1 kW, could create and maintain a plasma bubble or a gas bubble in the cutting area, which could partially or completely displace the drilling fluid in the path of the laser beam.

A high-pressure laser liquid jet, having a single liquid stream, may be used with the laser cutter and laser beam. The liquid used for the jet should be transmissive, or at least substantially transmissive, to the laser beam. In this type of jet laser beam combination the laser beam may be coaxial with the jet. This configuration, however, has the disadvantage and problem that the fluid jet does not act as a wave-guide. A further disadvantage and problem with this single jet configuration is that the jet must provide both the force to keep the drilling fluid away from the laser beam and be the medium for transmitting the beam.

A compound fluid laser jet may be used as a laser cutter. The compound fluid jet has an inner core jet that is surrounded by annular outer jets. The laser beam is directed by optics into the core jet and transmitted by the core jet, which functions as a waveguide. A single annular jet can surround the core, or a plurality of nested annular jets can be employed. As such, the compound fluid jet has a core jet. This core jet is surrounded by a first annular jet. This first annular jet can also be surrounded by a second annular jet; and the second annular jet can be surrounded by a third annular jet, which can be surrounded by additional annular jets. The outer annular jets function to protect the inner core jet from the drill fluid present in the annulus between the laser cutter and the structure to be cut. The core jet and the first annular jet should be made from fluids that have different indices of refraction. In the situation where the compound jet has only a core and an annular jet surrounding the core the index of refraction of the fluid making up the core should be greater than the index of refraction of the fluid making up the annular jet. In this way, the difference in indices of refraction enable the core of the compound fluid jet to function as a waveguide, keeping the laser beam contained within the core jet and transmitting the laser beam in the core jet. Further, in this configuration the laser beam does not appreciably, if at all, leave the core jet and enter the annular jet.

The pressure and the speed of the various jets that make up the compound fluid jet can vary depending upon the applications and use environment. Thus, by way of example the pressure can range from about 3000 psi, to about 4000 psi to about 30,000 psi, to preferably about 70,000 psi, to greater pressures. The core jet and the annular jet(s) may be the same pressure, or different pressures, the core jet may be higher pressure or the annular jets may be higher pressure. Preferably the core jet is higher pressure than the annular jet. By way of example, in a multi-jet configuration the core jet could be 70,000 psi, the second annular jet (which is positioned adjacent the core and the third annular jet) could be 60,000 psi and the third (outer, which is positioned adjacent the second annular jet and is in contact with the work environment medium) annular jet could be 50,000 psi. The speed of the jets can be the same or different. Thus, the speed of the core can be greater than the speed of the annular jet, the speed of the annular jet can be greater than the speed of the core jet and the speeds of multiple annular jets can be different or the same. The speeds of the core jet and the annular jet can be selected, such that the core jet does contact the drilling fluid, or such contact is minimized. The speeds of the jet can range from relatively slow to very fast and preferably range from about 1 ms (meters/second) to about 50 m/s, to about 200 m/s, to about 300 m/s and greater. The order in which the jets are first formed can be the core jet first, followed by the annular rings, the annular ring jet first followed by the core, or the core jet and the annular ring being formed simultaneously. To minimize, or eliminate, the interaction of the core with the drilling fluid, the annular jet is created first followed by the core jet.

In selecting the fluids for forming the jets and in determining the amount of the difference in the indices of refraction for the fluids the wavelength of the laser beam and the power of the laser beam are factors that should be considered. Thus, for example for a high power laser beam having a wavelength in the 1080 nm (nanometer) range the core jet can be made from an oil having an index of refraction of about 1.53 and the annular jet can be made from a mixture of oil and water having an index of refraction from about 1.33 to about 1.525. Thus, the core jet for this configuration would have an NA (numerical aperture) from about 0.95 to about 0.12, respectively. Further details, descriptions, and examples of such compound fluid laser jets are contained in Zediker et. al, Provisional U.S. Patent Application Ser. No. 61/378,910, titled Waveguide Laser Jet and Methods of Use, filed Aug. 31, 2010, the entire disclosure of which is incorporated herein by reference. It is to be noted that said incorporation by reference herein does not provide any right to practice or use the inventions of said application or any patents that may issue therefrom and does not grant, or give rise to, any licenses thereunder.

In addition to the use of high power laser beams to cut the tubulars, other forms of directed energy or means to provide the same, may be utilized in the BOP stack. Such directed energy means would include plasma cutters, arc cutters, high power water jets, and particle water jets. Each of these means, however, has disadvantages when compared to high power laser energy. In particular, high power laser energy has greater control, reliability and is substantially potentially less damaging to the BOP system components than are these other means. Nevertheless, the use of these others less desirable means is contemplated herein by the present inventions as a directed energy means to cut tubulars within a BOP cavity.

The angle at which the laser beam contacts the structure to be cut may be determined by the optics within the laser cutter or it may be determined by the angle or positioning of the laser cutter itself. Various angles that are advantageous to or based upon the configuration of the riser, external pipe, coupling or combinations thereof may be utilized.

The number of laser cutters utilized in a configuration of the present inventions can be a single cutter, two cutters, three cutters, and up to and including 12 or more cutters. As discussed above, the number of cutters depends upon several factors and the optimal number of cutters for any particular configuration and end use may be determined based upon the end use requirements and the disclosures and teachings provided in this specification. The cutters may further be positioned such that their respective laser beam paths are parallel, or at least non-intersecting within the center axis of the riser Examples of laser power, fluence and cutting rates, based upon published data, are set forth in Table I.

TABLE I

| type | thickness (mm) | laser power (watts) | spot size (microns) | Laser fluence ($MW/cc^2$) | gas | cutting rate (m/min) |
|---|---|---|---|---|---|---|
| mild steel | 15 | 5,000 | 300 | 7.1 | $O_2$ | 1.8 |
| stainless steel | 15 | 5,000 | 300 | 7.1 | $N_2$ | 1.6 |

The laser cutters have a discharge end from which the laser beam is propagated. The laser cutters also have a beam path. The beam path is defined by the path that the laser beam is intended to take, and extends from the discharge end of the laser cutter to the material or area to be cut.

Figures 22, 22A, 22B:
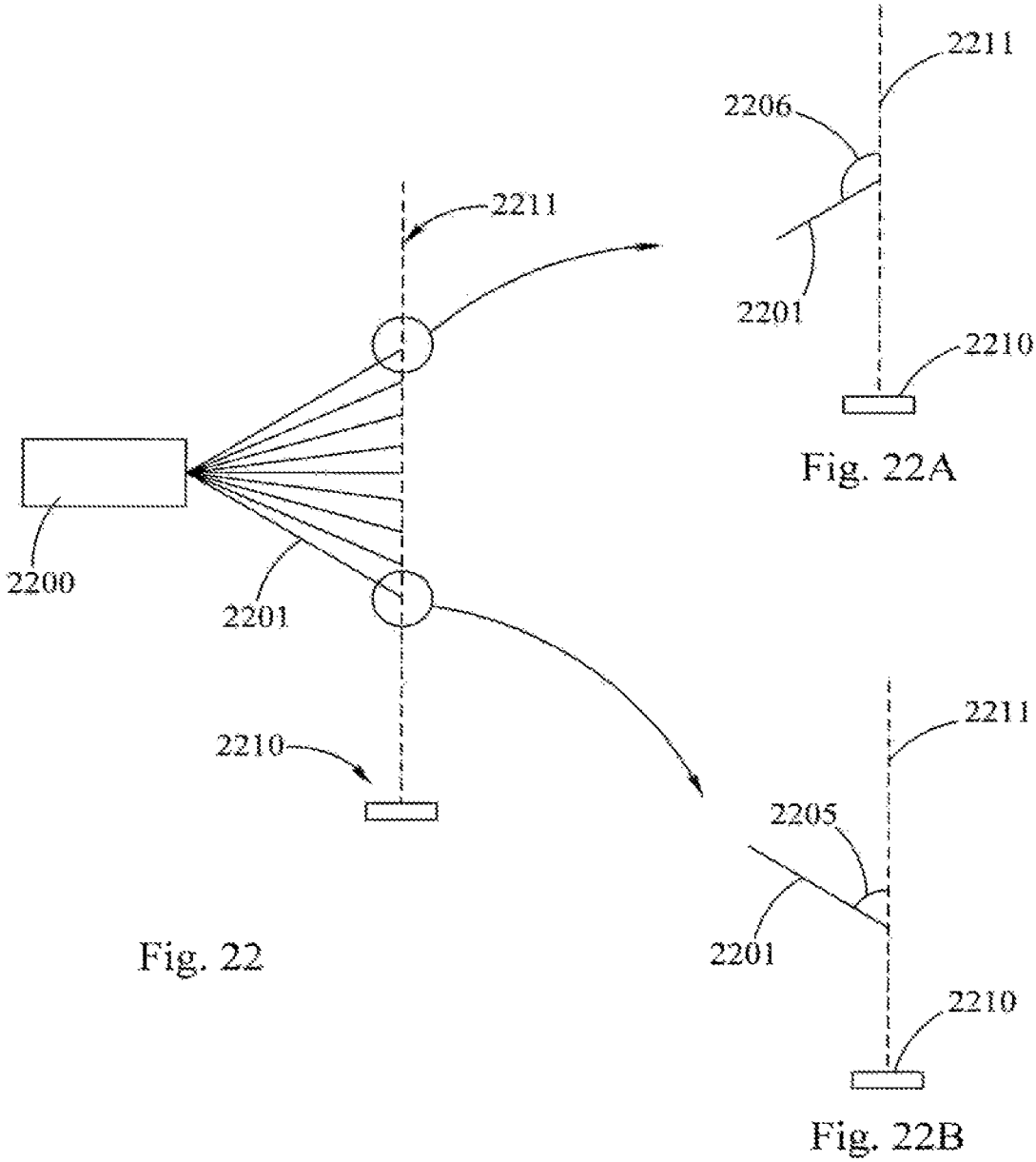
FIGS. 22, 22A & 22B are schematic illustrations of laser beam paths of the present invention.

The angle at which the laser beam contacts a tubular may be determined by the optics within the laser cutter or it may be determined by the angle or positioning of the laser cutter itself. In FIG. 22 there is shown a schematic representation of a laser cutter 2200 with a beam path 2201 leaving the cutter at various angles. When fired or shot from the laser cutter, a laser beam would travel along a beam path. The beam path is further shown in relation to the BOP cavity or a riser cavity vertical axis (dashed line) 2211. As seen in the enlarged views of FIGS. 22A and 22B, the angle that the beam path 2201 forms with vertical axis 2211, and thus the angle that a laser beam traveling along this beam path forms with vertical axis 2211, can be an acute angle 2205 or an obtuse angle 2206 relative to the portion of the axis 2211 furthest away from the wellhead connection side 2210. A normal or 90° angle may also be utilized. The BOP wellhead connection side 2210 is shown in the Figures as a reference point for the angle determinations used herein.

The angle between the beam path (and a laser beam traveling along that beam path) and the vertical axis of either the BOP or riser, corresponds generally to the angle at which the beam path and the laser beam will strike a tubular that is present in the BOP cavity or the riser. However, using a reference point that is based upon the BOP or the riser to determine the angle is preferred, because tubulars may shift or in the case of joints, or a damaged tubular, present a surface that has varying planes that are not parallel to the BOP cavity center axis; similarly the riser will rarely be straight and may have bends or movements in it.

Because the angle formed between the laser beam and the vertical axis can vary, and be predetermined, the laser cutter's position, or more specifically the point where the laser beam leaves the cutter does not necessarily have to be normal to the area to be cut. Thus, the laser cutter position or the beam launch angle can be such that the laser beam travels from: above the area to be cut, which would result in an acute angle being formed between the laser beam and the vertical axis; the same level as the area to be cut, which would result in a 90° angle being formed between the laser beam and the vertical axis; or, below the area to be cut, which would result in an obtuse angle being formed between the laser beam and the cavity vertical axis. In this way, the relationship between the shape of the rams, the surfaces of the rams, the forces the rams exert, and the location of the area to be cut by the laser can be evaluated and refined to optimize the relationship of these factors for a particular application.

The flexible support cables for the laser cutters provide the laser energy and other materials that are needed to perform the cutting operation. Although shown as a single cable for each laser cutter, multiple cables could be used. Thus, for example, in the case of a laser cutter employing a compound fluid laser jet the flexible support cable would include a high power optical fiber, a first line for the core jet fluid and a second line for the annular jet fluid. These lines could be combined into a single cable or they may be kept separate. Additionally, for example, if a laser cutter employing an oxygen jet is utilized, the cutter would need a high power optical fiber and an oxygen line. These lines could be combined into a single cable or they may be kept separate as multiple cables. The lines and optical fibers should be covered in flexible protective coverings or outer sheaths to protect them from riser fluids, the subsea environment, and the movement of the laser cutters, while at the same time remaining flexible enough to accommodate the orbital movement of the laser cutters. As the support cables near the feed-through assembly there to for flexibility decreases and more rigid means to protect them can be employed. For example, the optical fiber may be placed in a metal tube. The conduit that leaves the feet through assembly adds additional protection to the support cables, during assembly of the laser module and the riser, handling of the riser or module, deployment of the riser, and from the subsea environmental conditions.

It is preferable that the feed-through assemblies, the conduits, the support cables, the laser cutters and other subsea components associated with the operation of the laser cutters, should be constructed to meet the pressure requirements for the intended use. The laser cutter related components, if they do not meet the pressure requirements for a particular use, or if redundant protection is desired, may be contained in or enclosed by a structure that does meet the requirements. For deep and ultra-deep water uses the laser cutter related components should preferably be capable of operating under pressures of 2,000 psi, 4,500 psi, 5,000 psi or greater. The materials, fittings, assemblies, useful to meet these pressure requirements are known to those of ordinary skill in the offshore drilling arts, related sub-sea Remote Operated Vehicle ("ROV") art, and in the high power laser art.

The laser cutters that are used in the laser systems of the present invention may be incorporated into laser shear rams, shear laser modules and laser riser modules. These devices and other configurations utilizing laser directed energy cutters such as laser cutters in association with a riser and BOP components are provided in U.S. patent applications No. 13/034,175, now issued as U.S. Pat. No. 8,783,361, 13/034,183, now issued as U.S. Pat. No. 8,684,088, and 13/034,017, now Issued as U.S. Pat. No. 8,783,360, filed contemporaneously with the present application. The entire disclosures of these three co-filed patent applications are incorporated herein by reference.

Figure 2:
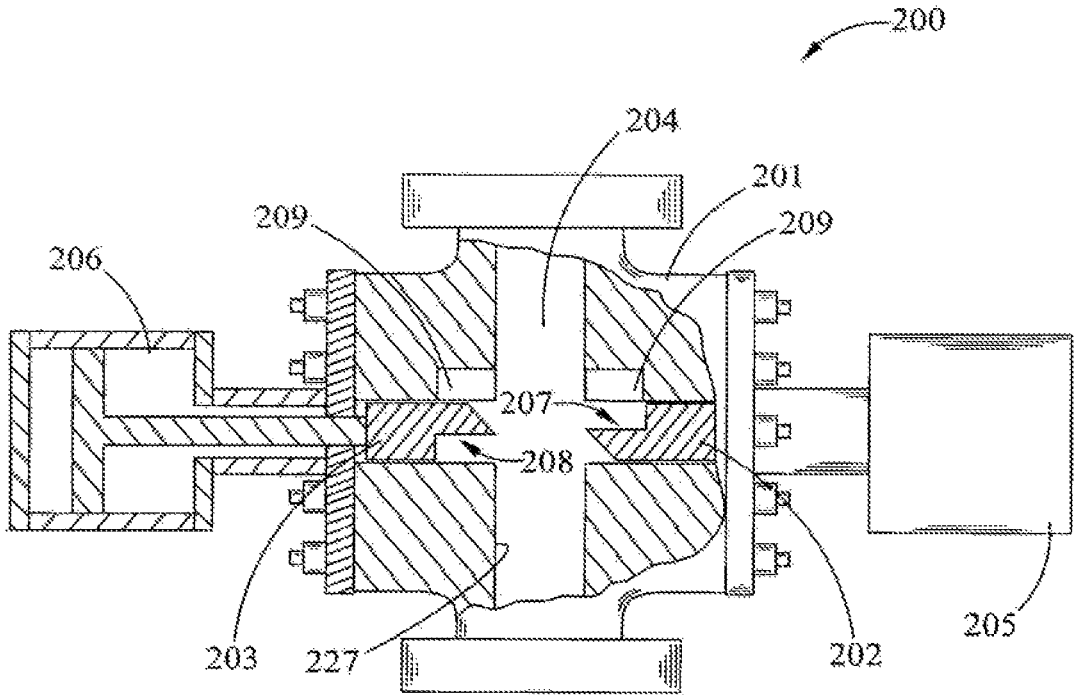
FIG. 2 is a partial cut away cross-sectional view of an embodiment of a laser shear ram assembly of the present invention to be used with the system of FIGS. 1 and 1A.

Turning to FIG. 2 there is shown an example of an embodiment of a laser shear ram assembly that could be used in a BOP stack. The laser shear ram assembly 200 has a body 201. The body 201 has a lower shear ram 202, (closer to the wellhead) and an upper shear ram 203 that upon activation are forced into inner cavity 204 by lower piston assembly 205 and upper piston assembly 206. Upon activation the mating surfaces 207, 208 of the shear rams 202, 203 engage each other and seal off the inner cavity 204, and thus, the well. The inner cavity 204 has an inner cavity wall 227. There is also provided a laser delivery assembly 209. The laser delivery assembly 209 is located in the body 201 of the laser shear ram assembly 200. The laser delivery assembly 209 may be, for example, an annular assembly that surrounds, or partially surround, the inner cavity 204. This assembly 209 is located above shear rams 202, 203, i.e., the side further away from the wellhead. The laser delivery assembly 209 is optically associated with at least one high power laser source.

During drilling and other activities tubulars, not shown in FIG. 2, are typically positioned within the inner cavity 204. An annulus is formed between the outer diameter of the tubular and the inner cavity wall 227. These tubulars have an outer diameter that can range in size from about 18" down to a few inches, and in particular, typically range from about 16⅖ (16.04)" inches to about 5", or smaller. When tubulars are present in the cavity 204, upon activation of the laser shear ram assembly 200, the laser delivery assembly 209 delivers high power laser energy to the tubular located in the cavity 204. The high power laser energy cuts the tubular completely, or at a minimum structurally weakens the tubular, to permit the shear rams 202, 203 to quickly seal off the cavity 204, moving any remaining tubular sections out of the way of the shear rams if the tubular was completely severed by the laser energy, or severing the tubular if only weakened by the laser and moving the severed tubular sections out of the way of the shear rams. Thus, the laser shear ram assembly 200 assures that the shear rams surface 207, 208 engage, seal, and thus, seal-off the BOP cavity 204 and the well. Although a single laser delivery assembly is shown in the example of the embodiment of FIG. 2, multiple laser delivery assemblies, assemblies of different shapes, and assemblies in different positions, may be employed. Further, configurations where the laser delivery assembly is located below the shear rams, i.e., the side closer to the wellhead, as well as, configurations where laser delivery assemblies are located above, below, within, or combinations thereof, the shear rams, or other sections or modules of the BOP stack may also be employed.

The ability of the laser energy to cut, remove or substantially weaken the tubular in the inner cavity enables the potential use of a single shear ram, where two shear rams may otherwise be required or needed; thus, reducing the number of moving parts, reducing the weight of the BOP, reducing the height of the BOP and reducing the deck footprint for the BOP, as well as other benefits, in the overall assembly.

Further, the ability to make precise and predetermined laser energy delivery patterns to tubulars and the ability to make precise and predetermined cuts in and through tubulars, provides the ability to have the shear ram cutting and mating surfaces configured in a way to match, complement, or otherwise work more efficiently with the laser energy delivery pattern. Thus, shear ram configurations matched or tailored to the laser energy delivery pattern are contemplated by the present inventions. Further, the ability to make precise and predetermined cuts in and through tubulars, provides the ability, even in an emergency situation, to sever the tubular without crushing it and to have a predetermined shape to the severed end of the tubular to assist in later attaching a fishing tool to recover the severed tubular from the borehole. Further, the ability to sever the tubular, without crushing it, provides a greater area, i.e., a bigger opening, in the lower section of the severed tubular through which drilling mud, or other fluid, can be pumped into the well, by the kill line associated with the BOP stack.

The body of laser shear ram assembly may be a single piece that is machined to accommodate the laser delivery assembly, or it may be made from multiple pieces that are fixed together in a manner that provides sufficient strength for its intended use, and in particular to withstand pressures of 5,000 psi, 10,000 psi, 15,000 psi, 20,000 psi, and greater. The area of the body that contains the laser delivery assembly may be machined out, or otherwise fabricated to accommodate the laser delivery assembly, while maintaining the strength requirements for the body's intended use. The body of the laser shear ram assembly may also be two or more separate components or modules, e.g., one component or module for the laser delivery assembly and another for the shear rams. These modules could be attached to each other by, for example, bolted flanges, or other suitable attachment means known to those of skill in the offshore drilling art. The body, or a module making up the body, may have a passage, passages, channels, or other such structures, to convey fiber optic cables for transmission of the laser beam from the laser source into the body and to the laser delivery assembly, as well as, other cables that relate to the operation or monitoring of the laser delivery assembly and its cutting operation.

Figure 3A:
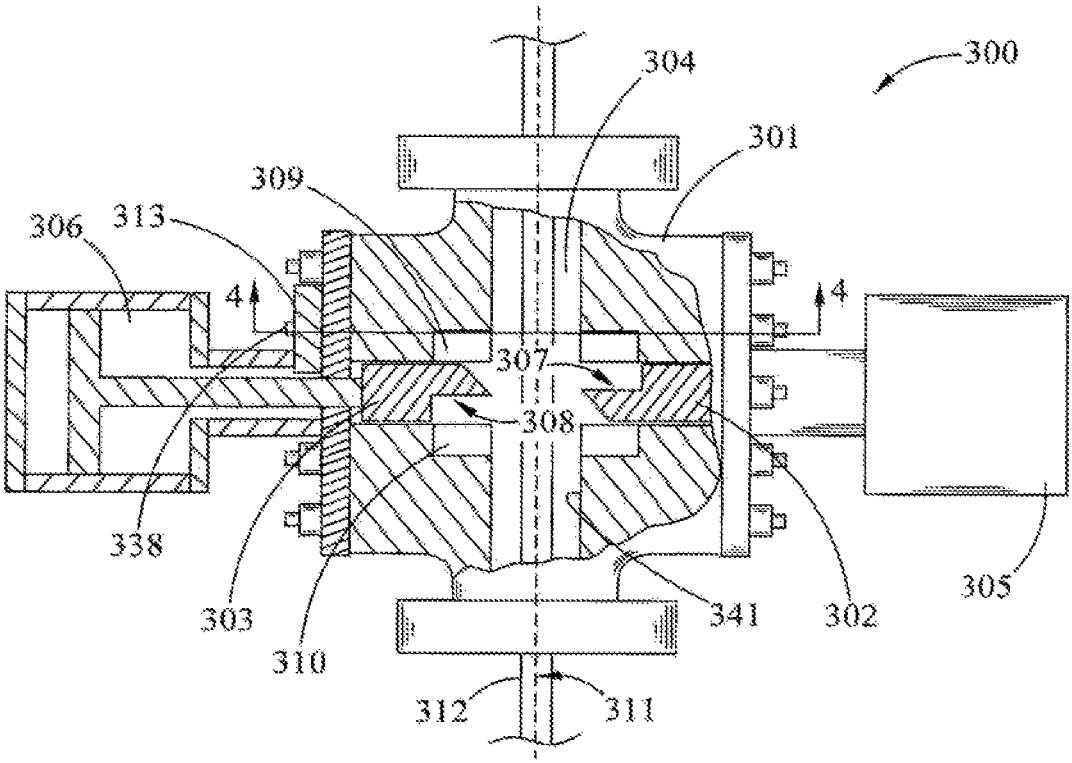
FIG. 3A is a partial cut away cross-sectional view of another embodiment of a laser shear ram assembly of the present invention to be used with the system of FIGS. 1 and 1A.

In FIG. 3A there is shown an example of an embodiment of a laser shear ram assembly that could be used in a laser assisted BOP. Thus, there is shown a laser shear ram assembly 300 having a body 301. The body has a cavity 304, which cavity has a center axis 311 (dashed line) and a wall 341. The BOP cavity also has a vertical axis and in this embodiment the vertical axis and the center axis are the same, which is generally the case for BOPs. (The naming of these axes are based upon the configuration of the BOP and are relative to the BOP structures themselves, not the position of the BOP with respect to the surface of the earth. Thus, the vertical axis of the BOP will not change if the BOP for example were laid on its side.) Typically, the center axis of cavity 311 is on the same axis as the center axis of the wellhead cavity or opening through which tubulars are inserted into the borehole.

The body 301 contains and supports lower shear ram 302 and upper shear ram 303, which rams have piston assemblies 305 and 306 associated therewith. In operation, the piston assemblies 305, 306 drive the rams 302, 303 toward the center axis 311, engaging, cutting and moving through tubular 312, and sealing the cavity 304, and thus, the well. The body 301 also has a feed-through assembly 313 for managing pressure and permitting optical fiber cables and other cables, tubes, wires and conveyance means, which may be needed for the operation of the laser cutter, to be inserted into the body 301. The body houses an upper laser delivery assembly 309 and a lower laser delivery assembly 310.

Figure 3B:
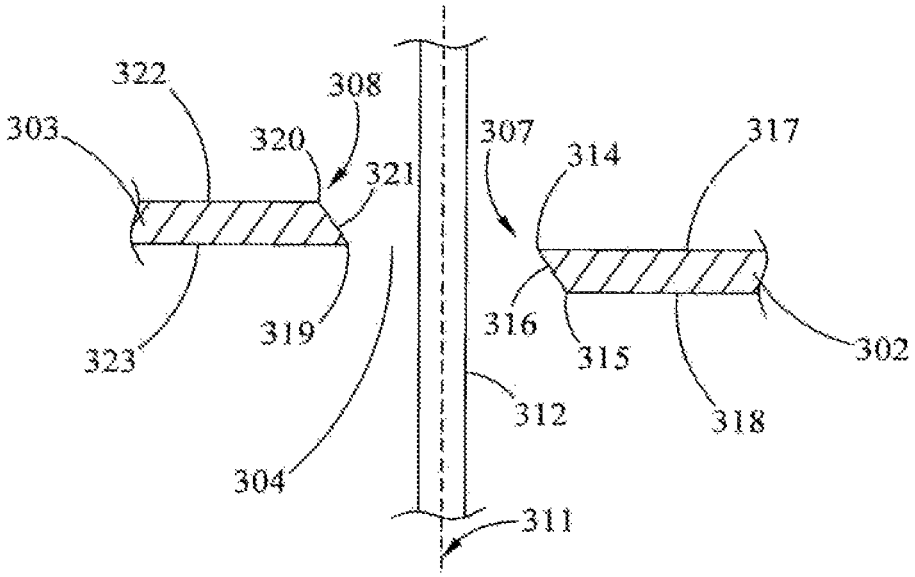
FIG. 3B is a detailed cross-sectional view of a portion of the laser shear ram assembly of FIG. 3A.

Turning to FIG. 3B there is shown a more detailed illustration of shear ram mating surfaces 308, 307 of the embodiment shown in FIG. 3A. Thus, mating surfaces 308 of upper shear ram 303 have an upper surface 322, a lower surface 323, a face 321, a leading edge 319, which edge is between the lower surface 323 and the face 321, and a trailing edge 320, which edge is between the upper surface 322 and the face 321. Mating surfaces 307 of lower shear ram 302 has an upper surface 317, a lower surface 318, a face 316, a leading edge 314, which edge is between the upper surface 317 and the face 316, and a trailing edge 315, which edge is between the face 316 and the lower surface 318.

FIGS. 4A to 4D, are cross-sectional views of the embodiment shown in FIGS. 3A and 3B taken along line 4-4 of FIG. 3A and show the sequence of operation of the laser shear ram assembly 300, in cutting the tubular 312 and sealing the cavity 304. In FIGS. 4A to 4D there is also shown further detail of the upper laser delivery assembly 309 of laser ram assembly 300. In this embodiment, lower laser assembly 310 could have similar components and configurations as upper laser delivery assembly 309. However, lower laser assembly 310 could have different configurations and more or fewer laser cutters.

The laser delivery assembly 309 has four laser cutters 326, 327, 328, and 329. Flexible support cables are associated with each of the laser cutters. Thus, flexible support cable 331 is associated with laser cutter 326, flexible support cable 332 is associated with laser cutter 327, flexible support cable 333 is associated with laser cutter 328, and flexible support cable 330 is associated with laser cutter 329. The flexible support cables are located in channel 339 and enter feed-through assembly 313. In the general area of the feed-through assembly, 313 the support cables transition from flexible to semi-flexible, and may further be included in conduit 338 for conveyance to a high power laser, or other sources of materials for the cutting operation. The flexible support cables 330, 331, 332, and 333 have extra, or additional length, which accommodates the orbiting of the laser cutters 326, 327, 328 and 329 around the axis 311, and around the tubular 312.

Figure 4A:
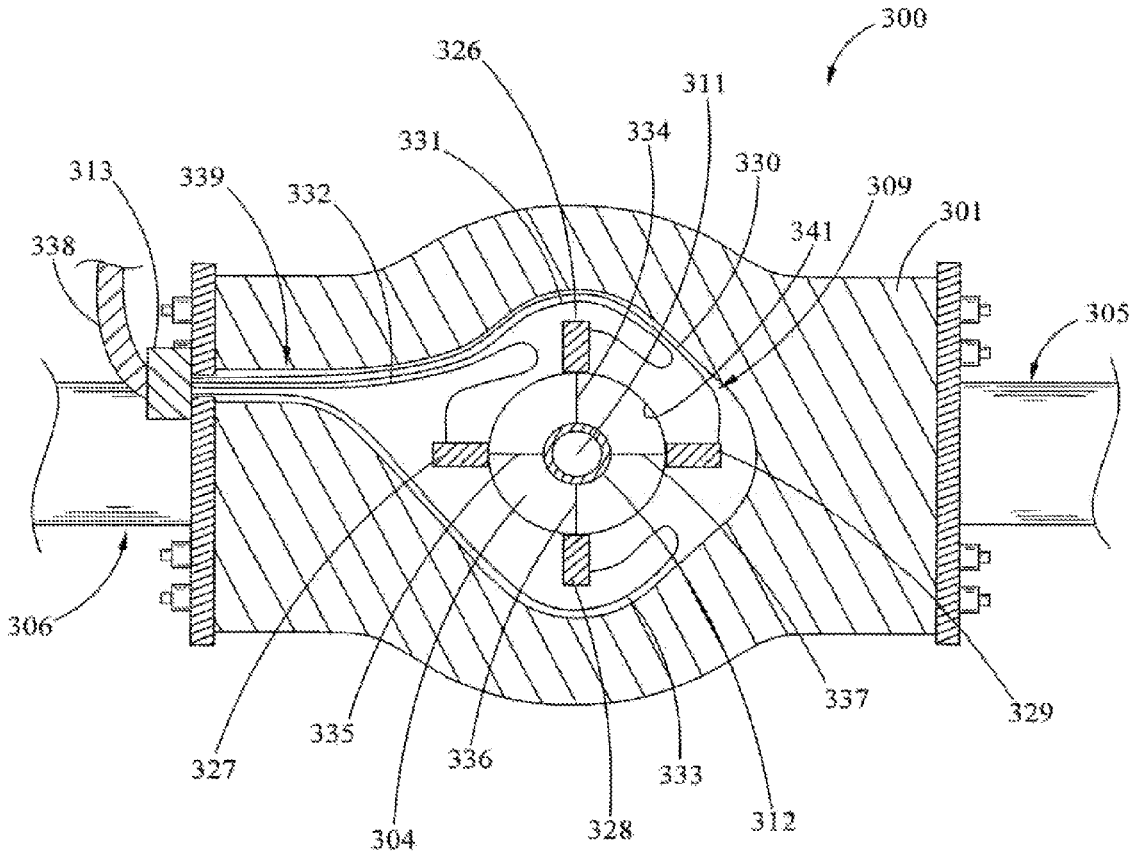
FIGS. 4A, 4B, 4C & 4D are transverse cross-sectional views of the embodiment of the laser shear ram assembly of FIG. 3A.

FIGS. 4A to 4D show the sequence of activation of the laser shear ram assembly 300 to sever a tubular 312 and seal off the cavity 304. In this example, the first view (e.g., a snap shot, since the sequence preferably is continuous rather than staggered or stepped) of the sequence is shown in FIG. 4A. As activated the four lasers cutters 326, 327, 328 and 329 shoot laser beams 334, 335, 336 and 337 respectively. The beams are directed toward the center axis 311. As such, the beams are shot from within the BOP, from outside of the cavity wall 327, and travel toward the center axis of the BOP. The laser beams strike tubular 312 and begin cutting, i.e., removing material from, the tubular 312. If the cavity 304 is viewed as the face of a clock, the laser cutters 326, 327, 328 and 329 could be viewed as being initially positioned at 12 o'clock, 9 o'clock, 6 o'clock and 3 o'clock, respectively. Upon activation, the laser cutters and their respective laser beams, begin to orbit around the center axis 311, and the tubular 312. (In this configuration the laser cutters would also rotate about their own axis as they orbit, and thus, if they moved through one complete orbit they would also have moved through one complete rotation.) In the present example the cutters and beams orbit in a counter clockwise direction, as viewed in the figures; however, a clockwise rotation may also be used. As the laser beams are shot and the orbiting occurs, the shear rams 303, 302 are driven towards each other and toward the tubular 312.

Figure 4B:
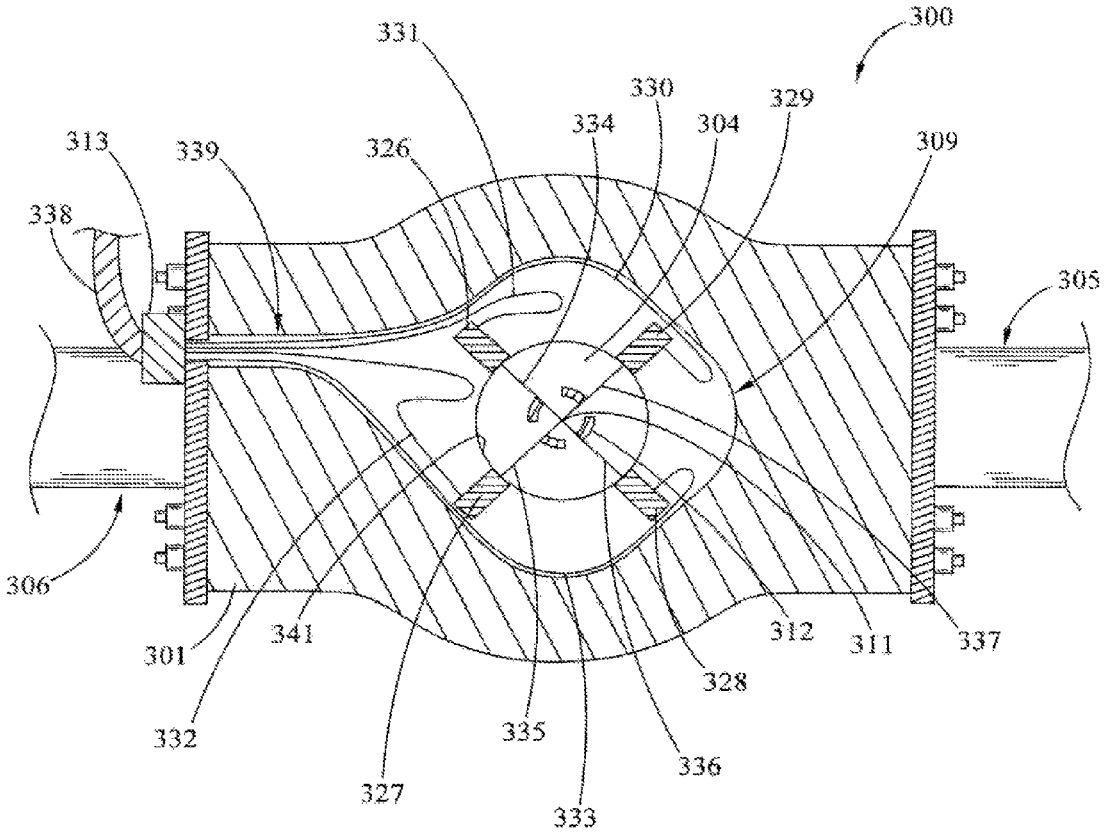
Figure 4C:
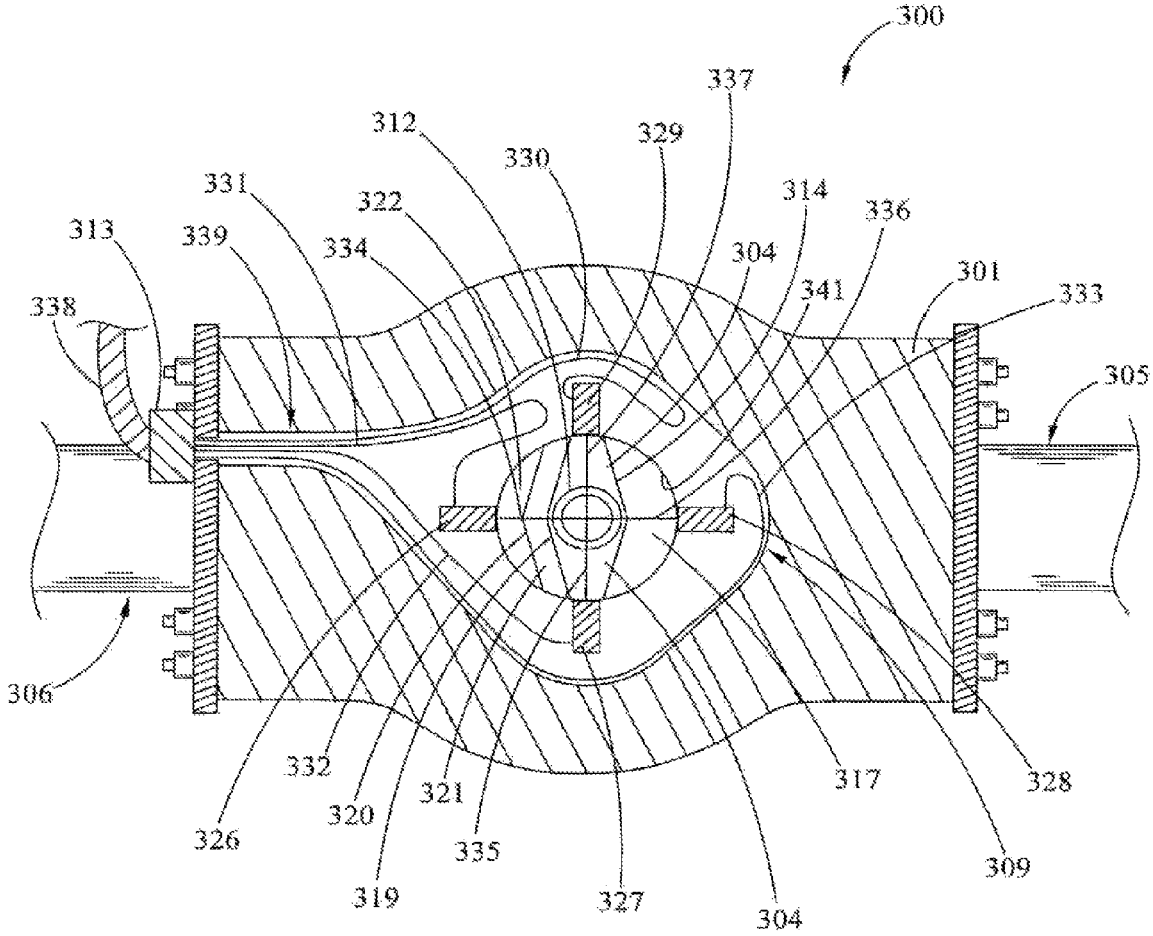

Thus, as seen in the next view of the sequence, FIG. 4B, the laser cutters, 326, 327, 328 and 329 have rotated 45 degrees, with laser beams that travel along beam paths 334,335, 336, and 337 having cut through four ⅛ sections (i.e., a total of half) of the circumference of the tubular 312. FIG. 4C then shows the cutter having moved through a quarter turn. Thus, in FIG. 4C, the lasers cutters, 326, 327, 328 and 329 have rotated a quarter turn, with the laser beams 334, 335, 336 and 337 having cut through the tubular 312. Thus, cutter 326 could be seen as having moved from the 12 o'clock position to 9 o'clock position, with the other cutters having similarly changed their respective clock face positions. There is further shown upper surface 322, trailing edge 320, face 321, and leading edge 319, of the upper ram and upper surface 317 and leading edge 314 of the lower ram as they approach and engage the tubular 312 and the area where the laser beams have cut the tubular.

Figure 4D:
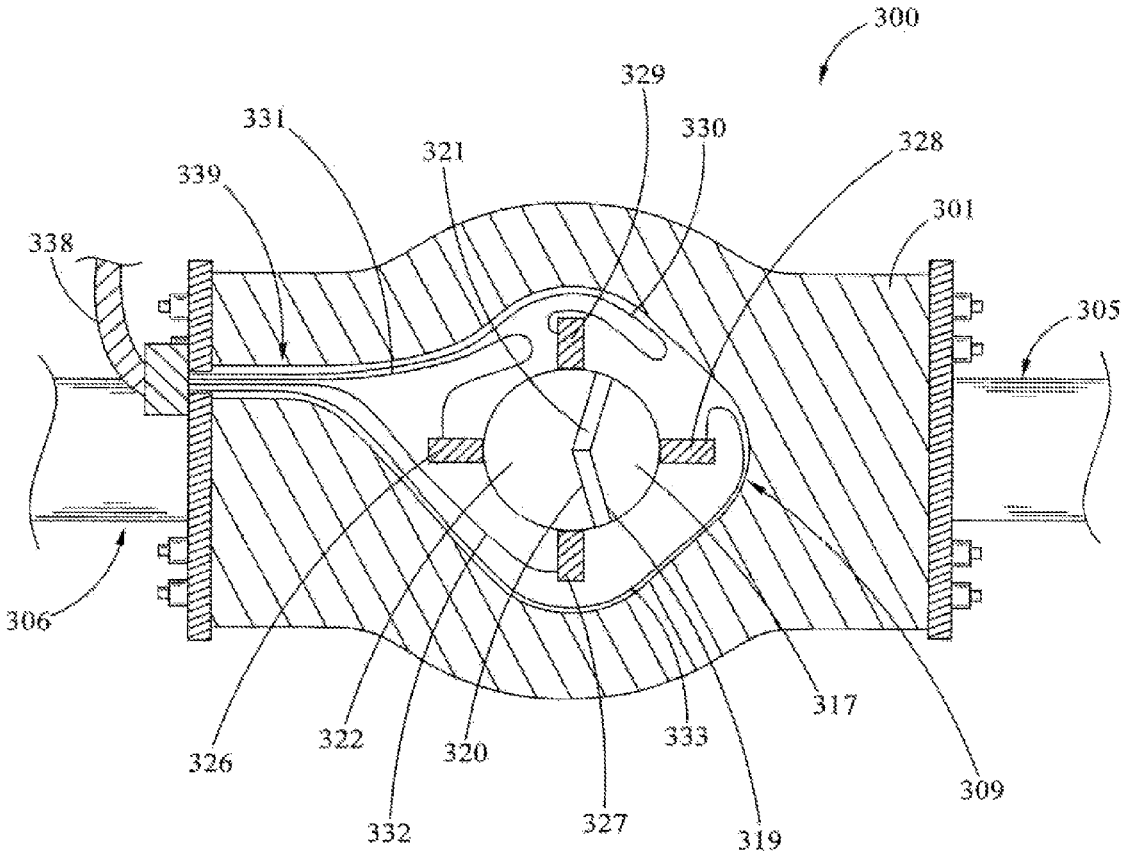

FIG. 4D then shows the last view of the sequence with the laser cutters having been deactivated and no longer shooting their laser beams and the shear rams in sealing engagement. The cavity 304 is completely filled and blocked by the shear rams 303, 302. As seen in FIG. 4C only upper surface 322, trailing edge 320, and leading edge 319 of the upper ram 303 and a portion of upper surface 317 of the lower ram 302, the other portions of upper surface 317 being in engagement with lower surface 323 of ram 302.

During the cutting operation, and in particular for circular cuts that are intended to sever the tubular, it is preferable that the tubular not move in a vertical direction. Thus, at or before the laser cutters are fired, the pipe rams, the annular preventer, or a separate holding device should be activated to prevent vertical movement of the pipe during the laser cutting operation.

The rate of the orbital movement of the laser cutters is dependent upon the number of cutters used, the power of the laser beam when it strikes the surface of the tubular to be cut, the thickness of the tubular to be cut, and the rate at which the laser cuts the tubular. The rate of the orbital motion should be slow enough to ensure that the intended cuts can be completed. The orbital movement of the laser cutters can be accomplished by mechanical, hydraulic and electro-mechanical systems known to the art.

The use of the term "completed" cut, and similar such terms, includes severing the object to be cut into two sections, e.g., a cut that is all the way through the wall and around the entire circumference of the tubular, as well as, cuts in which enough material is removed from the tubular to sufficiently weaken the object to ensure that it separates as intended. Depending upon the particular configuration of the laser cutters, the riser and the BOP and their intended use, a completed cut could be, for example: severing a tubular into two separate sections; the removal of a ring of material around the outer portion of the tubular, from about 10% to about 90% of the wall thickness; a number of perforations created in the wall, but not extending through the wall of the tubular; a number of perforations going completely through the wall of the tubular; a number of slits created in the wall, but not extending through the wall of the tubular; a number of slits going completely through the wall of the tubular; the material removed by the shot patterns or laser cutter placements disclosed in this and the incorporated by reference co-filed specifications; or, other patterns of material removal and combinations of the foregoing. It is preferred that the complete cut is made in less than one minute, and more preferable that the complete cut be made in 30 seconds or less.

The rate of the orbital motion can be fixed at the rate needed to complete a cut for the most extreme tubular or combination of tubulars, or the rate of rotation could be variable, or predetermined, to match the particular tubular, or types of tubulars, that will be present in the BOP during a particular drilling operation.

The greater the number of laser cutters in a rotating laser delivery assembly, the slower the rate of orbital motion can be to complete a cut in the same amount of time. Further, increasing the number of laser cutters decreases the time to complete a cut of a tubular, without having to increase the orbital rate. Increasing the power of the laser beams will enable quicker cutting of tubulars, and thus allow faster rates of orbiting, fewer laser cutters, shorter time to complete a cut, or combinations thereof.

Variable ram preventers could be used in conjunction with oxygen (or air) and laser cutters. Thus, a single variable ram could be used to grasp and seal against a tubular in the BOP cavity. The variable ram would form a small cavity within the rams, when engaged against the tubular, which cavity would surround the tubular. This cavity could then have its pressure reduced to at or near atmospheric, by venting the cavity. Oxygen, or air, (or other gases or transmissive liquids) could be added to the cavity before the laser cutters, which would be contained within the rams, are fired. In this manner the variable rams would have laser cutters therein, form an isolation cavity when engaged with a tubular, and provide a means to quickly cut the tubular with minimal interference from fluids. Two variable rams, one above the other may also be used, if a larger isolation cavity is desirable, or if additional space is needed for the laser cutters. Moreover, although the cavity could be vented to at or about atmospheric pressure, an increased pressure may be maintained, to for example, reduce or slow the influx of any drilling fluid from within the tubular as it is being cut.

Figure 5:
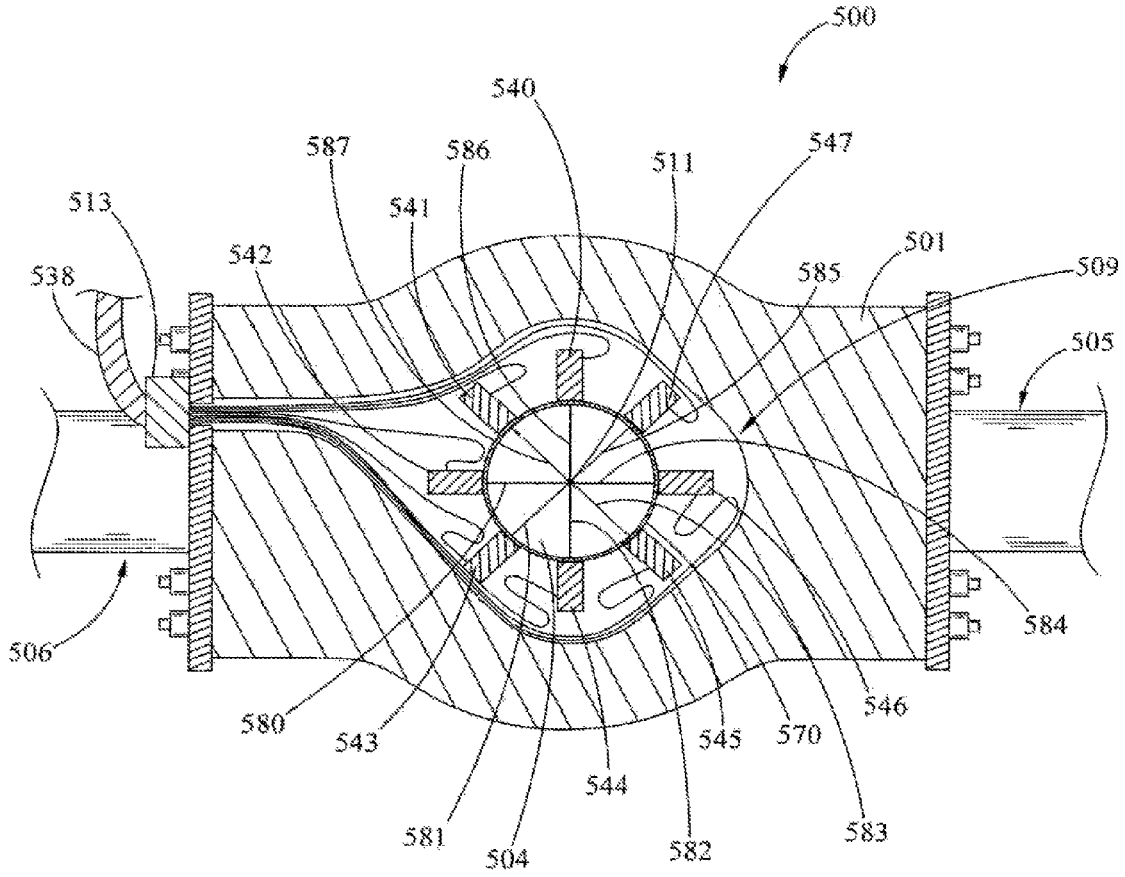
FIG. 5 is a transverse cross-sectional view of another embodiment of a laser shear ram assembly of the present invention to be used with the system of FIGS. 1 and 1A.

In FIG. 5 there is shown an example of an embodiment of a laser ram assembly that could be used in a laser assisted BOP. Thus, there is shown a laser shear ram assembly 500 having a body 501. The body has a cavity 504, which cavity has a center axis 511. The body 501 also has a feed-through assembly 513 for managing pressure and permitting optical fiber cables and other cables, tubes, wires and conveyance means, which may be needed for the operation of the laser cutter, to be inserted into the body 501. Ram piston assemblies 505, 506, which are partially shown in this Figure, are associated with the body 501. The body houses a laser delivery assembly 509. The laser delivery assembly 509 has eight laser cutters 540, 541, 542, 543, 544, 545, 546 and 547. Flexible support cables are associated with each of the laser cutters. The flexible support cables have sufficient length to accommodate the orbiting of the laser cutters around the center axis 511. In this embodiment the cutters need only go through ⅛ of a complete orbit to obtain a cut around the entire circumference of a tubular. The flexible support cables are located in a channel and enter feed-through assembly 513. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 513 the support cables transition from flexible to semi-flexible, and may further be included in conduit 538 for conveyance to a high power laser, or other sources.

There is also provided a shield 570. This shield 570 protects the laser cutters and the laser delivery assembly from drilling fluids and the movement of tubulars through the BOP cavity. Is it preferably positioned such that it does not extend into, or otherwise interfere with, the BOP cavity or the movement of tubulars through that cavity. It is preferably pressure rated at the same level as the other BOP components. Upon activation, it may be mechanically or hydraulically moved away from the laser beam's path or the laser beam may propagate through it, cutting and removing any shield material that initially obstructs the laser beam. Upon activation the lasers cutters propagate laser beams (which also may be referred to as shooting the laser or firing the laser to create a laser beam) from outside of the BOP cavity into that cavity and toward any tubular that may be in that cavity. Thus, there are laser beam paths 580, 581, 582, 583, 584, 585, 586, and 587, which paths rotate around center axis 511 during operation.

In general, operation of a laser assisted BOP stack where at least one laser beam is directed toward the center of the BOP and at least one laser cutter is configured to orbit (partially or completely) around the center of the BOP to obtain circumferential cuts, i.e., cuts around the circumference of a tubular (including slot like cuts that extend partially around the circumference, cuts that extend completely around the circumference, cuts that go partially through the tubular wall thickness, cut that go completely through the tubular wall thickness, or combinations of the foregoing) may occur as follows. Upon activation, the laser cutter fires a laser beam toward the tubular to be cut. At a time interval after the laser beam has been first fired the cutter begins to move, orbiting around the tubular, and thus the laser beam is moved around the circumference of the tubular, cutting material away from the tubular. The laser beam will stop firing at the point when the cut in the tubular is completed. At some point before, during, or after the firing of the laser beam, ram shears are activated, severing, displacing, or both any tubular material that may still be in their path, and sealing the BOP cavity and the well.

Figure 6:
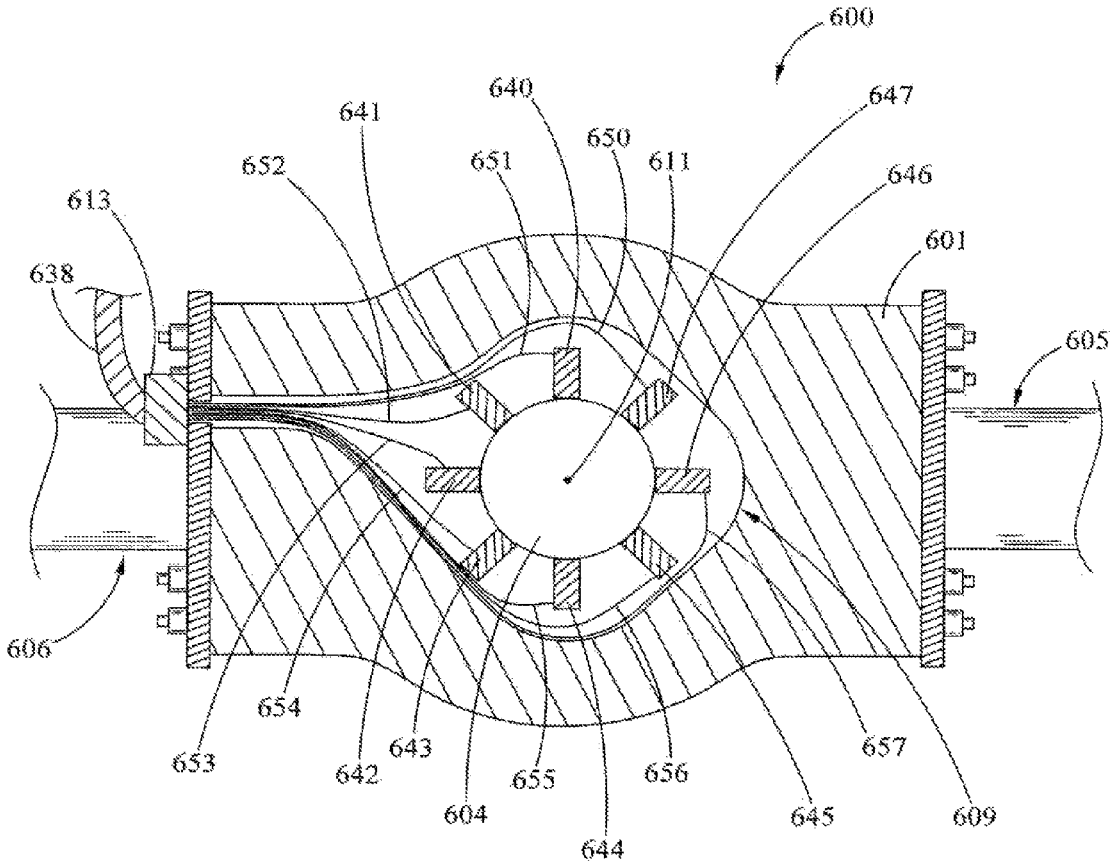
FIG. 6 is a transverse cross-sectional view of another embodiment of a laser shear ram assembly of the present invention to be used with the system of FIGS. 1 and 1A.

In FIG. 6 there is shown an example of an embodiment of a laser ram assembly, having fixed laser cutters, for use in a laser assisted BOP. Thus, there is shown a laser shear ram assembly 600 having a body 601. The body has a cavity 604, which cavity has a center axis 611. The body 601 also has a feed-through assembly 613 for managing pressure and permitting optical fiber cables and other cables, tubes, wires and conveyance means, which may be needed for the operation of the laser cutter, to be inserted into the body 601. Ram piston assemblies 605, 606, which are partially shown in this Figure, are associated with the body 601. The body houses a laser delivery assembly 609. The laser delivery assembly 609 has eight laser cutters 640, 641, 642, 643, 644, 645, 646 and 647. In this embodiment the cutters do not orbit or move. The cutters are configures such that their beam paths (not shown) are radially distributed around and through the center axis 611. Support cables 650, 651, 652, 653, 654, 655, 656 and 657 are associated with each of the laser cutters 640, 641, 642, 643, 644, 645, 646 and 647 respectively. The support cables in this embodiment do not need to accommodate the orbiting of the laser cutters around the center axis 611, because the laser cutters are fixed and do not orbit. Further, because the laser cutters are fixed the support cables 650, 651, 652, 653, 654, 655, 656 and 657 may be semi-flexible or ridged and the entire assembly 609 may be contained within an epoxy of other protective material. The support cables are located in a channel and enter feed-through assembly 613. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 613 the support cables transition from flexible to semi-flexible, and may further be included in conduit 638 for conveyance to a high power laser, or other sources. A shield, such as the shield 570 in FIG. 5, may also be used with this and other embodiments, but is not shown in this Figure.

Although eight evenly spaced laser cutters are shown in the example of a fixed laser cutter embodiment in FIG. 6, other configurations are contemplated. Fewer or more laser cutters may be used. The cutters may be positioned such that their respective laser beam paths are parallel, or at least non-intersecting within the BOP, instead of radially intersecting each other, as would be the case for the embodiment shown in FIG. 6.

Figure 7:
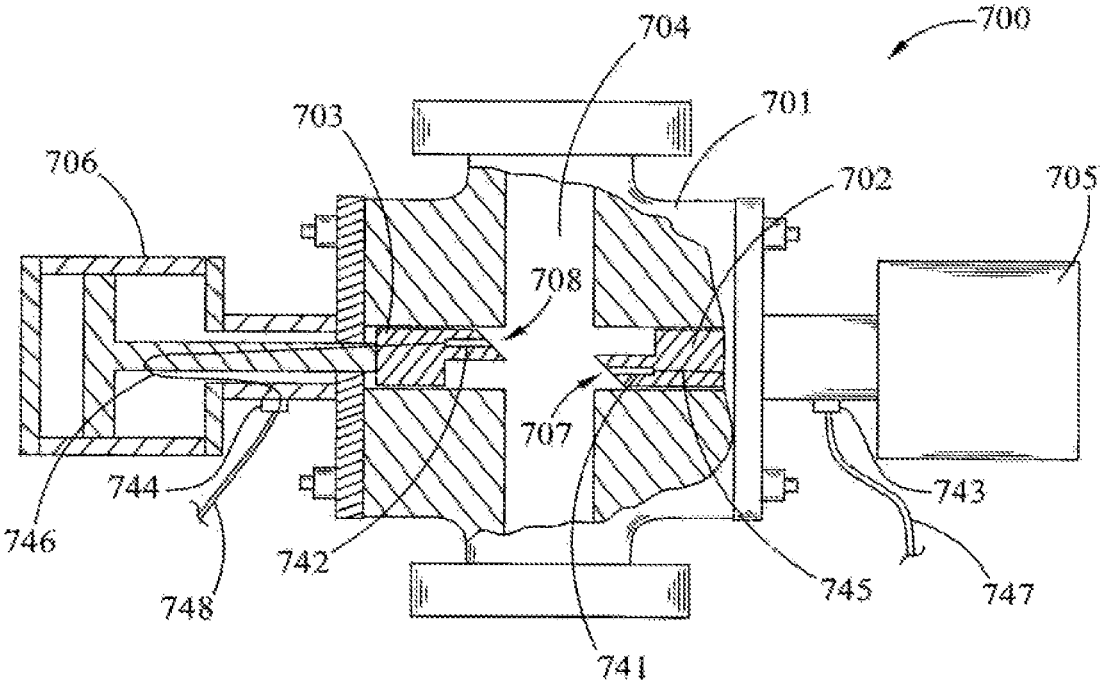
FIG. 7 is a partial cut away cross-sectional view of another embodiment of a laser shear ram assembly of the present invention to be used with the system of FIGS. 1 and 1A.

Turning to FIG. 7 there is shown an example of an embodiment of a laser shear ram assembly that could be used in a laser assisted BOP. The laser shear ram assembly 700 has a body 701. The body 701 has a lower shear ram 702, (closer to the wellhead) and an upper shear ram 703 that upon activation are forced into inner cavity 704 by lower piston assembly 705 and upper piston assembly 706. There is also provided laser delivery assemblies 741, 742. Laser delivery assemblies 741, 742 are located in rams 702, 703 respectively. The laser delivery assemblies 741, 742 have flexible support cables 745, 746 respectively, which pass through feed-through assemblies 743, 744 respectively, into conduits 747, 748 respective, which conduits are optically associated with at least one high power laser source. The feed-through assemblies as well as all places where the flexible support cable passes through should be pressure rated to meet the requirements of the BOP and specifically the pressure requirements associated with the structures through which the cable is passed. Sufficient lengths of the flexible support cables 745, 746 are provided to accommodate the movement of the shear rams 702, 703 and the piston assemblies 705,706.

During drilling and other activities tubulars, not shown in FIG. 7, are typically positioned within the inner cavity 704. When tubulars are present in the cavity 704, upon activation of the laser shear ram assembly 700, the laser delivery assemblies 741, 742 deliver high power laser energy to the tubular located in the cavity 704. The high power laser energy cuts the tubular completely, or at a minimum weakens the tubular, to permit the shear rams 702, 703 to quickly seal-off the cavity 704, moving the tubular sections out of the way of the shear rams if completely cut by the laser energy, or cutting the tubular if only weakened by the laser and moving the tubular sections out of the way of the shear rams, and thus, assuring that the shear rams surface 707, 708 engage, seal, and thus, seal-off the BOP cavity 704 and the well.

By having the laser delivery assemblies in the rams, such as laser delivery assemblies 741, 742 of the embodiment seen in FIG. 7, the distance of the laser beam path through any drilling fluids can be greatly reduced if not eliminated. Thus, the firing of the laser beam may be delayed until the rams are very close to, or touching, the tubular to be cut.

Shields for the laser cutters or laser delivery assemblies may also be used with laser ram configurations, such as the embodiment shown in FIG. 7, where the cutters or assemblies are located in the rams. Thus, such shields may be associated with the ram faces and removed upon activation or cut through by the laser beam.

Figure 8:
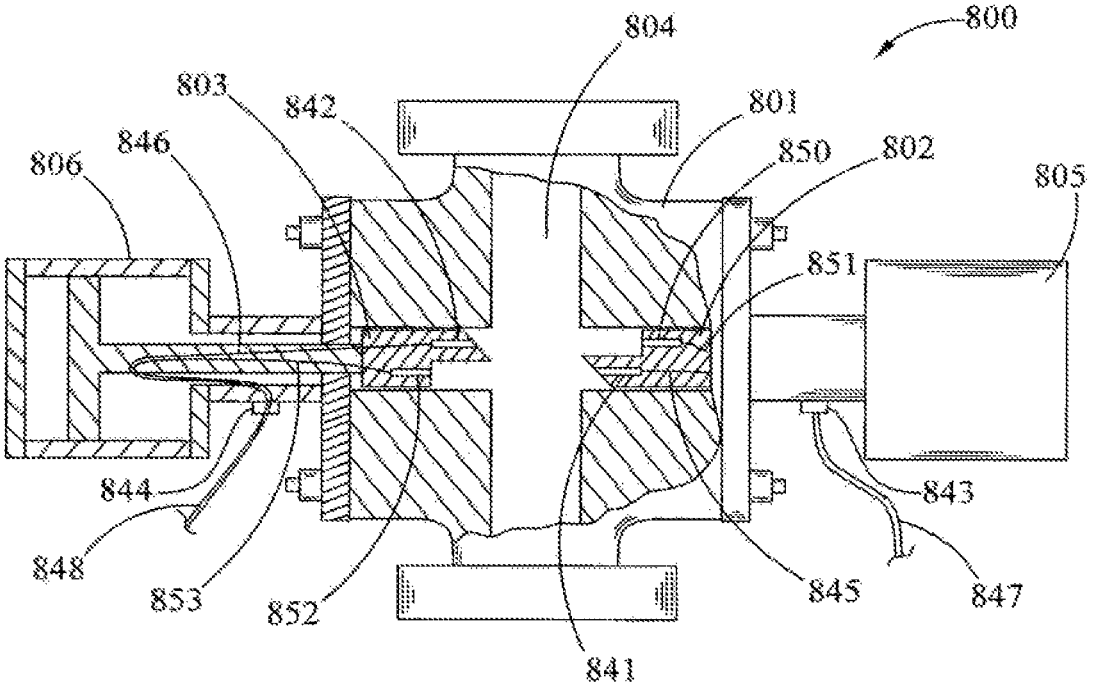
FIG. 8 is a partial cut away cross-sectional view of another embodiment of a laser shear ram assembly of the present invention to be used with the system of FIGS. 1 and 1A.

Turning to FIG. 8 there is shown an example of an embodiment of a laser shear ram assembly that could be used in a laser assisted BOP. The laser shear ram assembly 800 has a body 801. The body 801 has a lower shear ram 802, (closer to the wellhead) and an upper shear ram 803 that upon activation are forced into inner cavity 804 by lower piston assembly 805 and upper piston assembly 806. There is also provided laser delivery assemblies 841, 842, 850, 852. Laser delivery assemblies 841, 850 are located in ram 802. Laser delivery assemblies 842, 852 are located in ram 803. The laser delivery assemblies 841, 842, 850, 852 have flexible support cables 845, 846, 851, 853 respectively, which pass through feed-through assemblies 743 (cables 845, 851), 844 (cables 846, 853), into conduits 847, 848 respective, which conduits are optically associated with at least one high power laser source. The feed-through assemblies, as well as, all places where the flexible support cable passes through should be pressure rated to meet the requirements of the BOP and specifically the pressure requirements associated with the structures through which the cable is passed. Sufficient lengths of the flexible support cables 845, 746, 851, 853 are provided to accommodate the movement of the shear rams 802, 803 and the piston assemblies 805, 806.

During drilling and other activities tubulars, not shown in FIG. 8, are typically positioned within the inner cavity 804. When tubulars are present in the cavity 804, upon activation of the laser shear ram assembly 800, the laser delivery assemblies 841, 842, 850, 852 deliver high power laser energy to the tubular located in the cavity 804. The high power laser energy cuts the tubular completely, or at a minimum weakens the tubular, to permit the shear rams 802, 803 to quickly seal-off the cavity 804, moving the tubular sections out of the way of the shear rams if completely cut by the laser energy, or cutting the tubular if only weakened by the laser and moving the tubular sections out of the way of the shear rams, and thus, assuring that the shear rams engage, seal, and thus, seal-off the BOP cavity 804 and the well.

Figure 9:
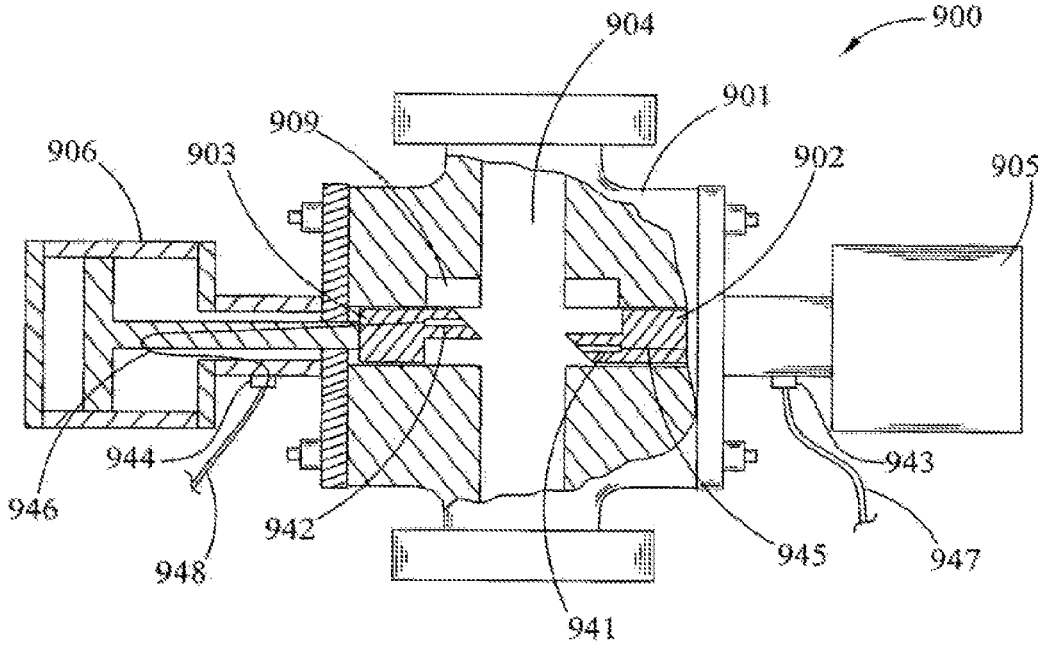
FIG. 9 is a partial cut away cross-sectional view of another embodiment of a laser shear ram assembly of the present invention to be used with the system of FIGS. 1 and 1A.

Turning to FIG. 9 there is shown an example of an embodiment of a laser shear ram assembly that could be used in a laser assisted BOP. The laser shear ram assembly 900 has a body 901. The body 901 has a lower shear ram 902, (closer to the wellhead) and an upper shear ram 903 that upon activation are forced into inner cavity 904 by lower piston assembly 905 and upper piston assembly 906. There is also provided laser delivery assemblies 941, 942, and 909. Laser delivery assemblies 941, 942 are located in rams 902, 903. Laser delivery assembly 909 is located in body 901. Laser delivery assemblies 941, 942 have flexible support cables 945, 946 respectively, which pass through feed-through assemblies 943, 944, into conduits 947, 948 respective, which conduits are optically associated with at least one high power laser source. Laser assembly 909 has flexible support cables and a feed-through assembly associated therewith, but which are not shown in the Figure. Laser assembly 909 can be of any type of laser assembly shown or taught for use in the body by in the present specification, such as for example the assemblies in embodiments shown in FIG. 4A, 5 or 6. The feed-through assemblies, as well as, all places where the flexible support cable passes through, should be pressure rated to meet the requirements of the BOP and specifically the pressure requirements associated with the structures through which the cable is passed. Sufficient lengths of the flexible support cables 945, 946 are provided to accommodate the movement of the shear rams 902, 903 and the piston assemblies 905, 906.

During drilling and other activities tubulars are typically positioned within the inner cavity 904. When tubulars are present in the cavity 904, upon activation of the laser shear ram assembly 900, the laser delivery assemblies 941, 942, 909 deliver high power laser energy to the tubular located in the cavity 904. The high power laser energy cuts the tubular completely, or at a minimum weakens the tubular, to permit the shear rams 902, 903 to quickly seal-off the cavity 904, moving the tubular sections out of the way of the shear rams if completely cut by the laser energy, or cutting the tubular if only weakened by the laser and moving the tubular sections out of the way of the shear rams, and thus, assuring that the shear rams engage, seal, and thus, seal-off the BOP cavity 904 and the well.

Figure 14:
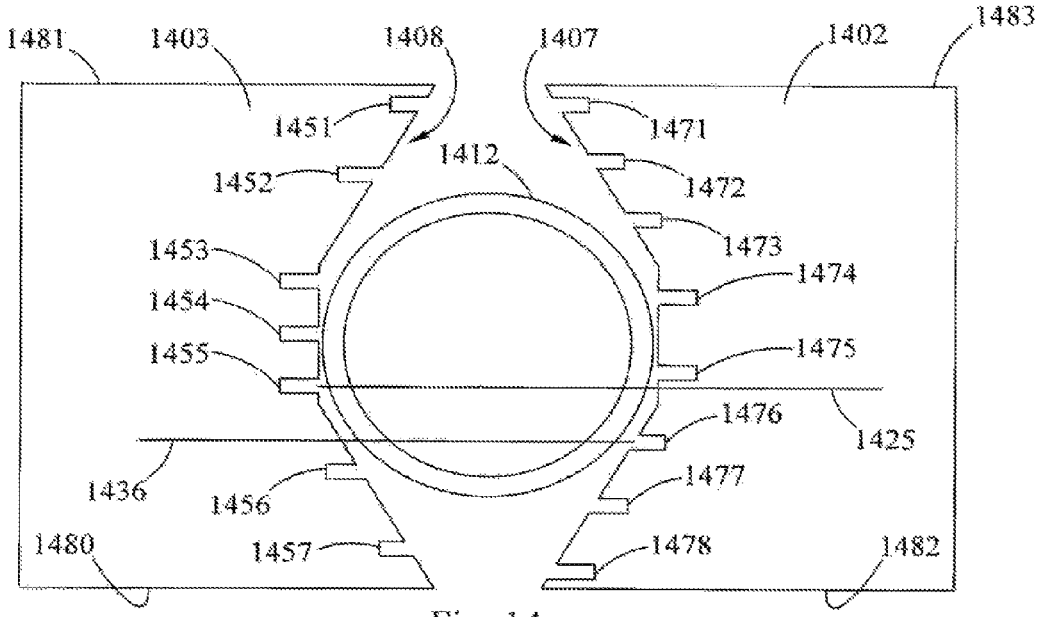
FIG. 14 is a plan schematic view of an embodiment of a pair of opposed laser shear rams having laser cutters of the present invention to be used with the system of FIGS. 1 and 1A.
Figure 15:
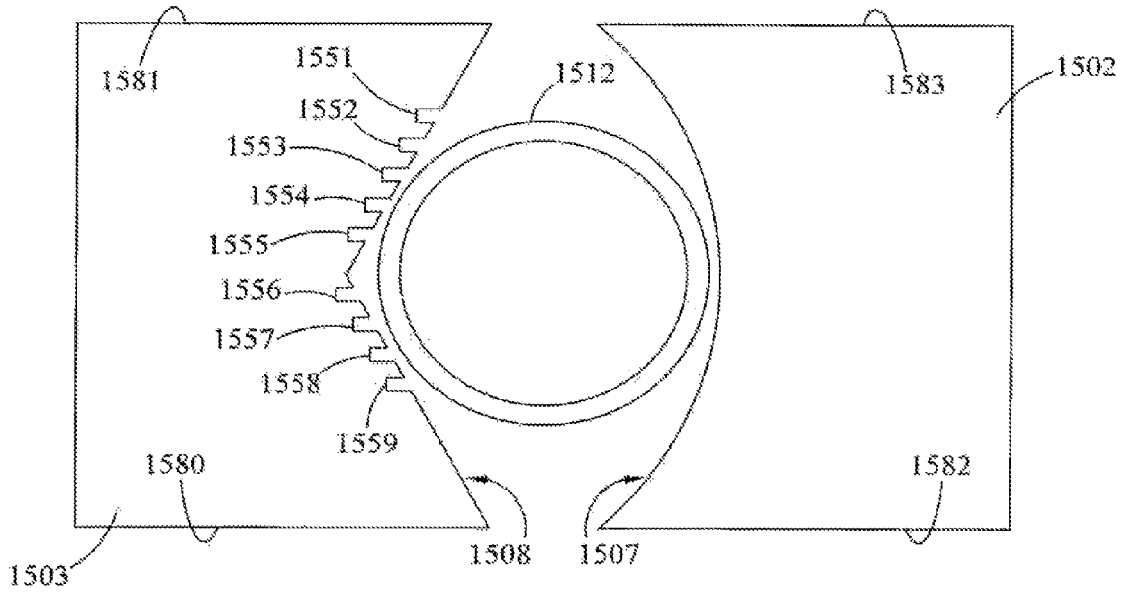
FIG. 15 is a plan schematic view of another embodiment of a pair of opposed laser shear rams having laser cutters in one of the rams of the present invention to be used with the system of FIGS. 1 and 1A.

FIGS. 10A-C, 11A-C, 12A-C, 13A-C, 14 and 15 show illustrative examples of configurations of laser cutters for laser assemblies in shear rams. Although some of these figures could be viewed as an upper ram, and in some of these figures upper and lower rams are designated, these figures and their teachings are applicable to upper and lower rams, and various locations in those rams, such as for example the locations of assemblies 850 and 841 of the embodiment shown in FIG. 8. Further, fewer or greater numbers of laser cutters may be used, the locations of the cutters may be varied, the position of the cutters may be uniformly or non-uniformly distributed across the face of the ram, and other variations of laser cutter placement may be employed. Further, these rams or the laser cutters may also have shields associated with them, to protect the cutters from borehole fluids and tubulars. FIGS. 14 and 15 also provide examples of the various shapes that the mating surfaces of a shear ram may employ. The laser shear rams of the present invention may utilize any mating surface shape now known to the art or later developed.

Figure 10B:
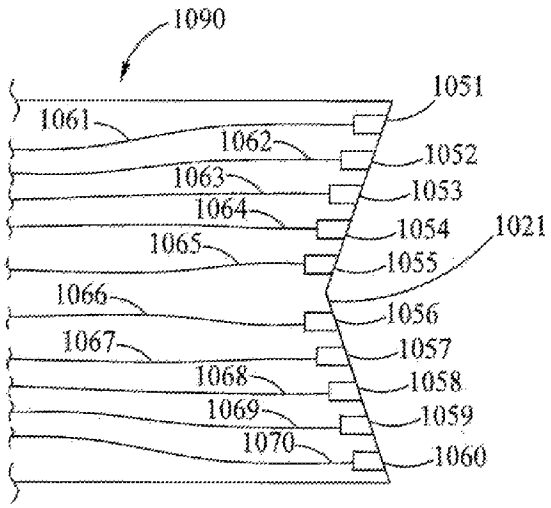
FIGS. 10A, 10B & 10C are views of a section of an embodiment of a laser shear ram having laser cutters of the present invention to be used with the system of FIGS. 1 and 1A.
Figure 10A:
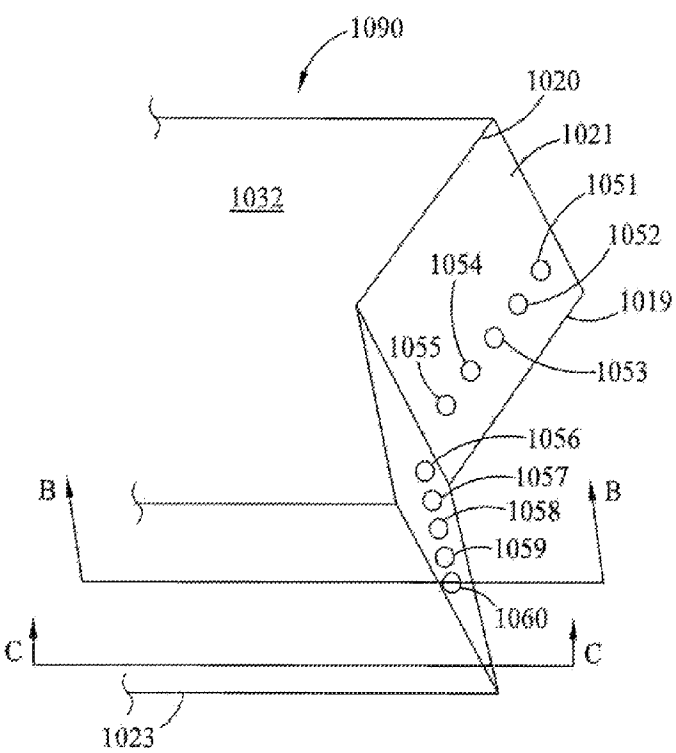
Figure 10C:
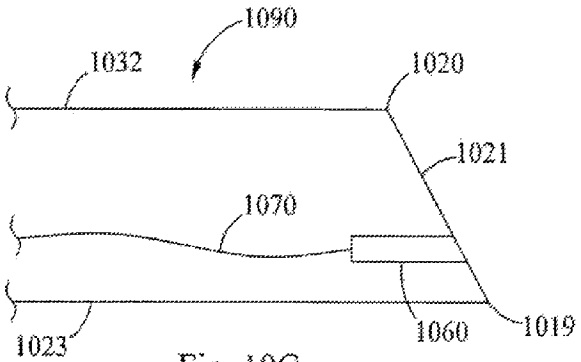

In FIGS. 10A-10C there is shown a configuration of laser cutters in a shear ram, only the leading portion, e.g., the portion intend to engage a tubular, of the ram is shown. Specifically, FIG. 10A shows a perspective view of the ram. FIG. 10B shows transverse cross-sectional view taken along line B-B of FIG. 10A and FIG. 10C shows a vertical cross-sectional view taken along line C-C of FIG. 10A. The shear ram shear 1090 has a trailing edge 1020, a trailing edge surface 1032, a leading edge 1019, a leading edge surface 1023, and a face surface 1021 positioned between and connecting the leading edge 1019 and the trailing edge 1020. The shear ram 1090 has 10 laser cutters 1051, 1052, 1053, 1054, 1055, 1056, 1057, 1058, 1059, and 1060. These laser cutters are positioned on the face surface 1021 about ⅓ to ¼ of the way along the face from the leading edge 1019, as is generally depicted in the figures. Each of the laser cutters 1051, 1052, 1053, 1054, 1055, 1056, 1057, 1058, 1059, and 1060 has a support cable 1061, 1062, 1063, 1064, 1064, 1065, 1066, 1067, 1068, 1069 and 1070 associated with it. The laser cutters are also essentially evenly spaced across the face surface 1021.

Figure 11B:
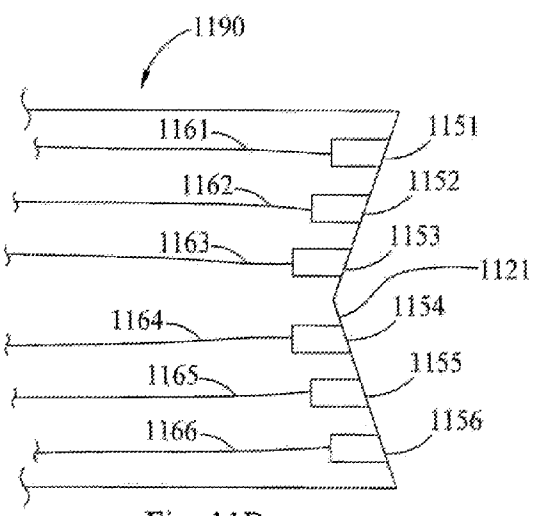
FIGS. 11A, 11B & 11C are views of a section of another embodiment of a laser shear ram having laser cutters of the present invention to be used with the system of FIGS. 1 and 1A.
Figure 11A:
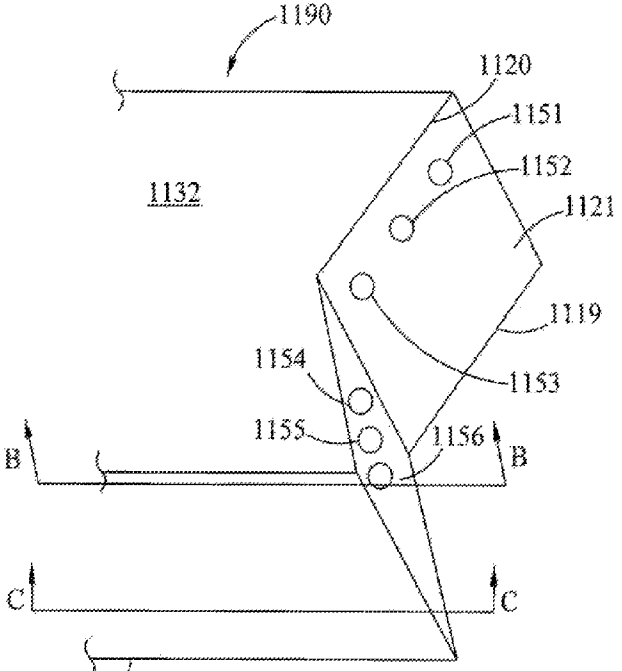
Figure 11C:
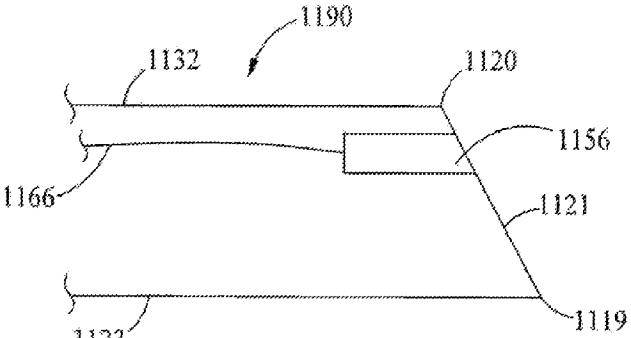

In FIGS. 11A-11C there is shown a configuration of laser cutters in a shear ram, only the leading portion, e.g., the portion intend to engage a tubular, of the ram is shown. Specifically, FIG. 11A shows a perspective view of the ram. FIG. 11B shows transverse cross-sectional view taken along line B-B of FIG. 11A and FIG. 11C shows a vertical cross-sectional view taken along line C-C of FIG. 11A. The shear ram 1190 has a trailing edge 1120, a trailing edge surface 1132, a leading edge 1119, a leading edge surface 1123, and a face surface 1121 positioned between and connecting the leading edge 1119 and the trailing edge 1120. The shear ram 1190 has six laser cutters 1151, 1152, 1153, 1154, 1155 and 1156. These laser cutters are positioned on the face surface 1121 in the half of the face closest to the trailing edge 1120, as is generally depicted in the figures. Each of the laser cutters 1151, 1152, 1153, 1154, 1155 and 1156 has a support cable 1161, 1162, 1163, 1164, 1164, 1065 and 1166, associated with it. The laser cutters are also essentially evenly spaced across the face surface 1121.

Figure 12B:
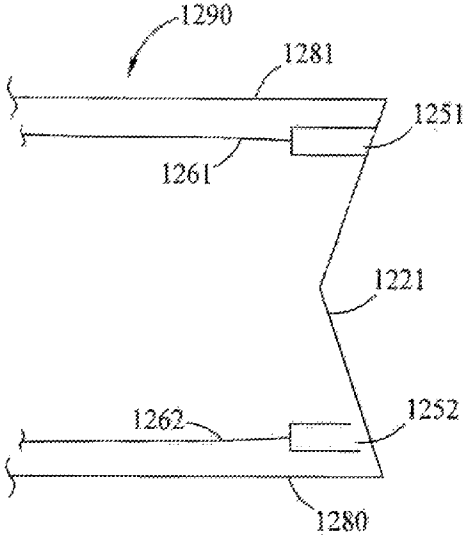
FIGS. 12A, 12B & 12C are views of a section of another embodiment of a laser shear ram having laser cutters of the present invention to be used with the system of FIGS. 1 and 1A.
Figure 12A:
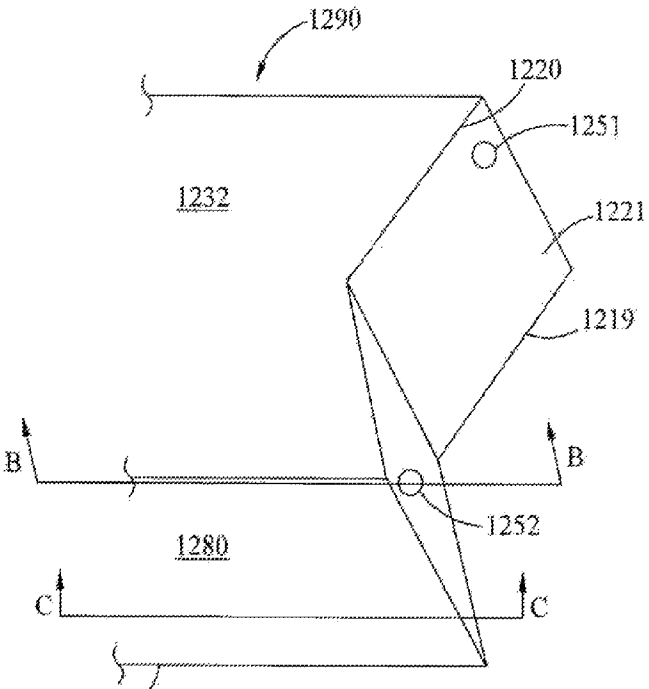
Figure 12C:
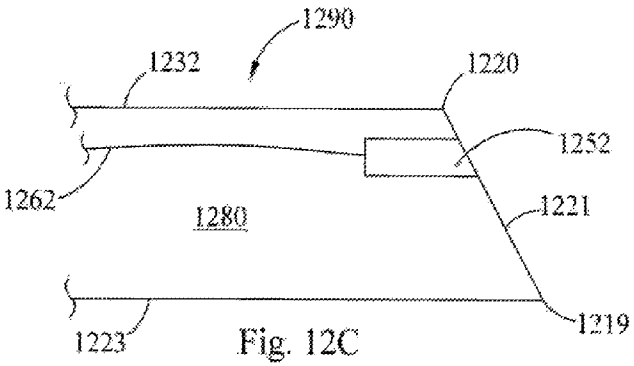

In FIGS. 12A-12C there is shown a configuration of laser cutters in a shear ram, only the leading portion, e.g., the portion intend to engage a tubular, of the ram is shown. Specifically, FIG. 12A shows a perspective view of the ram. FIG. 12B shows transverse cross-sectional view taken along line B-B of FIG. 12A and FIG. 12C shows a vertical cross-sectional view taken along line C-C of FIG. 12A. The shear ram 1290 has a trailing edge 1220, a trailing edge surface 1232, a leading edge 1219, a leading edge surface 1223, and a face surface 1221 positioned between and connecting the leading edge 1219 and the trailing edge 1220. The shear ram 1290 has two laser cutters 1251 and 1252. These laser cutters are positioned on the face surface 1221 in the half of the face closest to the trailing edge 1220, and adjacent the side surfaces 1280, 1281, as is generally depicted in the figures. Each of the laser cutters 1251 and 1252 has a support cable 1261 and 1262 associated with it. The laser cutters are also essentially unevenly spaced across the face surface 1221.

Figure 13B:
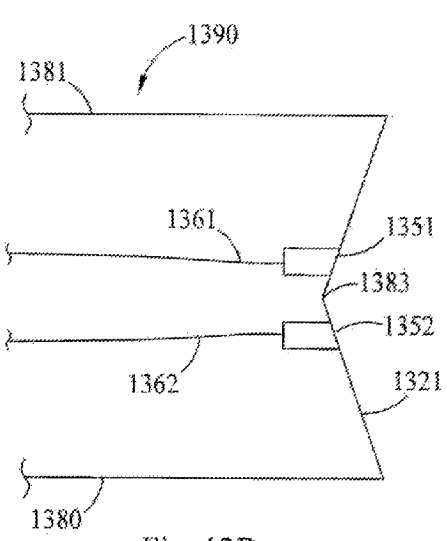
FIGS. 13A, 13B & 13C are views of a section of another embodiment of a laser shear ram having laser cutters of the present invention to be used with the system of FIGS. 1 and 1A.
Figure 13A:
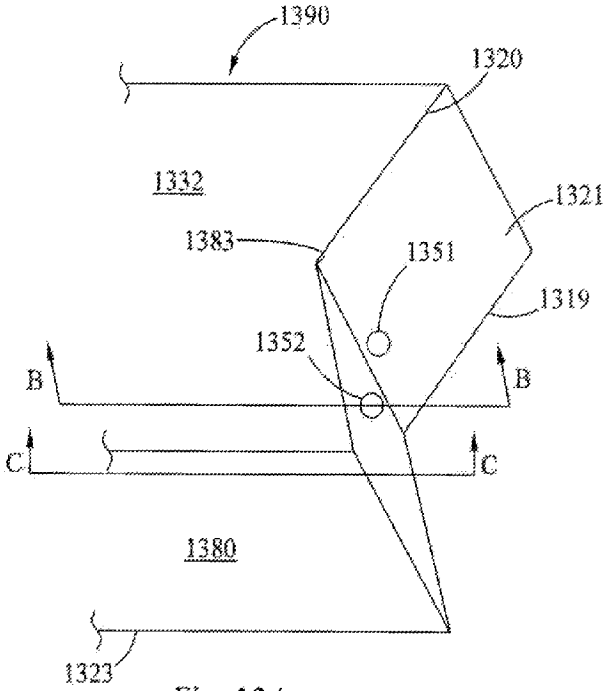
Figure 13C:
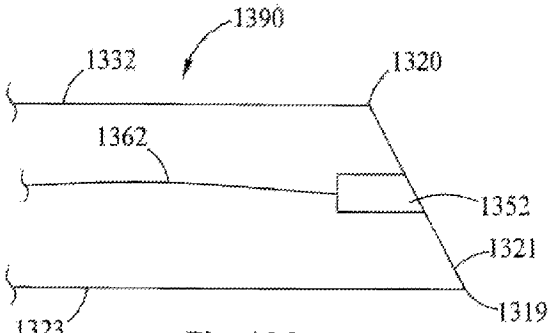

In FIGS. 13A-13C there is shown a configuration of laser cutters in a shear ram, only the leading portion, e.g., the portion intend to engage a tubular, of the ram is shown. Specifically, FIG. 13A shows a perspective view of the ram. FIG. 13B shows transverse cross-sectional view taken along line B-B of FIG. 13A and FIG. 13C shows a vertical cross-sectional view taken along line C-C of FIG. 13A. The ram 1390 has a trailing edge 1320, a trailing edge surface 1332, a leading edge 1319, a leading edge surface 1323, and a face surface 1321 positioned between and connecting the leading edge 1319 and the trailing edge 1320. The shear ram 1390 has two laser cutters 1351 and 1352. These laser cutters are positioned on the face surface 1321 in the general area of the midpoint of the face between the trailing edge 1320 and the leading edge 1319, removed from the side surfaces 1380, 1381, and adjacent the midpoint 1383 of the face between the side surfaces 1380, 1381 as is generally depicted in the figures. Each of the laser cutters 1351 and 1352 has a support cable 1361 and 1362 associated with it. The laser cutters are also essentially unevenly spaced across the face surface 1321.

In FIG. 14 there is shown a configuration of laser cutters in opposing shear rams 1402, 1403, which rams are in initial engagement with a tubular 1402. Shear ram 1403 is the upper ram, having two sides 1481, 1480, and a mating surface 1408. Shear ram 1402 is the lower ram, having two sides 1483, 1482 and a mating surface 1407. Mating surface 1408 has laser cutters 1451, 1452, 1453, 1454, 1455, 1456 and 1457 associated with it. These cutters have support cables associated with them, which cables are not shown in this figure. Mating surface 1409 has laser cutters 1471, 1472, 1472, 1374, 1475, 1476, 1477, and 1478 associated with it. These cutters have support cables associated with them, which cables are not shown in this figure. The cutters on shear ram 1402 are in a staggered relationship to the cutters on shear ram 1403. As such, the beam path leaving a cutter on shear ram 1402, for example beam path 1425 of cutter 1455, would not intersect any cutters on shear ram 1403. Similarly, the beam path leaving a cutter on shear ram 1402, for example beam path 1436 of cutter 1476, would not intersect any cutters on shear ram 1402. The laser cutters are essentially evenly spaced across their respective mating surfaces 1408, 1407.

In FIG. 15 there is shown a configuration of laser cutters in opposing shear rams 1502, 1503, which rams are in initial engagement with a tubular 1502. Shear ram 1503 is the upper ram, having two sides 1581, 1580, and a mating surface 1508. Shear ram 1502 is the lower ram, having two sides 1583, 1582 and a mating surface 1507. Mating surface 1508 has laser cutters 1551, 1552, 1553, 1554, 1555, 1556, 1557, 1558 and 1559 associated with it. These cutters have support cables associated with them, which cables are not shown in this figure. The laser cutters are also essentially evenly spaced with respect to each other and are unevenly spaced across the mating surfaces 1508, 1407, i.e., the cutters spacing in relation to the two sides 1581, 1580.

The firing sequence or order of the firing of laser cutters in the configurations shown in FIGS. 10A-C, 11A-C, 12A-C, 13A-C, 14 and 15 may be in series, sequentially, simultaneous, from the outside to the inside, from the inside to the outside, from side to side, or combinations and variations thereof. Preferably, the laser cutters would be fired sequentially with the central cutters firing first with the adjacent cutters firing next. Thus, turning to the configuration shown in FIGS. 10A-10C, by way of illustration, the cutters would be fired in pairs with the inner most cutters 1055, 1056 being fired first, then cutters 1057, 1054 would fire next, followed by 1058,1053 etc. A high-speed beam switch may be employed to control this firing sequence. Further, the timing of the firing of the laser cutters should be such that the first cutters cut completely through the wall of the tubular, e.g., they make a hole through the tubular, the next cutters will then fire taking advantage of, or otherwise creating, a traveling cut front in the tubular.

Exemplary configurations and arrangements of BOP stacks having shear laser modules (SLM) are contemplated. For example, pre-existing ram shears may be replaced with a shear laser module or multiple shear laser modules, a combination of shear rams and shear laser modules may be added, a shear laser ram assembly may be added, multiple laser modules may be added and combinations of the forgoing may be done as part of a retrofitting process to obtain a retrofitted laser assisted BOP stack. Additionally, larger and newer BOP stacks may also obtain benefits by having a shear laser module added to the stacks components.

Figure 16:
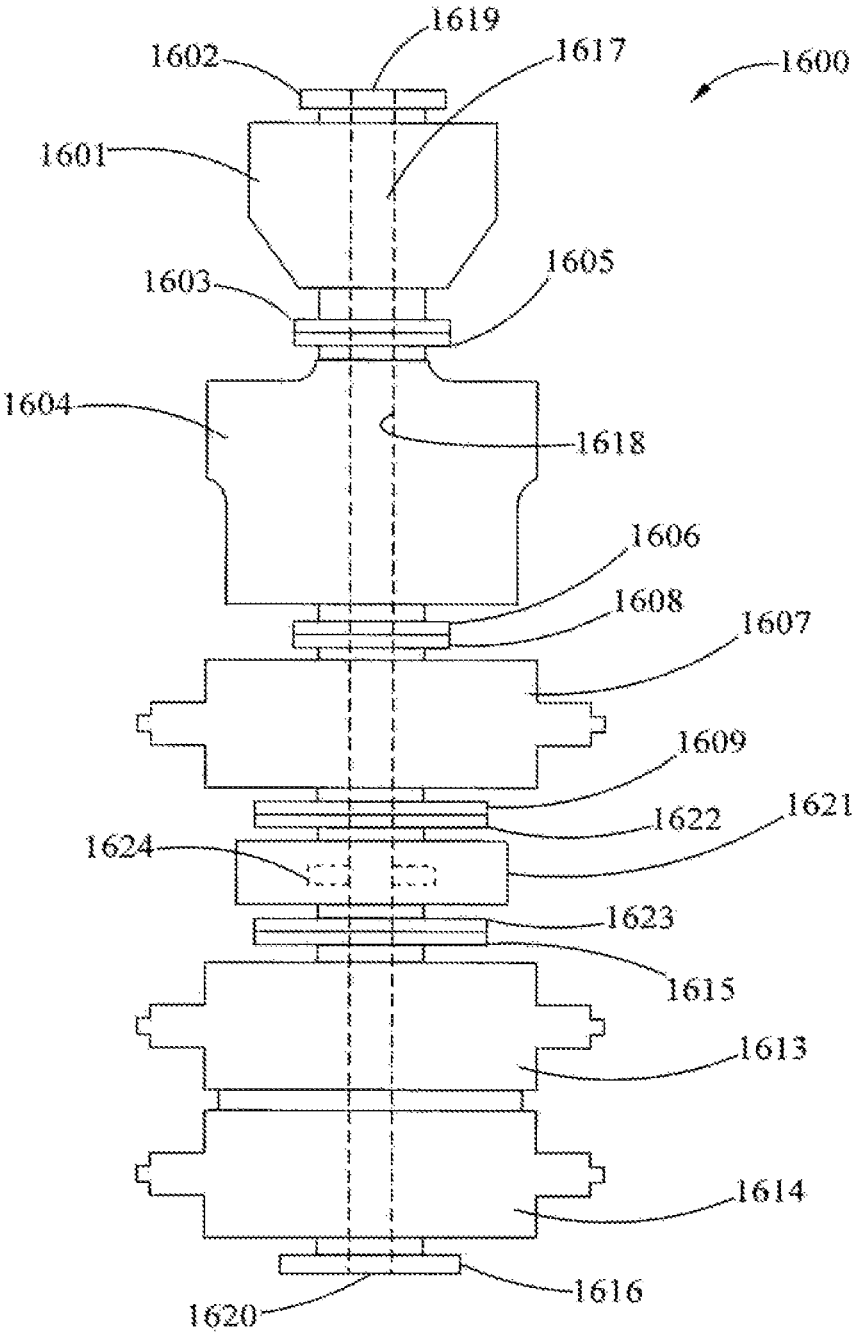
FIG. 16 is a schematic of an embodiment of a laser assisted BOP stack of the present invention to be used with the system of FIGS. 1 and 1A.

Turning to FIG. 16 there is shown an example of an embodiment of a laser assisted BOP stack. Thus, there is shown a laser assisted BOP stack 1600 having, from top 1619 to bottom 1620, a flex joint 1601 with connecters 1602, 1603, an annular preventer 1604 with connecters 1605, 1606, a shear ram 1607 with connecters 1608, 1609, a shear laser assembly 1621 with connecters 1622, 1623 (having a laser delivery assembly 1624 shown in phantom lines), and pipe ram 1613 and pipe ram 1614 with connecters 1615, 1616. The connecters, e.g., 1602 can be any type of connecter known or used by those of skill in the offshore drilling arts, such as for example a flange with bolts, that meet the pressure requirements for the BOP. Each of the components, e.g., shear ram 1607, in the BOP stack 1600 have an internal cavity, or bore, having a wall, which when assembled into the BOP stack forms an inner cavity 1617 having a wall 1618 (shown as in phantom lines in the drawing).

Figure 17:
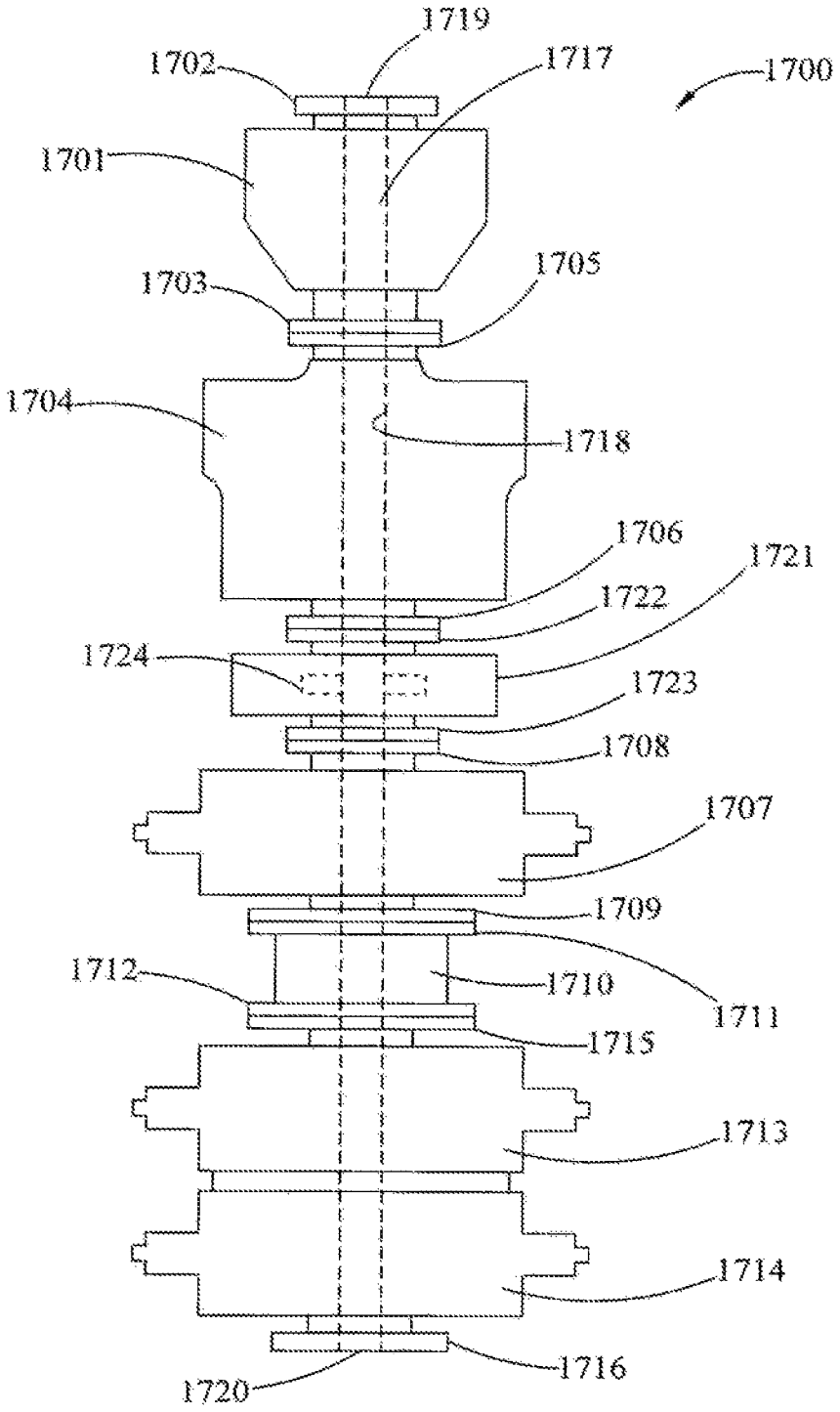
FIG. 17 is a schematic of another embodiment of a laser assisted BOP stack of the present invention to be used with the system of FIGS. 1 and 1A.

In FIG. 17 there is shown an example of a laser assisted BOP stack. Thus, there is shown a laser assisted BOP stack 1700 having, from top 1719 to bottom 1720, a flex joint 1701 with connecters 1702, 1703, an annular preventer 1704 with connecters 1705, 1706, a shear laser assembly 1721 with connecters 1722, 1723 (having a laser delivery assembly 1724 shown in phantom lines), a shear ram 1707 with connecters 1708, 1709, a spacer 1710 with connecters 1711, 1712, and pipe rams 1713, 1714 with connecters 1715, 1716. The connecters, e.g., 1702 can be any type of connecter known or used by those of skill in the offshore drilling arts, such as for example a flange with bolts, that meet the pressure requirements for the BOP. Each of the components, e.g., shear ram 1707, in the BOP stack 1700 have an internal cavity, or bore, having a wall, which when assembled into the BOP stack forms an inner cavity 1717 having a wall 1718 (shown as in phantom lines in the drawing).

Figure 18:
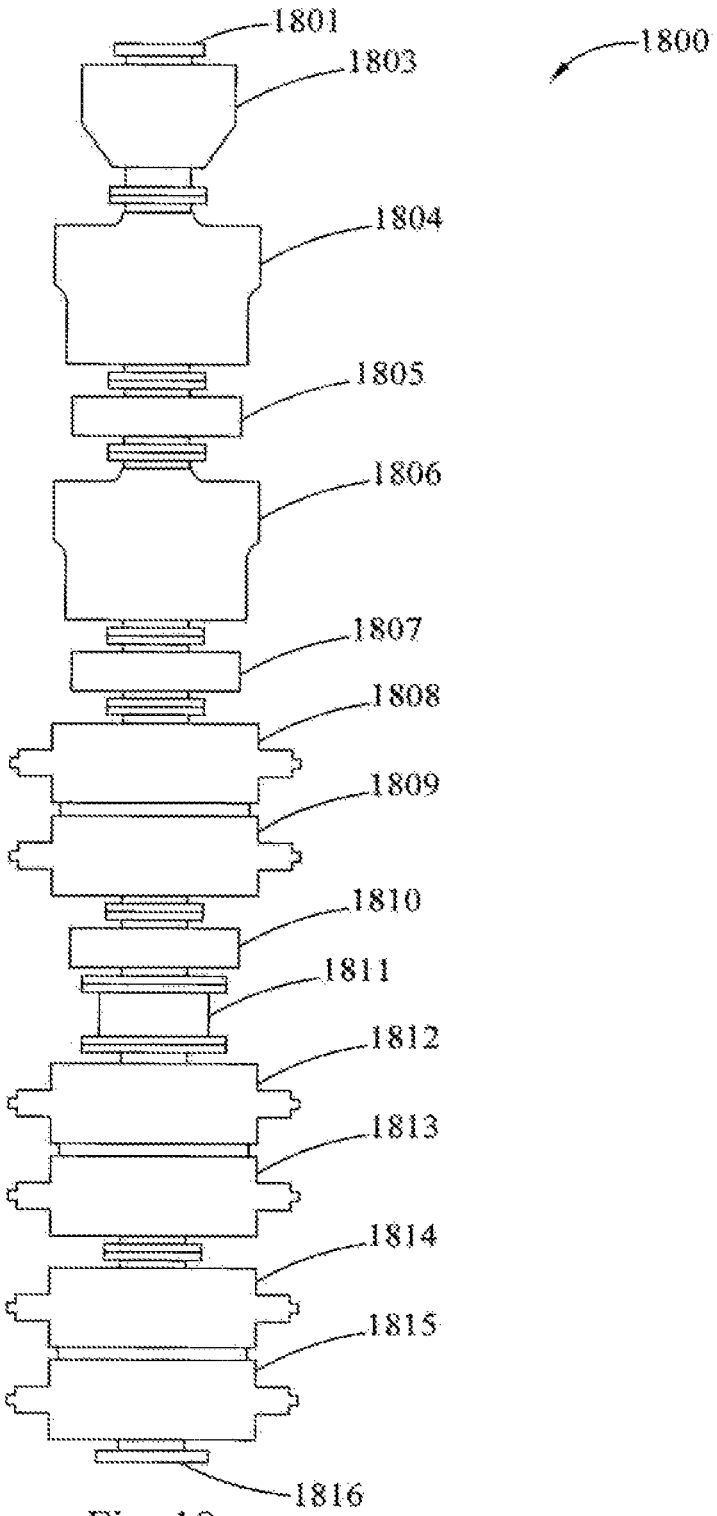
FIG. 18 is an illustration of another embodiment of a laser assisted BOP stack of the present invention to be used with the system of FIGS. 1 and 1A.

In FIG. 18 there is shown an example of a laser assisted BOP stack for ultra deep-water operations of 10,000 feet and greater, although this stack would also operate and be useful at shallower depths. Listing the components from the top of the stack 1801 to the bottom of the stack 1815, the laser assisted BOP stack 1800, has a flex joint 1803, an annular preventer 1804, a shear laser module 1805, an annular preventer 1806, a shear laser module 1807, a shear ram 1808, a shear ram 1809, a shear laser module 1810, a spacer 1811, pipe rams 1812, 1813 and pipe rams 1814, 1815. These components each have bores and when assembled in the stack the bores form a cavity (not shown in this figure) extending from the top 1801 to the bottom 1815 of the stack. The shear laser modules have laser delivery assemblies (not shown in this figure) The components are connected together with connecters of any type suitable for, and that would meet the requirements of, offshore drilling and for this example in particular that would meet the requirements of ultra-deep water offshore drilling.

The laser assisted BOP stacks of may be used to control and manage both pressures and flows in a well; and may be used to manage and control emergency situations, such as a potential blowout. In addition to the shear laser module, the laser assisted BOP stacks may have an annular preventer. The annular preventers may have an expandable packer that seals against a tubular that is in the BOP cavity preventing material from flowing through the annulus formed between the outside diameter of the tubular and the inner cavity wall of the laser assisted BOP. In addition to the shear laser module, the laser assisted BOP stacks may have ram preventers. The ram preventers may be, for example: pipe rams, which may have two half-circle like clamping devices that are driven against the outside diameter of a tubular that is in the BOP cavity; blind ram that can seal the cavity when no tubulars are present, or they may be a shear rams that can cut tubulars and seal off the BOP cavity; or they may be a shear laser ram assemblies In general, laser shear rams assemblies use a laser beam to cut or weaken a tubular, including drilling collars, pipe joints, and bottom hole assemblies that might be present in the BOP cavity.

Figure 19:
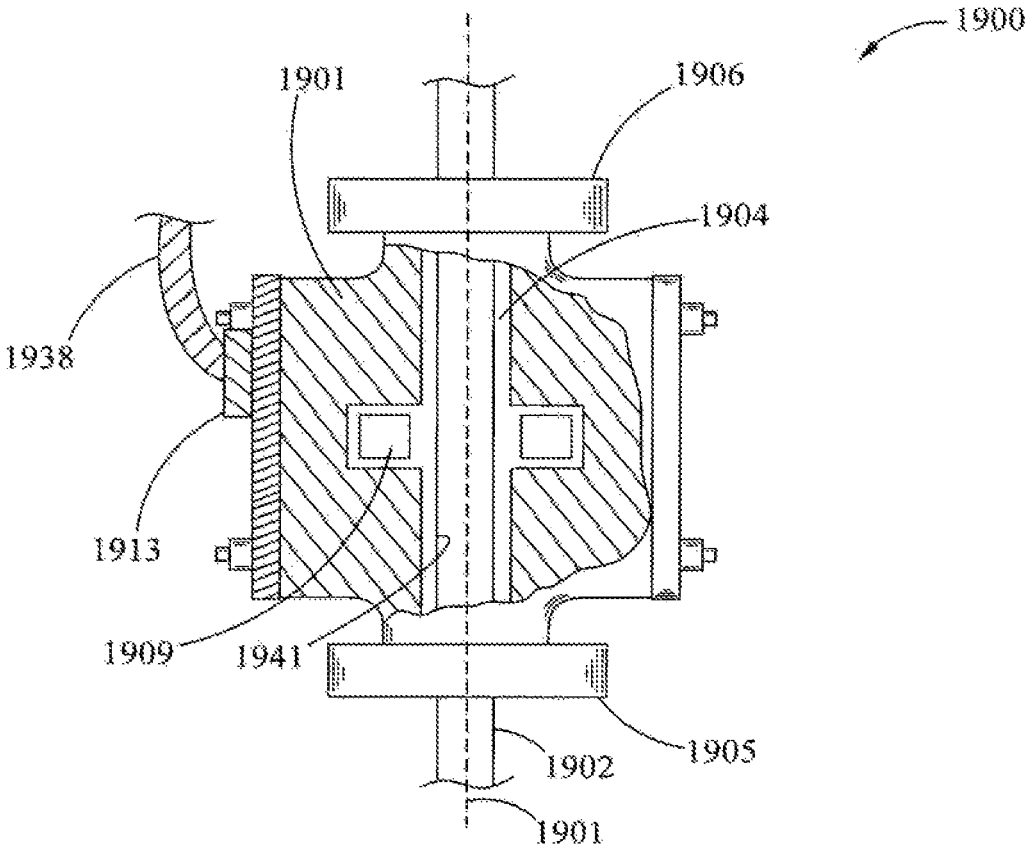
FIG. 19 is a partial cut away cross-sectional view of a section of an embodiment of a shear laser module ("SLM") of the present invention to be used with the system of FIGS. 1 and 1A.

Turning to FIG. 19 there is shown an example of an embodiment of a shear laser module ("SLM") that could be used in a laser assisted BOP stack. The SLM 1900 has a body 1901. The body 1901 has a first connecter 1905 and a second connecter 1906. The inner cavity 1904 has an inner cavity wall 1941. There is also provided a laser delivery assembly 1909. The laser delivery assembly 1909 is located in body 1901. The laser delivery assembly 1909 may be, for example, an annular assembly that surrounds, or partially surround, the inner cavity 1904. This assembly 1909 is optically associated with at least one high power laser source.

Figure 20:
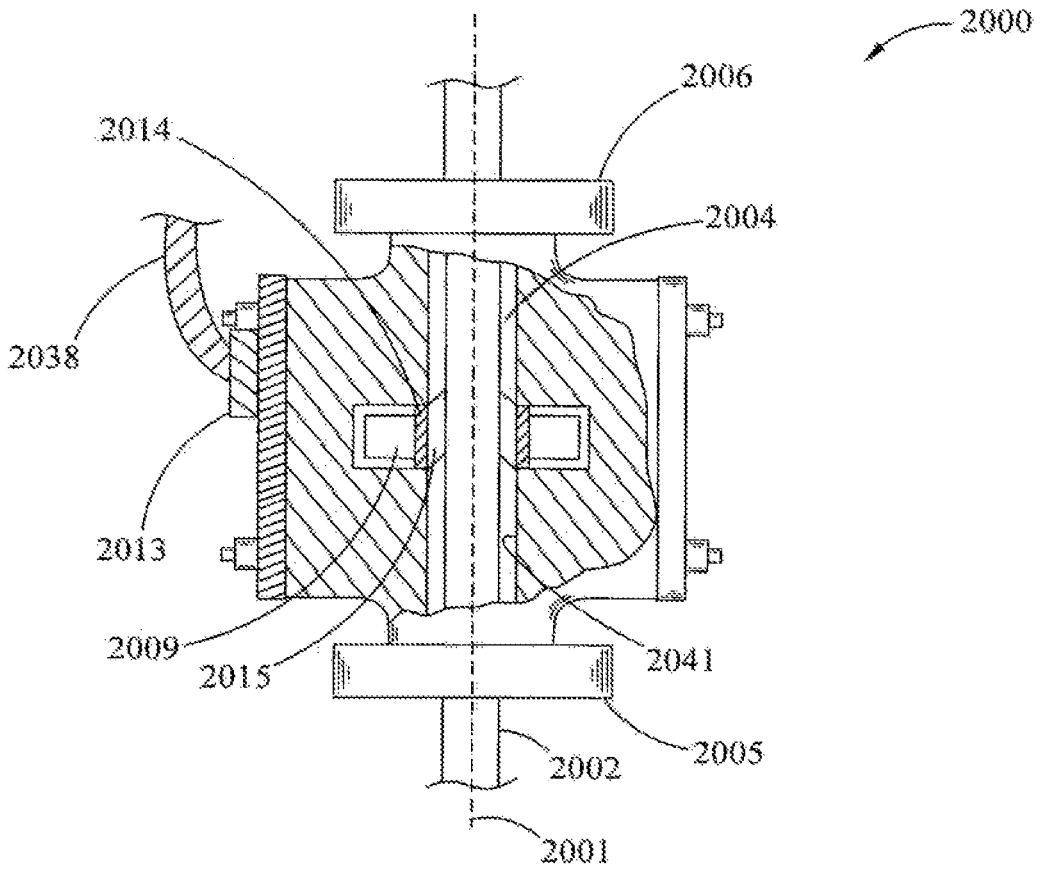
FIG. 20 is a partial cut away cross-sectional view of a section of another embodiment of an SLM of the present invention to be used with the system of FIGS. 1 and 1A.

Turning to FIG. 20 there is shown an example of an embodiment of a shear laser module ("SLM") that could be used in a laser assisted BOP stack. The SLM 2000 has a body 2001. The body 2001 has a first connecter 2005 and a second connecter 2006. The inner cavity 2004 has an inner cavity wall 2041. There is also provided a laser delivery assembly 2009. The laser delivery assembly 2009 is located in body 2001. The laser delivery assembly 2009 may be, for example, an annular assembly that surrounds, or partially surround, the inner cavity 2004. This assembly 2009 is optically associated with at least one high power laser source.

The embodiment of FIG. 20 further contains a shield 2014 for the laser delivery assembly 2009. The shield 2014 is positioned within the body 2001, such that its inner surface or wall 2015 is flush with the cavity wall 2041. In this manner the shield does not form any ledge or obstruction in the cavity 2004. The shield can protect the laser delivery assembly 2009 from drilling fluids. The shield may also manage pressure, or contribute to pressure management, for the laser delivery assembly 2009. The shield may further protect the laser delivery assembly 2009 from tubulars, such as tubular 2002, as they are moved through, in or out of the cavity 2004. The shield may be made of a material, such as steel or other type of metal or other material, that is both strong enough to protect the laser delivery assembly 2009 and yet be quickly cut by the laser beam when it is fired toward the tubular 2002. The shield could also be removable from the beam path of the laser beam. In this configuration upon activation of the laser delivery assembly 2009 the shield would be moved away from the beam path. In the removable shield configuration the shield would not have to be easily cut by the laser beam.

During drilling and other activities, tubulars are typically positioned within the BOP inner cavity. An annulus is formed between the outer diameter of the tubular and the inner cavity wall. These tubulars have an outer diameter that can range in size from about 18" down to a few inches, and in particular, typically range from about 16⅖ (16.04)" inches to about 5", or smaller. When tubulars are present in the cavity, upon activation of the SLM, the laser delivery assembly delivers high power laser energy to the tubular located in the cavity. The high power laser energy cuts the tubular completely permitting the tubular to be moved or dropped away from the rams or annular preventers in the stack, permitting BOP to quickly seal off the inner BOP cavity, and thus the well, without any interference from the tubular.

Although a single laser delivery assembly is shown in the example of the embodiment of FIGS. 19 and 20, multiple laser delivery assemblies, assemblies of different shapes, and assemblies in different positions, may be employed. The ability to make precise and predetermined laser energy delivery patterns to tubulars and the ability to make precise and predetermined cuts in and through tubulars, provides the ability, even in an emergency situation, to sever the tubular without crushing it and to have a predetermined shape to the severed end of the tubular to assist in later attaching a fishing tool to recover the severed tubular from the borehole. Further, the ability to sever the tubular, without crushing it, provides a greater area, i.e., a bigger opening, in the lower section of the severed tubular through which drilling mud, or other fluid, can be pumped into the well, by the kill line associated with the BOP stack.

The body of the SLM may be a single piece that is machined to accommodate the laser delivery assembly, or it may be made from multiple pieces that are fixed together in a manner that provides sufficient strength for its intend use, and in particular to withstand pressures of 5,000 psi, 10,000 psi, 15,000 psi, 20,000 psi, and greater. The area of the body that contains the laser delivery assembly may be machined out, or otherwise fabricated to accommodate the laser delivery assembly, while maintaining the strength requirements for the body's intended use. The body of the SLM may also be two or more separate components or parts, e.g., one component for the upper half and one for the lower half. These components could be attached to each other by, for example, bolted flanges, or other suitable attachment means known to one of skill in the offshore drilling arts. The body, or a module making up the body, may have a passage, passages, channels, or other such structures, to convey fiber optic cables for transmission of the laser beam from the laser source into the body and to the laser delivery assembly, as well as, other cables that relate to the operation or monitoring of the laser delivery assembly and its cutting operation.

Turning to FIGS. 21 and 21A-21C there is shown an example of an embodiment of an SLM that could be used in a laser assisted BOP stack. Thus, there is shown an SLM 2100 having a body 2101. The body has a cavity 2104, which cavity has a center axis (dashed line) 2111 and a wall 2141. The BOP cavity 2104 also has a vertical axis and in this embodiment the vertical axis and the center axis 2111 are the same, which is generally the case for BOPs. (The naming of these axes are based upon the configuration of the BOP and are relative to the BOP structures themselves, not the position of the BOP with respect to the surface of the earth. Thus, the vertical axis of the BOP will not change if the BOP, for example, were laid on its side.) Typically, the center axis of cavity 2111 is on the same axis as the center axis of the wellhead cavity or opening through which tubulars are inserted into the borehole.

The body 2101 contains laser delivery assembly 2109. There is also shown a tubular 2112 in the cavity 2104. The body 2101 also has a feed-through assembly 2113 for managing pressure and permitting optical fiber cables and other cables, tubes, wires and conveyance means, which may be needed for the operation of the laser cutter, to be inserted into the body 2101. The feed-through assembly 2113 connects with conduit 338 for conveyance to a high power laser, or other sources of materials for the cutting operation.

Figure 21:
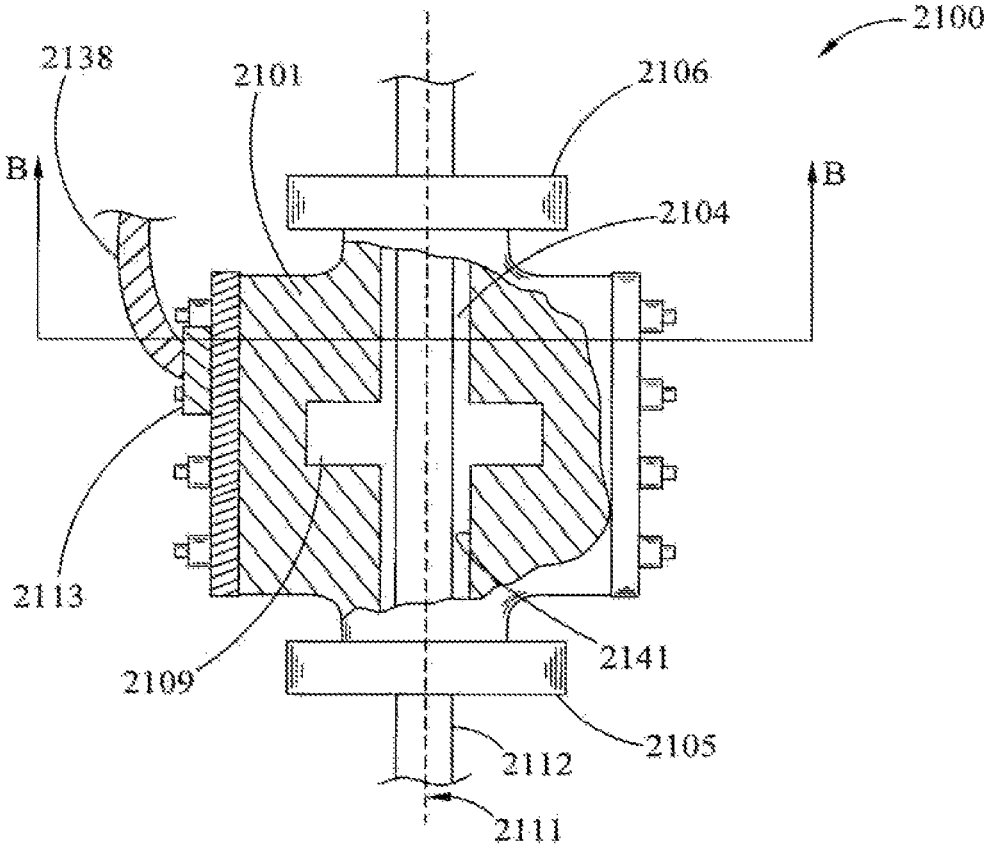
FIG. 21 is a partial cut away cross-sectional view of a section of another embodiment of an SLM of the present invention to be used with the system of FIGS. 1 and 1A.
Figure 21A:
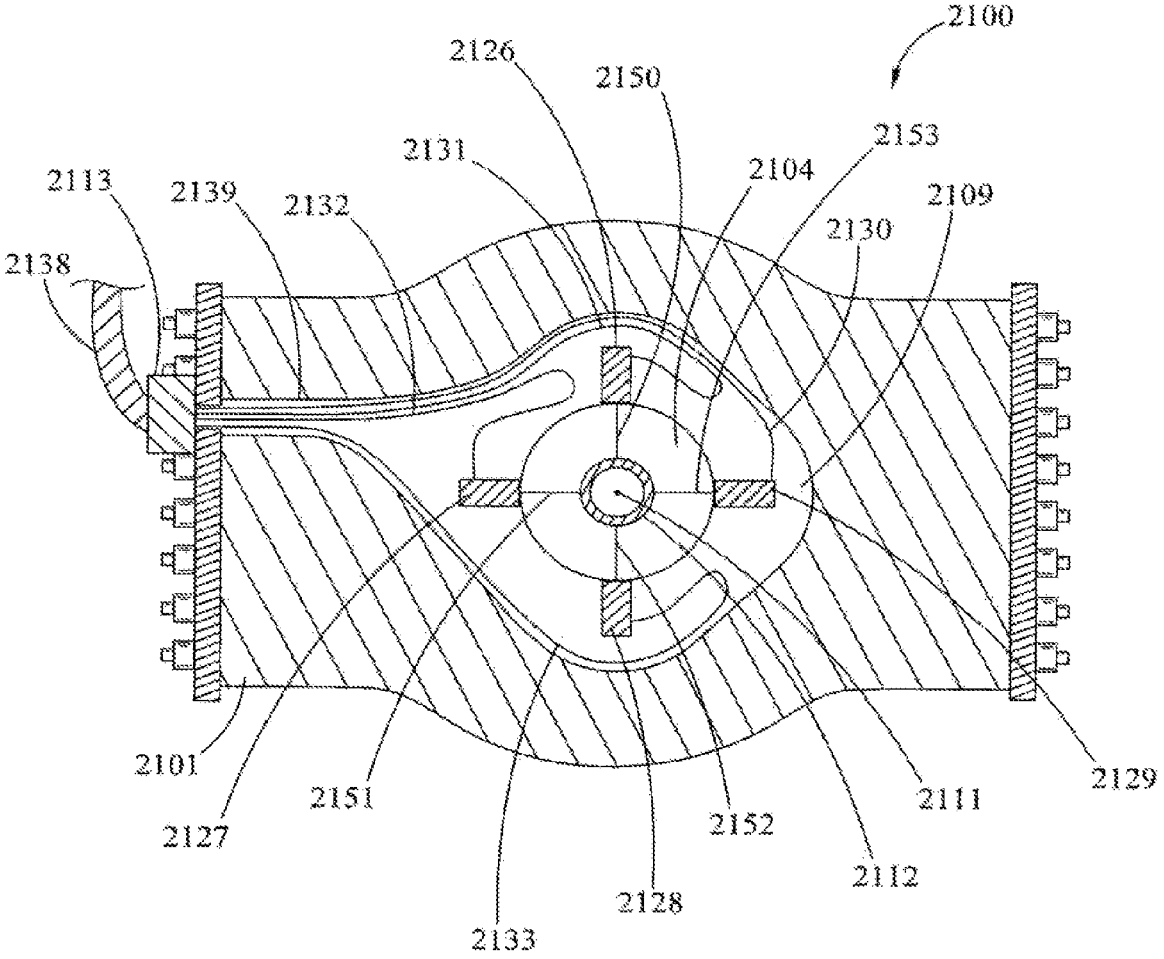
FIGS. 21A, 21B & 21C are transverse cross-sectional views of the SLM of FIG. 21 taken along line B-B.
Figure 21B:
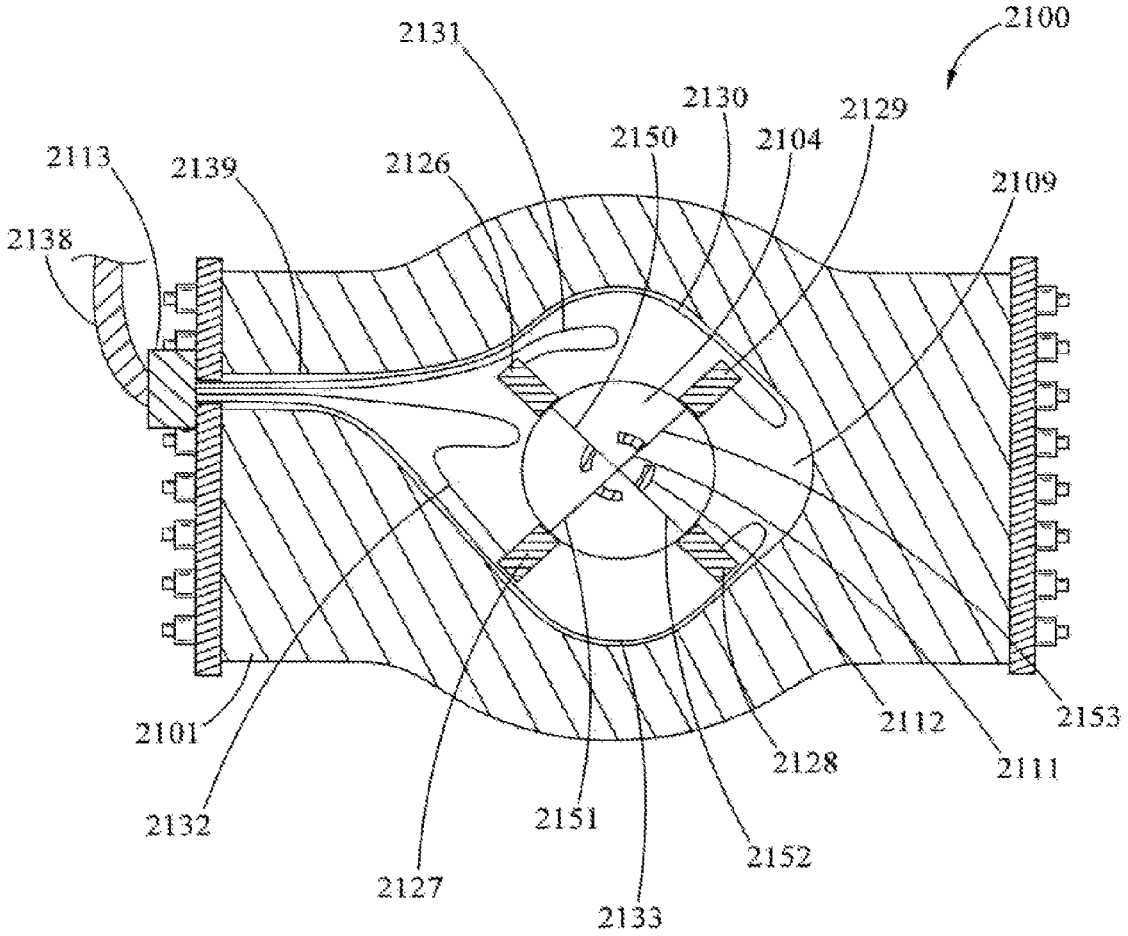
Figure 21C:
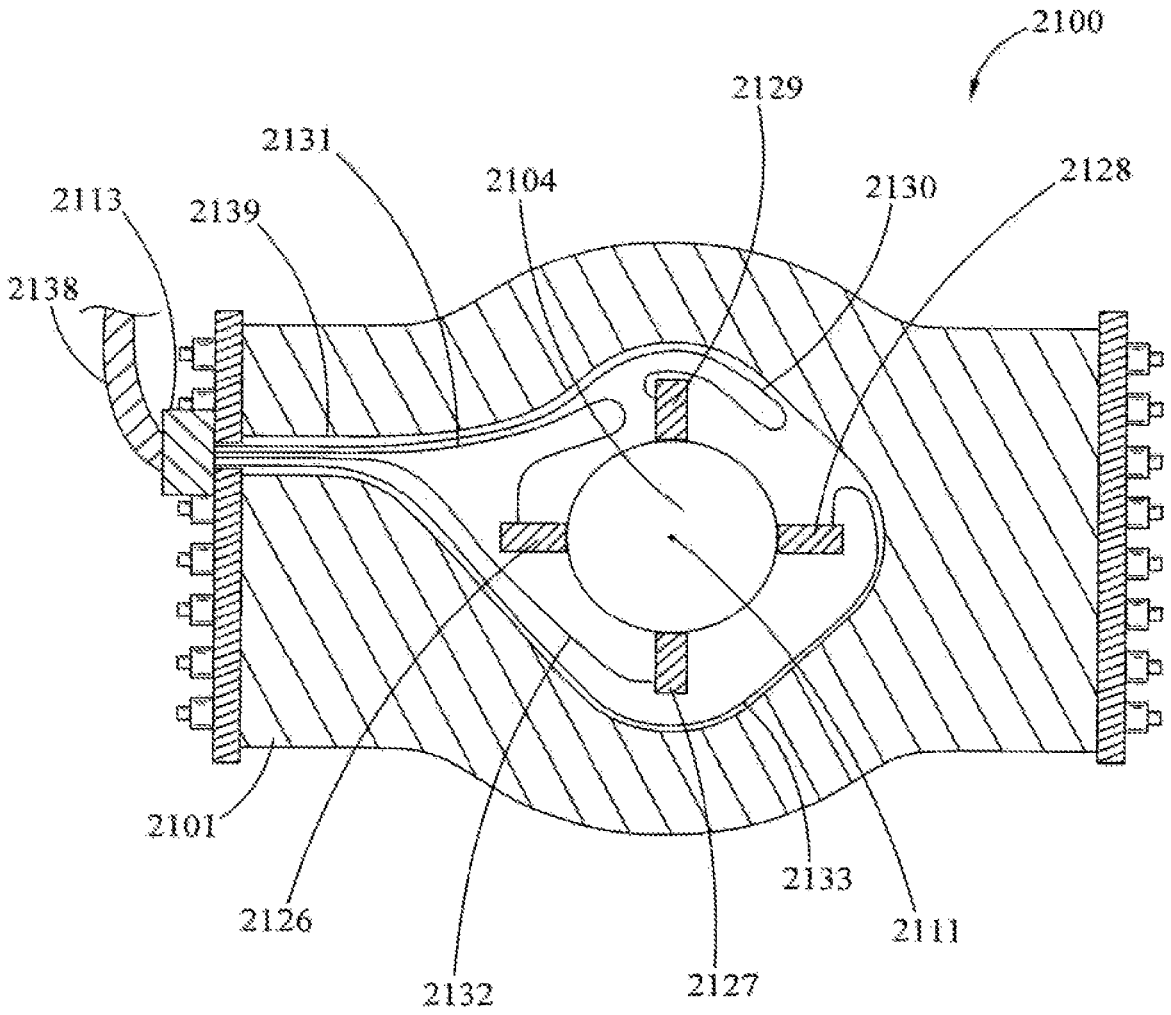

FIGS. 21A to 21C show cross-sectional views of the embodiment shown in FIG. 21 taken along line B-B. FIGS. 21A to 21C also show the sequences of operation of the SLM 2100, in cutting the tubular 2112. In this embodiment the laser delivery assembly 2109 has four laser cutters 2126, 2127, 2128, and 2129. Flexible support cables are associated with each of the laser cutters. Thus, flexible support cable 2131 is associated with laser cutter 2126, flexible support cable 2132 is associated with laser cutter 2127, flexible support cable 2133 is associated with laser cutter 2128, and flexible support cable 2130 is associated with laser cutter 2129. The flexible support cables are located in channel 2139 and enter feed-through assembly 2113. In the general area of the feed-through assembly 2113, the support cables transition from flexible to semi-flexible, and may further be included in conduit 338 for conveyance to a high power laser, or other sources of materials for the cutting operation. The flexible support cables 2130, 2131, 2132, and 2133 have extra, or additional length, which accommodates the orbiting of the laser cutters 2126, 2127, 2128 and 2129 around the axis 2111, and around the tubular 2112.

FIGS. 21A to 21C show the sequence of activation of the SLM 2100 to sever a tubular 2112. In this example, the first view (e.g., a snap shot, since the sequence preferably is continuous rather than staggered or stepped) of the sequence is shown in FIG. 21A. As activated the four lasers cutters 2126, 2127, 2128 and 2129 propagates (which may also be referred to as shooting or firing the laser to deliver or emit a laser beam) laser beams that travel along beam paths 2150, 2151, 2152 and 2153. The beam paths 2150, 2151, 2152 and 2153 extend from the laser cutters 2126, 2127, 2128 and 2129 toward the center axis 2111 and thus intersect the tubular 2112. The beams are directed toward the center axis 2111. As such, the beams are shot from within the BOP, from outside of the cavity wall 2141, and travel along their respective beam paths toward the center axis of the BOP. The laser beams strike tubular 2112 and begin cutting, i.e., removing material from, the tubular 2112.

If the cavity 2104 is viewed as the face of a clock, the laser cutters 2126, 2127, 2128 and 2129 could be viewed as being initially positioned at 12 o'clock, 9 o'clock, 6 o'clock and 3 o'clock, respectively. Upon activation, the laser cutters and their respective laser beams, begin to orbit around the center axis 2111, and the tubular 2112. (In this configuration the laser cutters would also rotate about their own axis as they orbit, and thus, if they moved through one complete orbit they would also have moved through one complete rotation.) In the present example the cutters and beams orbit in a counter clockwise direction, as viewed in the figures; however, a clockwise rotation may also be used.

Thus, as seen in the next view of the sequence, FIG. 21B, the laser cutters, 2126, 2127, 2128 and 2129 have rotated 45 degrees, with laser beams that travel along beam paths 2150, 2151, 2152 and 2153 having cut through four ⅛ sections (i.e., a total of half) of the circumference of the tubular 2112. FIG. 21C then shows the cutter having moved through a quarter turn. Thus, cutter 2126 could be seen as having moved from the 12 o'clock position to 9 o'clock position, with the other cutters having similarly changed their respective clock face positions. Thus, by moving through a quarter turn the beam paths 2150, 2151, 2152 and 2153 would have crossed the entire circumference of the tubular 2112 and the laser beams traveling along those beam paths would severe the tubular.

During the cutting operation, and in particular for circular cuts that are intended to sever the tubular, it is preferable that the tubular not move in a vertical direction. Thus, at or before the laser cutters are fired, the pipe rams, the annular preventer, or a separate holding device should be activated to prevent vertical movement of the pipe during the laser cutting operation. The separate holding device could also be contained in the SLM.

The rate of the orbital movement of the laser cutters is dependent upon the number of cutters used, the power of the laser beam when it strikes the surface of the tubular to be cut, the thickness of the tubular to be cut, and the rate at which the laser cuts the tubular. The rate of the orbital motion should be slow enough to ensure that the intended cuts can be completed. The orbital movement of the laser cutters can be accomplished by mechanical, hydraulic and electro-mechanical systems known to the art.

In FIGS. 23A-C and 24A-B there are shown exemplary embodiments of laser modules associated with a riser having a flanged coupling, such as an HMF coupling. In the "A" figures there is shown the riser flanges in solid lines and the related tubes and the laser module in phantom lines. The "A" figures also have a cut away view with the section taken along lines A-A of the "B" figures removed from the view. In the "B" figures, there is shown a transverse cross-section of the flange and laser module taken along the transverse connection between the two flanges.

Figure 23A:
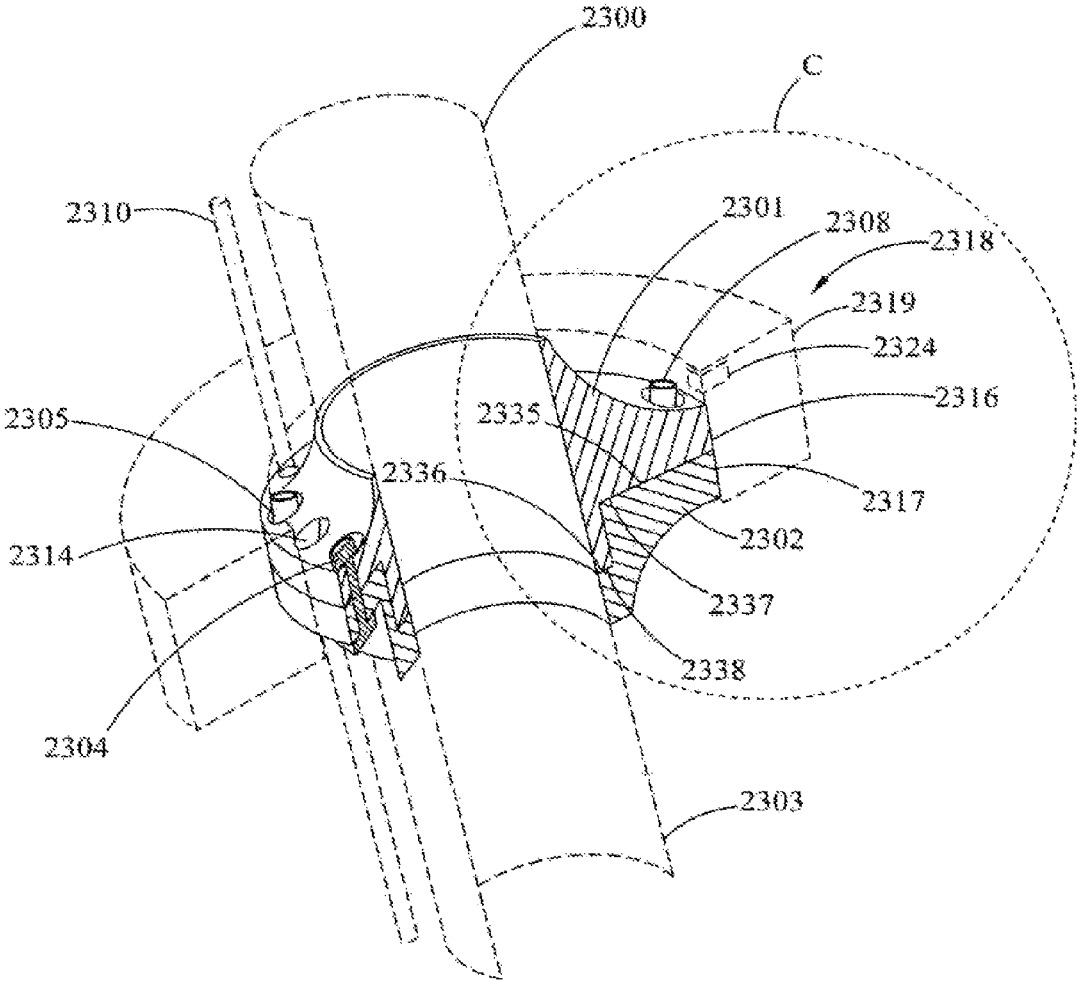
FIG. 23A is a partial cutaway view of an embodiment of a laser module and riser sections of the present invention to be used with the system of FIGS. 1 and 1A.
Figure 23B:
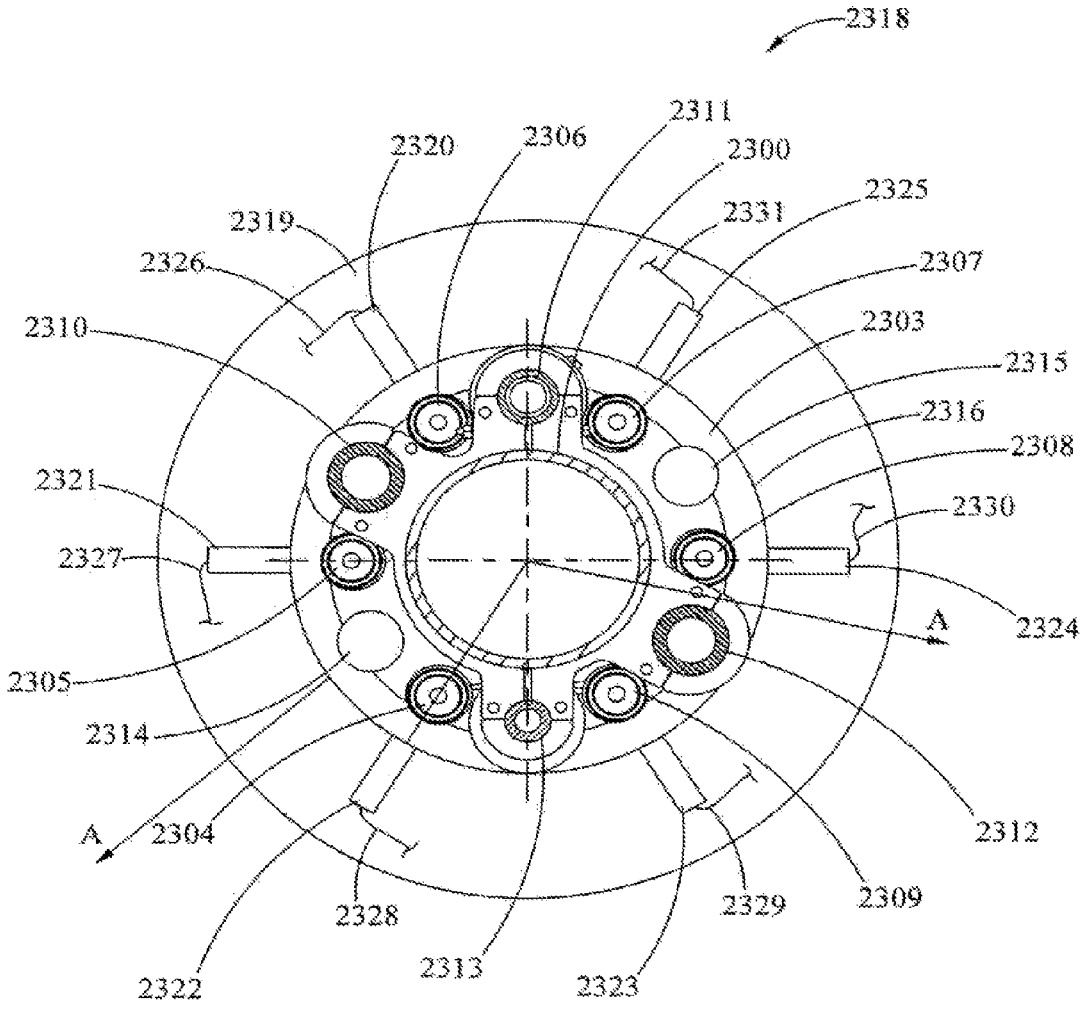
FIG. 23B is a transverse cross-section view of the laser module and riser sections of FIG. 23A.

Thus, turning to FIGS. 23A & 23B there is provided a riser section center tube 2300 that has a flange 2301 attached at its lower end. Riser section center tube 2303 has a flange 2302 attached at it upper end. (Although not shown in this figure, it is recognized that riser section center tube 2300 would have a flange attached to its upper end and that riser section center tube 2303 would have a flange attached to its lower end.) Flange 2301 is attached to upper flange 2302 by bolts and nuts 2304, 2305, 2306, 2307, 2308, 2309. Also associated with the riser sections 2300, 2303 and extending through the flanges 2301, 2302 are a choke line 2310, a booster line 2311, a kill line 2312, a hydraulic line 2313 and blanks (e.g., open unfilled holes in the flange) 2314, 2315. Flange 2301 has an outer surface 2316, a mating surface 2335 and a shoulder surface 2336. Flange 2303 has an outer surface 2317 a mating surface 2337 and a shoulder surface 2338. When the flanges 2301 and 2302 are engaged and connected, surface 2335 is engaged against surface 2337 and surface 2336 is engaged against surface 2338. Laser cutters 2320, 2321, 2322, 2323, 2324, 2325 have flexible support cables 2326, 2327, 2328, 2329, 2330, 2331 respectively. The laser cutters are optically associated with at least one high power laser. The laser cutters are contained within housing 2319 of laser module 2318. In this embodiment the laser cutters are positioned adjacent the heads of the bolts, see, e.g., laser cutter 2324 and bolt 2308, and have beam paths direct toward the bolts.

Figure 23C:
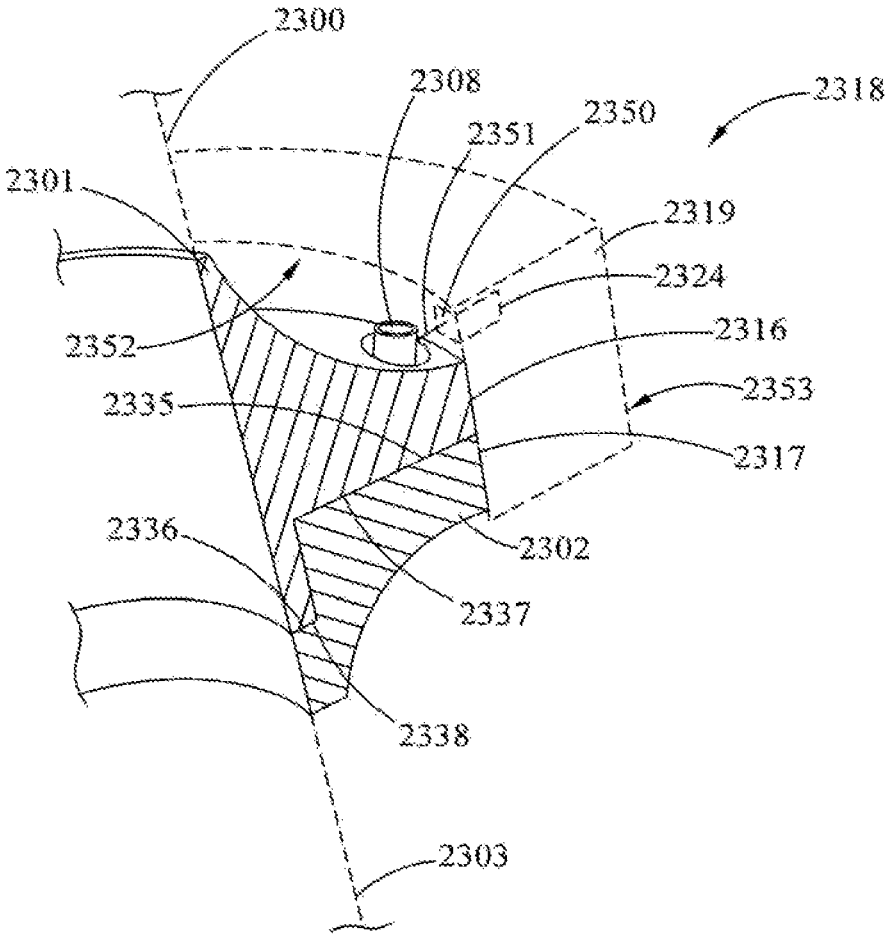
FIG. 23C is an enlarged view of section C of FIG. 23A.

Turning to FIG. 23C, which is an enlarged view of a section of FIG. 23A, there is shown a laser discharge end 2350 of the laser cutter 2324. A beam path 2351, which a laser beam propagated from laser cutter 2324 would follow, extends between laser discharge end 2350 and the component of the riser section to be cut, which in this illustration would be bolt 2308. The housing 2319 has an inner area 2352 that is configured or otherwise adapted to contact, be associated with or engage the components of the riser that are to be cut by the laser. The housing 2319 has an outer area 2353 that is removed from the inner area 2352. In general, the housing inner area will be closest to the riser and the housing outer area will be furthest from the riser.

Figure 24A:
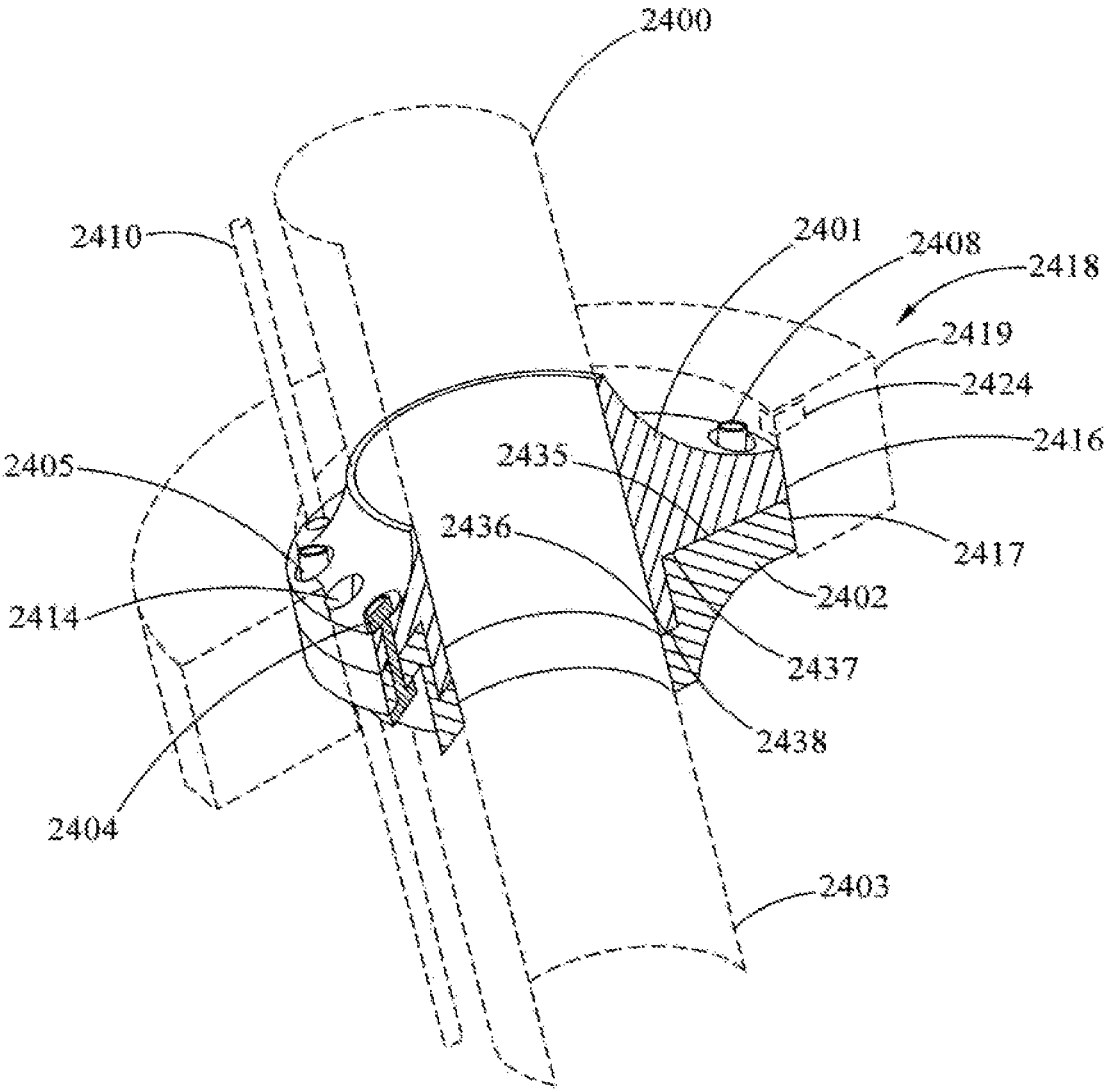
FIG. 24A is a partial cutaway view of another embodiment of a laser module and riser sections of the present invention to be used with the system of FIGS. 1 and 1A.
Figure 24B:
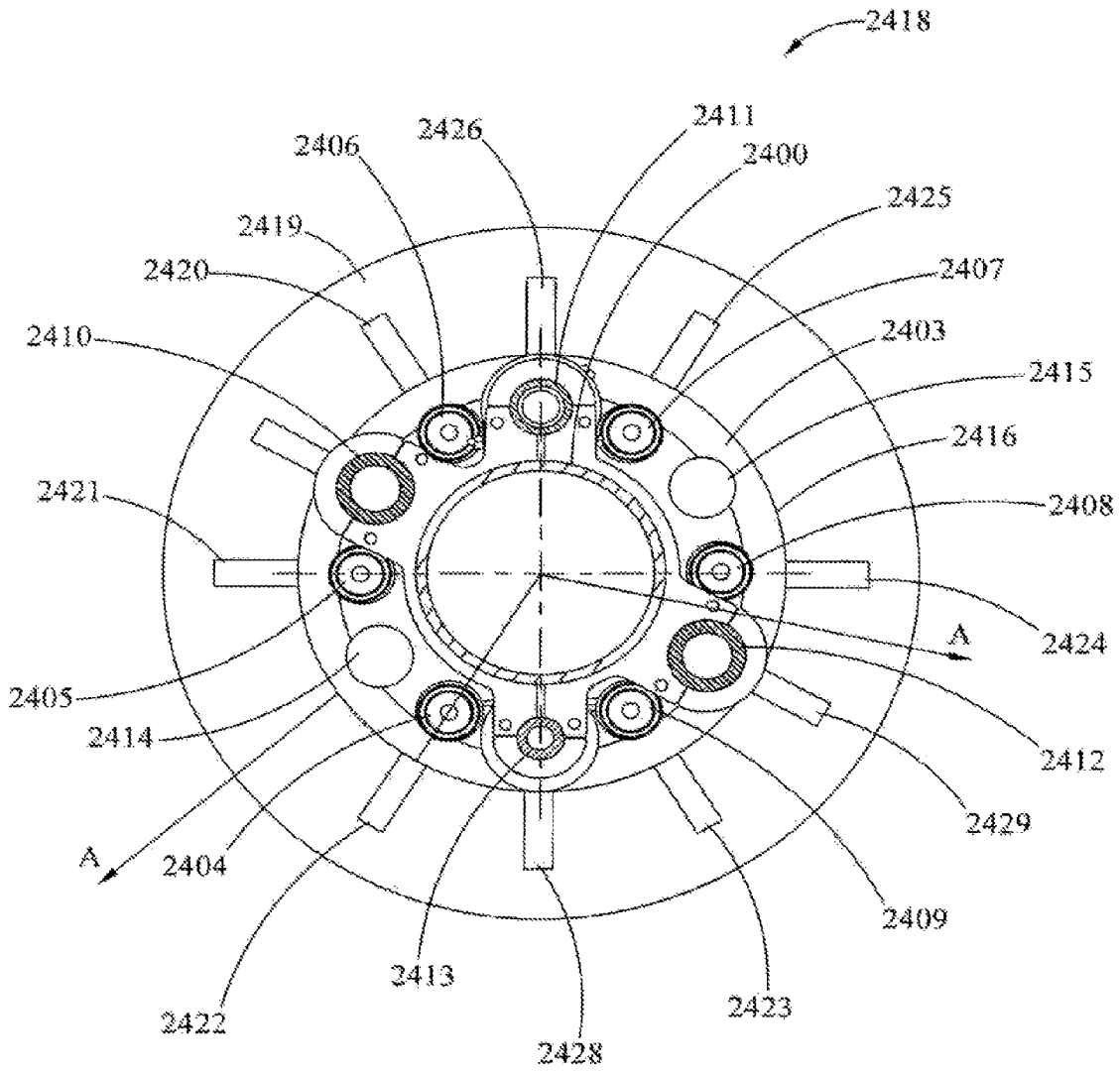
FIG. 24B is a transverse cross-section view of the laser module and riser sections of FIG. 24A.

Turning to FIGS. 24A & 24B there is provided a riser section center tube 2400 that has a flange 2401 attached at its lower end. Riser section center tube 2403 has a flange 2402 attached at it upper end. (Although not shown in this figure, it is recognized that riser section center tube 2400 would have a flange attached to its upper end and that riser section center tube 2403 would have a flange attached to its lower end.) Flange 2401 is attached to upper flange 2402 by bolts and nuts 2404, 2405, 2406, 2407, 2408, 2409. Also associated with the riser sections 2400, 2403 and extending through the flanges 2401, 2402 are a choke line 2410, a booster line 2411, a kill line 2412, a hydraulic line 2413 and blanks (e.g., open unfilled holes in the flange) 2414, 2415. Flange 2401 has an outer surface 2416, a mating surface 2435 and a shoulder surface 2436. Flange 2403 has an outer surface 2417 a mating surface 2437 and a shoulder surface 2438. When the flanges 2401 and 2402 are engaged and connected, surface 2435 is engaged against surface 2437 and surface 2436 is engaged against surface 2438. Laser cutters 2420, 2421, 2422, 2423, 2424, 2425, 2426, 2427, 2428, 2429 each having a flexible support cable (not shown). The laser cutters are optically associated with at least one high power laser. The laser cutters are contained within housing 2419 of laser module 2418. In this embodiment the laser cutters are positioned adjacent the heads of the bolts, see, e.g., laser cutter 2424 and bolt 2408, and adjacent the external pipes, see, e.g., laser cutter 2426 and booster line 2411. The laser cutters have beam paths direct toward the bolts and external pipes.

In another embodiment the laser cutters are positioned adjacent the connection of the two flanges, i.e., ring where the outer surfaces and mating surfaces converge. Thus, in this embodiment the laser cutters are directed into the flange, and have beam paths that intersect, or follow, the annular disc created by the engagement of mating surfaces. In another embodiment the laser cutters are positioned adjacent the shoulders. In this way the laser has a beam path that is directed from the laser cutter to the area where the shoulders engage each other. Additionally, in this embodiment the beam path is directed through the thinnest area of the flange connections, and thus presents the laser cutters with the least amount of material to remove. In a further embodiment the laser cutters are positioned adjacent the nuts of the bolts and have beam paths direct toward the nuts.

A housing for a laser module can be integral with one of the flanges. The house can be in two pieces, with each piece being integral with a flange, and thus, the housing pieces will be joined together as the flanges are connected. The housing may extend inwardly, and join with the central tube, either above or below the flange. When the housing extends inwardly it may be configured to keep water out of the beam path between the laser cutter and the material to be cut, e.g., a bolt head. However, in this housing configuration, care must be taken so that the housing is assembled in a manner that provides for access to the bolts and nuts, as well as, passage for the external pipes. The housing may be in a split ring type of configuration or may be in two or more semi-circular sections, which sections are connected together around the flanges after the flanges have been bolted together, or around the center tube or riser.

Preferably, upon activation the laser cutters will propagate (also commonly referred to as firing or shooting the laser to create a laser beam) their respective laser beams along their respective beam paths. The cutters will then rotate around the riser causing the beam path to cut additional material. Non-rotating laser cutters may be utilized, however, in such a case to assure the quick, clean and controlled severing of the riser greater numbers of cutters should be used. The delivery of the high power laser energy beam will cut, or otherwise, remove the material that is in the beam path. Thus, the high power laser energy, for example, can sever the bolts holding two riser flanges together; and separate or sever the two riser sections that were held together by those bolts.

Although not shown in the figures, the laser modules and the teachings of this specification may be utilized with any type of riser coupling presently existing, including dog styles couplings and rotating key style couplings, as well as, future riser coupling systems, yet to be developed, and riser coupling systems, which the teachings herein may give rise to.

Figure 25A:
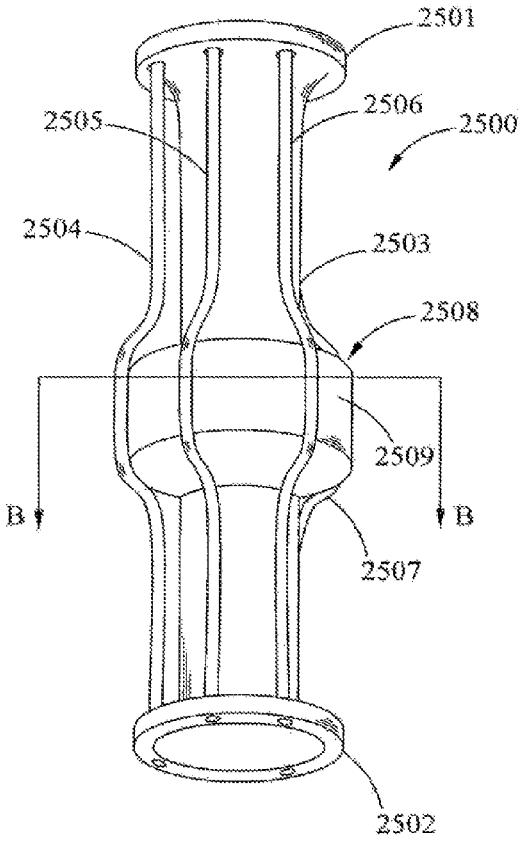
FIG. 25A is a perspective view of an embodiment of a laser riser section of the present invention to be used with the system of FIGS. 1 and 1A.
Figure 25B:
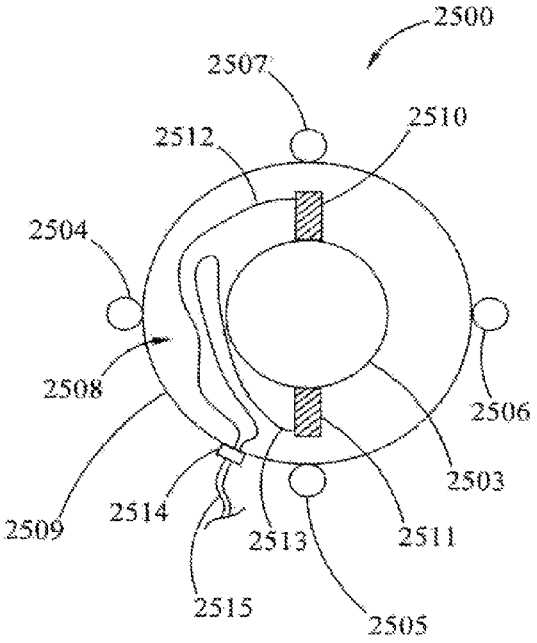
FIG. 25B is a transverse cross-section view of the laser riser section of FIG. 25A.

FIGS. 25A & 25B show an embodiment of a laser riser disconnect section. FIG. 25B is a transverse cross-sectional view of the laser riser disconnect section taken along line B-B of FIG. 25A. There is provided a riser section 2500. The riser section 2500 has a center tube 2503 that has at its ends an upper coupling 2501 and a lower coupling 2502. These coupling may be any type of riser coupling known to those of skill in the drilling arts and would include flange-style, dog-style and rotating key-style couplers. The riser section 2500 has associated therewith four external pipes, a kill line 2504, a choke line 2505, a booster line 2506 and a hydraulic line 2507. The riser section 2500 has a laser module 2508 having a housing 2509. The external pipes are configured to go around, e.g., be exterior to, the laser housing. Thus, laser cutters 2510, 2511 can be adjacent the center tube 2503 of the riser section 2500. The laser cutters have flexible support cables 2512, 2513 that are feed through feed through assembly 2514 and into conduit 2515 for connection to a source of high power laser energy and other materials that may be utilized in the operation or monitoring of the laser cutters. The flexible support cables have extra slack or length to accommodate the rotation of the laser cutters 2510, 2511 around the circumference of the center tube 2503. In the embodiment of FIG. 25B the cutters would have to move about ½ of a rotation to sever the center tube 2503.

It is desirable to have quick disconnect valves or assemblies on the external pipes to facilitate their disconnecting, and closing off or shutting off, when the center tube of the riser, the external pipes, the bolts or other means holding the riser sections together, or all of them are severed. These disconnect means for the external tubes should be positioned in a manner that prevents spillage of the material they are carrying if the laser module is activated and severs the riser or otherwise weakens the riser so that a quick disconnect is possible.

The laser modules or laser cutters may contain a shield to provide protection to the laser cutters, to a lesser or greater extent, from the water, pressure or other subsea environmental conditions in which the riser is deployed. The shield may be part of the housing or it may be a separate component. It may assist in the management of pressure, or contribute to pressure management, for the laser module. The shield may be made of a material, such as steel or other type of metal or other material, that is both strong enough to protect the laser cutters and yet be quickly cut by the laser beam when it is fired. The shield could also be removable from the beam path of the laser beam. In this configuration, upon activation of the laser module the shield would be moved away from the beam path. In the removable shield configuration, the shield would not have to be easily cut by the laser beam.

Although single laser modules are shown for a single riser section, multiple laser modules, modules of different shapes, and modules in different positions, may be employed. Further multiple riser sections each having its own laser module may be utilized in a riser at various positions between the offshore rig and the BOP. The ability to make precise and predetermined laser energy delivery patterns to the riser and the ability to make precise and predetermined cuts in and through risers, provides the ability, even in an emergency situation, to sever the riser without crushing it and to do so with minimal damage to the riser.

The riser laser module may be a single piece that is machined to accommodate the laser cutters, or it may be made from multiple pieces that are fixed together in a manner that provides sufficient strength for its intend use, and in particular to withstand pressures of 1,000 psi, 2,000 psi, 4,500 psi, 5,000 psi and greater. The modules need to be able to operate at the pressures that will occur at depths where the BOP is located, thus for example at depths of 1,000 ft, 5,000 ft, 10,000 ft and potentially greater. The area of the housing that contains the laser cutter may be machined out, or otherwise fabricated to accommodate the laser cutters, while maintaining the strength requirements for the body's intended use. The housing of the laser module may also be two or more separate components or parts, e.g., one component for the upper half and one for the lower half, or one more components for the section of a ring that is connected around the riser. These components could be attached to each other by, for example, bolted flanges, or other suitable attachment means known to one of skill in the offshore drilling arts. The laser module or the housing may have a passage, passages, channels, or other such structures, to convey fiber optic cables for transmission of the laser beam from the laser source into the housing and to the laser cutter, as well as, other cables that relate to the operation or monitoring of the laser delivery assembly and its cutting operation.

The greater the number of laser cutters in a rotating laser module, the slower the rate of orbital motion can be to complete a cut in the same amount of time. Further, increasing the number of laser cutters decreases the time to complete a cut of a riser, without having to increase the orbital rate. Increasing the power of the laser beams will enable quicker cutting of tubulars, and thus allow faster rates of orbiting, fewer laser cutters, shorter time to complete a cut, or combinations thereof.

The invention may be embodied in other forms than those specifically disclosed herein without departing from its spirit or essential characteristics. The described embodiments are to be considered in all respects only as illustrative and not restrictive.

What is claimed:

1. A laser riser and blowout preventer system for use with an offshore drilling rig, a vessel or platform, the laser riser blowout preventer system comprising:

a. a riser;

b. a frame comprising a blowout preventer and a high power laser capable of providing a high power laser beam having greater than 1 kW of power, the blowout preventer comprising a pressure containment cavity;

c. a first laser cutter and a second laser cutter, in optical association with the high power laser, whereby a first cutting high power laser beam is capable of being transmitted from the high power laser to the first laser cutter, and whereby a second cutting high power laser beam is capable of being transmitted from the high power beam switch to the second laser cutter;

d. wherein the first laser cutter is positioned adjacent the riser, whereby the first laser cutter is capable of directing the first cutting high power laser beam at the riser;

e. wherein the second laser cutter is positioned in the blowout preventer, whereby the second laser cutter is capable of directing the second cutting high power laser beam within the pressure containment cavity of the blowout preventer; and, f. a control network in data and control communication with the high power laser and the blowout preventer, wherein the control network provides for firing of the high power laser and actuation of the blowout preventer.

2. The system of claim 1, wherein the control network comprises a programmable logic controller.

3. The system of claim 1, wherein the control network comprises a user interface.

4. The system of claim 1, wherein the control network comprises a memory device comprising a series of instructions for executing a predetermined sequence of laser firing.

5. The system of claim 1, wherein the control network comprises a memory device comprising a series of instructions for executing a predetermined sequence of laser firing and preventer activation.

6. The system of claim 4, wherein the predetermined sequence is tailored to address an offshore situation selected from the group consisting of a drive-off, a drilling emergency, and a kick.

7. The system of claim 5, wherein the predetermined sequence comprises an activity selected from the group consisting of a drive-off, a drilling emergency, and a kick.

8. The system of claim 1, wherein the control network comprises a memory device comprising a series of instructions for executing a control procedure, wherein the procedure is selected from the group consisting of laser firing, preventer actuation, kill pumping, choke pumping, ram actuation and boost pumping.

9. The system of claim 6, wherein the control network comprises a memory device comprising a series of instructions for executing a control procedure, wherein the procedure is selected from the group consisting of laser firing, preventer actuation, kill pumping, choke pumping, ram actuation and boost pumping.

10. The system of claim 1, wherein the high power laser is capable of firing a high power laser beam having at least about 10 kW of power and having a wavelength of about 1083 nm.

11. The system of claim 10, wherein the high power laser is capable of firing a high power laser beam having at least about 20 kW of power.

12. The system of claim 1, wherein the high power laser is capable of firing a high power laser beam having at least about 40 kW of power and the wavelength is about 1550 nm.

13. The system of claim 1, comprising a second high power laser for generating the high power laser beam.

14. The system of claim 13, wherein the second laser is located above the surface of a body of water.

15. The system of claim 13, wherein the second laser is located near the sea floor.

16. A laser riser and blowout preventer system, the laser riser blowout preventer system comprising:

a. a first high power laser for generating a first high power laser beam having a power greater than 1 kW and a second high power laser for generating a second high power laser beam having a power greater than about 1 kW;

b. a riser;

c. a blowout preventer, comprising a pressure containment cavity;

d. a first laser cutter and a second laser cutter; the first laser cutter in optical association with the first high power laser, whereby the first high power laser beam from the first high power laser is capable of being transmitted from the first high power laser to the first laser cutter; and the second laser 1 cutter in optical association with the second high power laser, whereby the second high power laser beam from the second high power laser is capable of being transmitted from the second high power laser to the second laser cutter;

e. wherein the first laser cutter is mechanically and optically associated with the riser, whereby the first laser cutter is capable of delivering the first laser beam to cut the riser and, wherein the second laser cutter is mechanically and optically associated with the blowout preventer, whereby the second laser cutter is capable of delivering the second laser beam within the pressure containment cavity of the blowout preventer; and, f. wherein the second high power laser is located near the sea floor.

17. The system of claim 16, wherein the second laser high power laser is located at the sea floor.

18. The system of claim 17, wherein the blowout preventer comprises a frame, and wherein the second high power laser is mechanically associated with the blowout preventer frame.

19. The system of claim 16, wherein the first high power laser is capable of firing a high power laser beam having at least about 20 kW of power.

20. The system of claim 19, wherein the laser beam wave length is about 1083 nm.

21. A laser riser and blowout preventer system, the laser riser blowout preventer system comprising:

a. a high power laser to generate a high power laser beam having a power greater than about 1 kW;

b. a means to direct the high power laser beam in optical and control association with the high power laser, whereby the high power laser beam from the high power laser is capable of being transmitted from the high power laser to the means to direct the high power laser beam;

c. a riser comprising a first laser cutter, whereby the first laser cutter is capable of directing a first high power laser beam toward a component of the riser;

d. a blowout preventer comprising a pressure containment cavity and a second laser cutter, whereby the second laser cutter is capable of directing a second high power laser beam toward an article within the pressure containment cavity of the blowout preventer; the high power laser located adjacent to the blowout preventer, whereby upon deployment the laser is located subsea; and, e. the first laser cutter and the second laser cutter in optical association with the means to direct the high power laser beam, wherein the first laser cutter and the second laser cutter are capable for receiving a high power laser beam from the high power laser.

22. The system of claim 21, wherein the second laser cutter is capable of completely cutting the article; and the article is selected from the group consisting of a tool, a bottom hole assembly, a tool joint and a drilling collar.

23. The system of claim 21, wherein the article is a drill pipe.

24. The system of claim 21, wherein the riser component is selected from the group consisting of a choke line and a kill line.

25. An offshore drilling rig, vessel or platform having a laser riser and blowout preventer system, the laser riser and blowout preventer system comprising:

a. a high power laser in optical association with a first laser cutter and a second laser cutter, whereby a high power laser beam, having a power of greater than 1 kW, from the high power laser is capable of being transmitted from the high power laser to the first laser cutter, the second laser cutter, or both the first and second laser cutters;

b. a riser comprising a plurality of riser sections, wherein the plurality of riser sections are configured for being lowered from and operably connected to the offshore drilling rig, vessel or platform to a depth at or near a seafloor of a body of water having a surface;

c. a blowout preventer, comprising a pressure containment cavity and configured for being operably connected to the riser and lowered from the offshore drilling rig to the seafloor; the high power laser adjacent the blow out preventer, whereby upon deployment the high power laser is positioned below the surface of the body of water; and, d. the riser comprising the first laser cutter, for emitting the laser beam and defining a first beam path, wherein the first beam path is directed toward the riser;

e. the blowout preventer comprising a second laser cutter for emitting the laser beam and defining a second beam path, wherein at least a portion of the second beam path is within the pressure containment cavity of the blowout preventer; and, f. a control system;

g. wherein, when the riser and blowout preventer are deployed and operably associating the offshore drilling rig, vessel or platform and a borehole in the seafloor, and the control system is configured to control the firing of the first and second laser cutters.

26. The laser riser and blowout preventer system of claim 25, wherein the control system is configured to control the actuation of the blowout preventer.

27. The laser riser and blowout preventer system of claim 25, wherein the high power laser is mechanically associated with the blowout preventer.

28. The laser riser and blowout preventer system of claim 25, wherein the high power laser is mechanically associated with a frame of the blowout preventer.

29. The laser riser and blowout preventer system of claim 25, wherein the high power laser upon deployment is positioned near the sea floor.

30. A method of performing drilling, workover, intervention, completion or service on a subsea well by using a laser riser and blowout preventer system in conjunction with an offshore rig, vessel or platform, the method comprising:

a. lowering a blowout preventer, from an offshore drilling rig, vessel or platform to a seafloor using a riser comprising a plurality of riser sections;

b. wherein the blowout preventer comprises: a high power laser capable of delivering a high power laser beam having at least about 5 kW of power; a blowout preventer pressure containment cavity defined by the blowout preventer; and a first laser cutter for emitting a first laser beam that defines a first beam path, wherein at least a portion of the first beam path is in the blowout preventer pressure containment cavity;

c. wherein the riser comprises: a riser cavity defined by the riser; and a second laser cutter for emitting a second laser beam that defines a second beam path, wherein the second beam path is directed toward a component of the riser;

d. operably connecting the high power laser for providing the first laser beam having a power greater than 1 kW, the second laser beam, having a power greater than 1 kW, or both the first and second laser beams, into a control system;

e. securing the blowout preventer to a borehole having a borehole cavity, whereby the borehole cavity and the riser cavity are in fluid and mechanical communication; and, f. performing operations on the borehole by lowering structures from the offshore rig, vessel or platform down through the riser cavity, the blowout preventer cavity and into the borehole; and, g. wherein, the control system is configured to fire the first and second laser cutters.

31. The method of claim 30, wherein the structures are selected from the group consisting of: tubulars, wireline, coiled tubing and slickline.

32. A method of performing drilling, workover, intervention, completion or service on a subsea well by using a laser riser and blowout preventer system in conjunction with an offshore drilling rig, vessel or platform, the method comprising:

a. positioning a blowout preventer in mechanical association and fluid communication with a borehole in a sea floor, the borehole comprising a borehole cavity;

b. the blowout preventer comprising: a blowout preventer pressure containment cavity defined by the blowout preventer; and a first laser cutter defining a first beam path, wherein at least a portion of the first beam path is in the blowout preventer pressure containment cavity;

c. connecting the blowout preventer and an offshore drilling rig, vessel or platform with a riser;

d. the riser comprising: a riser cavity defined by the riser, wherein the borehole cavity, the blowout preventer pressure containment cavity and the riser cavity are in fluid communication; and a second laser cutter defining a second beam path, wherein the second beam path is directed toward a component of the system, e. operably connecting a high power laser, for providing the first laser beam having a power greater than 5 kW, the second laser beam having a power greater than 5 kW or both the first and second laser beams, into a control system, wherein, the control system is configured to fire the first and second laser cutters; and, f. performing operations on the borehole by moving structures through the riser cavity and the blowout preventer pressure containment cavity.

33. The method of claim 32, wherein the second beam path is directed toward the riser.

34. The method of claim 32, wherein the high power laser is mechanically associated with the blowout preventer.

35. The method of claim 32, wherein the high power laser is mechanically associated with a frame of the blowout preventer.

36. The method of claim 32, wherein the high power laser is located near the sea floor.

37. The method of claim 32, wherein the high power laser is located on the offshore drilling rig, vessel or platform.

38. The system of claim 32, wherein the control system comprises a laser control network and a blowout preventer control network.

39. The system of claim 38, wherein the laser control network and the blowout preventer network are integral.

40. The system of claim 32, wherein the control system comprises a programmable logic controller.

41. The system of claim 32, wherein the control system comprises a user interface.

42. The system of claim 32, wherein the control system comprises a memory device comprising a series of instructions for executing a predetermined sequence of laser firing.

43. The system of claim 32, wherein the control network comprises a memory device comprising a series of instructions for executing a predetermined sequence of laser firing and preventer activation.

44. The system of claim 43, wherein the predetermined sequence is tailored to address an offshore situation selected from the group consisting of a drive-off, a drilling emergency, and a kick.

45. The system of claim 32, wherein the control system comprises a memory device comprising a series of instructions for executing a control procedure, wherein the procedure is selected from the group consisting of laser firing, preventer actuation, kill pumping, choke pumping, ram actuation and boost pumping.

46. A laser riser and blowout preventer system for use with an offshore rig to control and manage potential emergency and emergency situations, the laser riser blowout preventer system comprising:

a. a control system in data and control communication with the high power laser and the blowout preventer, wherein the control system provides for firing of the high power laser and actuation of the blowout preventer;

b. a riser;

c. the blowout preventer comprising a pressure containment cavity;

d. a high power laser capable of providing a high power laser beam having greater than 5 kW of power;

e. a laser cutter defining a laser beam path within the pressure containment cavity of the blowout preventer and capable of directing the high power laser beam along the beam path within the pressure containment cavity of the blowout preventer;

f. the control system comprising a memory device comprising a series of instructions for executing a control procedure, wherein the control procedure is selected from the group consisting of laser firing, preventer actuation, kill pumping, choke pumping, ram actuation and boost pumping.

47. The system of claim 46, wherein the high power laser is mechanically associated with the blowout preventer.

48. The system of claim 46, wherein the high power laser upon deployment of the system is mechanically associated with a frame of the blowout preventer.

49. The system of claim 46, wherein the high power laser is located near the sea floor.

50. The system of claim 46, wherein the high power laser is located on an offshore rig, drilling rig, vessel or platform.

* * * * *